US006070035A

United States Patent [19]

Fujita et al.

[11] Patent Number: 6,070,035

[45] Date of Patent: May 30, 2000

[54] IMAGE FORMING APPARATUS HAVING DEVELOPER SUPPLY DEVICE

[75] Inventors: Syouichi Fujita, Kashiba; Eiji Sato, Nara; Hirofumi Sakita, Tenri; Masato Asanuma, Nara; Itaru Kawabata, Kashiba; Kouichi Takenouchi, Nabari, all of Japan

[73] Assignee: Sharp Kabushiki Kaisha, Osaka, Japan

[21] Appl. No.: 09/162,765

[22] Filed: Sep. 30, 1998

[30] Foreign Application Priority Data

Oct. 29, 1997 [JP] Japan ..... 9-296595

[51] Int. Cl.[7] ..... G03G 15/08

[52] U.S. Cl. ..... 399/258; 399/260

[58] Field of Search ..... 399/258, 260, 399/261, 262, 263

[56] References Cited

U.S. PATENT DOCUMENTS

| | | | |
|---|---|---|---|
| 3,724,725 | 4/1973 | Stauffer | 399/62 |
| 4,558,659 | 12/1985 | Alden | 399/256 |
| 4,803,513 | 2/1989 | Nishise et al. | 399/261 |
| 5,017,966 | 5/1991 | Suga | 399/261 |
| 5,185,631 | 2/1993 | Shibata | 399/263 |
| 5,307,129 | 4/1994 | Miura et al. | 399/263 |
| 5,629,758 | 5/1997 | Kageyama et al. | 399/263 |
| 5,909,609 | 6/1999 | Yahata et al. | 399/258 |

FOREIGN PATENT DOCUMENTS

| | | |
|---|---|---|
| 56-144466 | 11/1981 | Japan . |
| 7-333962 | 12/1995 | Japan . |
| 8-248755 | 9/1996 | Japan . |

*Primary Examiner*—Robert Beatty

[57] ABSTRACT

In an image forming apparatus having a developing unit for developing an image using toner, a toner box for withholding the toner, and a toner transportation section for transporting the toner withheld in the toner box to the developing unit, the toner transportation section includes a transportation screw portion having formed a spiral blade section on its shaft, a pipe section for controlling a toner transportation route by covering the transportation screw portion of the toner transportation section, and a toner flow suppressing section for suppressing flow of the toner from a space between the transportation screw and pipe section. Consequently, a toner transportation opening formed near the transportation section can be closed, and therefore, the flowing of toner into the developing unit can be controlled or reduced by a simple and inexpensive arrangement.

26 Claims, 50 Drawing Sheets

IMAGE FORMING APPARATUS HAVING DEVELOPER SUPPLY DEVICE

FIELD OF THE INVENTION

The present invention relates to an image forming apparatus, such as a copying machine, a facsimile machine, and a printer, and more particularly, to an image forming apparatus arranged to prevent toner powders, which turns to a liquid while being replenished to toner withholding means, from flowing into a developing unit over a predetermined amount.

BACKGROUND OF THE INVENTION

A conventionally known toner supply unit of an image forming apparatus comprises a toner container for withholding toner, a toner transportation path provided between the toner container and a developing unit, and a toner transportation member provided in the toner transportation path, and it is arranged in such a manner that the toner transportation member supplies the toner withheld in the toner container to the developing unit when necessary.

Known as another arrangement of the toner container is a technique disclosed in Japanese Laid-open Patent Application No. 333962/1995 (Tokukaihei No. 7-333962). According to the above publication, the toner container (developer withholding section) is furnished inside with a roller of a developer replenishing member having concavities on its surface, a sealing member for sealing a space between the developer replenishing member and an inner wall of a hopper section, and rotary driving means for rotating the developer replenishing member at a predetermined timing.

In a rotary developing system disclosed in the above publication, the toner container supplies a developing device with the powders of a developer withheld in the hopper section while holding the same in concavities on the surface of the developer supplying member. Also, a space between the developer supplying member and the inner wall of the hopper section is sealed with the sealing member. Moreover, the developer supplying member is arranged to touch the sealing member regardless of an angle at which the developer supplying member is oriented.

Thus, an end of the replenish developer container is always shut off from an end of the developing device with the developer supplying member of the hopper section being provided inbetween. Consequently, the developer is never supplied to the developing device end by natural falling, and powders of the developer are supplied to the developing device end in an adequate quantity by the concavities of the developer supplying member. Thus, this technique is effective in preventing an excessive supply of the developer even when the powders of the developer come to have high fluidity by containing air while the developing device rotates.

A technique disclosed in Japanese Laid-open Patent Application No. 248755/1996 (Tokukaihei No. 8-248755) is known as still another arrangement of the toner container. An image forming apparatus disclosed in the above publication comprises a developing unit and a supplying unit for transporting toner withheld in a toner container by means of a toner transportation member provided in a toner transportation path, and for supplying the toner to the developing unit through a joint portion of the toner transportation path and developing unit, and it is characterized in that an elevated portion is formed in the toner transportation path at the downstream end of a toner transportation route.

Thus, according to the above arrangement, the toner, which has turned into a liquid, will not flow to the downstream end of the toner transportation route from the elevated portion formed in the toner transportation path. Consequently, the toner transportation path can be oriented upward without extending the time required to replenish the toner to the developing unit from the supply unit. In other words, this technique is effective in that the liquid toner is prevented from flowing to the developing unit end with a simple arrangement.

An example adopting a sponge member as the sealing member is disclosed in aforementioned Japanese Laid-open Patent Application No. 333962/1995 (Tokukaihei No. -7-333962). However, it is generally known that the sponge member has very poor durability. Thus, the sealing property is lost as the sponge member deteriorates.

If a rubber member is adopted as the sealing member instead of the sponge member, very high dimensional accuracy is required in the longitudinal direction of the roller of the developer supplying member. Thus, a unit price of each component, and hence a total cost of the apparatus increases undesirably. Further, the flexibility of the rubber member makes is very difficult to seal delicate spaces in the longitudinal direction. Thus, in some cases, the technique disclosed in the above publication can not prevent the flowing of the liquid toner to the developing unit end.

The flowing of the liquid toner to the developing unit end may be prevented by pressing the sealing member hard against the developer supplying member. However, if the sealing member is pressed too hard, the developer supplying member is locked, and the developer may not be supplied in an adequate manner or a load is applied unnecessarily to a driving circuit portion or a driving mechanism portion of the developer supplying member.

Also, in the technique disclosed in aforementioned Japanese Laid-open Patent Application No. 248755/1996 (Tokukaihei No. 8-248755), a space between an exterior of a transportation screw that transports the toner from the hopper and the inside diameter of a transportation pipe is not specifically defined. Thus, it is very difficult to set the space in such a manner that the toner is transported perpendicularly from the transportation screw without causing any leakage, while applying no load on the transportation screw.

In other words, when the exterior of the transportation screw is too large in comparison with the inside diameter of the transportation pipe, a load is applied to the transportation screw, whereas when the exterior is too small, the toner is not transported. Consequently, there arises a problem that a lock phenomenon of the transportation screw occurs or a large quantity of toner is left unused in the hopper.

SUMMARY OF THE INVENTION

The present invention is devised to solve the above problems, and it is therefore an object of the present invention to prevent an excessive supply of toner by controlling or reducing the flowing of liquid toner to a developing device with a simple and inexpensive arrangement, while improving assembling efficiency without increasing rotation torque of a transportation screw.

Also, it is another object of the present invention to improve an effect of lifting toner to a toner transportation opening and the sealing property against replenished toner without diminishing a toner withholding area.

To fulfill the above and other objects, an image forming apparatus of the present invention furnished with:

a developing unit (developing device) for developing an image on a read original document using toner;

a toner box for withholding the toner; and a toner transportation section for transporting the toner withheld in the toner box to the developing unit, is characterized in that the toner transportation section includes:

a transportation screw having a supporting shaft and a spiral blade section formed thereon;

a pipe section for covering the transportation screw in a direction along the supporting shaft; and a toner flow suppressing section for suppressing flow of the toner from a space between the transportation screw and pipe section.

According to the above arrangement, the pipe section covers the transportation screw, in other words, the pipe section covers a toner transportation opening formed near the transportation screw almost entirely. Moreover, the toner flow suppressing section suppresses the flow of the toner from a space between the transportation screw and pipe section. Thus, it has become possible to suppress the flowing of the toner into the developing unit.

An image forming apparatus of the present invention furnished with:

a developing unit (developing device) for developing an image on a read original document using toner;

a toner box for withholding the toner; and a toner transportation section for transporting the toner withheld in the toner box to the developing unit, may be characterized in that the toner transportation section includes:

a transportation screw having a supporting shaft and a spiral blade section formed thereon; and a pipe section for covering the transportation screw in a direction along the supporting shaft, a space between an inside diameter of said pipe-wise member and an exterior of said transportation screw becomes smaller toward a toner replenish opening of said developing device.

The above arrangement makes it possible to suppress the flowing of the toner into the developing unit.

An elastic element may be provided to the pipe section or an elastic element, a brush, or a spring may be wrapped around the transportation screw as the toner flow suppressing section. Consequently, besides the flowing of the toner can be suppressed more effectively, the follow-up property of the toner can be improved and a quantity of transported toner can be increased.

To fulfill the above and other objects, another image forming apparatus of the present invention furnished with:

a developing unit for developing an image on a read original document using toner;

a toner box for withholding the toner; and a toner transportation section for transporting the toner withheld in the toner box to the developing unit, is characterized in that the toner box includes a toner stirring section inside, the toner stirring section closing a toner transportation opening formed at the toner box when at least an initial setting action or a toner replenishing action is carried out.

According to the above arrangement, the toner transportation opening is closed using the toner stirring section provided in the toner box in advance. Thus, the flowing of the toner to the developing unit can be suppressed. Moreover, since no additional arrangement is necessary in the toner box, the arrangement of the image forming apparatus can be simplified.

It is preferable that the toner stirring section is formed as a lifting section for lifting up the toner to the transportation screw. When it is arranged that the lifting section closes the toner transportation opening, the flowing of the toner can be prevented more effectively.

Further, the flowing of the toner can be suppressed in a more secure manner by changing the shape of the lifting section or reinforcing the lifting section.

To fulfill the above and other objects, still another image forming apparatus of the present invention furnished with:

a developing unit for developing an image on a read original document using toner;

a toner box for withholding the toner; and a toner transportation section for transporting the toner withheld in the toner box to the developing unit, is characterized in that the toner box includes a flowing toner preventing section, the flowing toner preventing section being placed at a position to allow the following toner preventing section to close a toner transportation opening formed at the toner transportation section.

According to the above arrangement, the flowing of the toner to the developing unit can be suppressed effectively by providing the flowing toner preventing section.

It is preferable to arrange the above image forming apparatus in such a manner that it is further furnished with a replenish opening which can be opened/closed by an opening/closing shutter and through which the toner is replenished to the toner box, and that the flowing toner preventing section is movable to close a toner transportation opening provided at the toner transportation section when the opening/closing shutter is open, and to open the toner transportation opening when the opening/closing shutter is closed.

Also, the flowing toner preventing section may be a vibration plate provided inside the toner box. The vibration plate may be further arranged to receive vibrations in association with a stirring action of the toner stirring section. In addition, the flowing toner preventing section may be split and provided inside the toner box while having a discharge opening portion smaller than the toner replenish opening.

The flowing of the toner can be prevented furthermore effectively by adopting the above arrangement.

The flowing toner preventing section may be arranged to close the toner transportation opening of the toner transportation section in association with an action of opening/closing a main body exterior portion of the image forming apparatus.

According to the above arrangement, for example, the toner transportation opening can be opened/closed in advance when the front part of the main body exterior portion is opened/closed. Also, even if a vibration, caused by a small impact when the developing unit is pulled out from the main body, is conveyed, the toner does not flow into the developing unit.

For a fuller understanding of the nature and advantages of the invention, reference should be made to the ensuing detailed description taken in conjunction with the accompanying drawings.

BRIEF DESCRIPTION OF THE DRAWINGS

FIG. 19(*b*) is a side view depicting the shape of the toroidal elastic material;

FIG. 33(*b*) is a side view partially depicting an arrangement of gears provided to the driving section;

FIG. 39(*b*) is a view explaining an arrangement of an end portion of a lifting section provided to the toner box of FIG. 39(*a*);

DESCRIPTION OF THE EMBODIMENTS

Referring to the accompanying drawings, the following description will describe an example embodiment of the present invention.

In the present embodiment, a digital copying machine is used as an example image forming apparatus, and the arrangements of the present invention are adopted to a developing device of the digital copying machine. However, it should be appreciated that the present invention is not limited to the use for the developing device of the digital copying machine, and it can be also applied to a general developing section in electrophotographic analog copying machines, facsimile machines, printers, etc.

Further, the present embodiment describes an example case where the image forming apparatus includes a single developing device. However, it should be also appreciated that the present invention is not limited to such a case, and the present invention is applicable to a color copying machine including more than one developing device as well.

Figure 1:
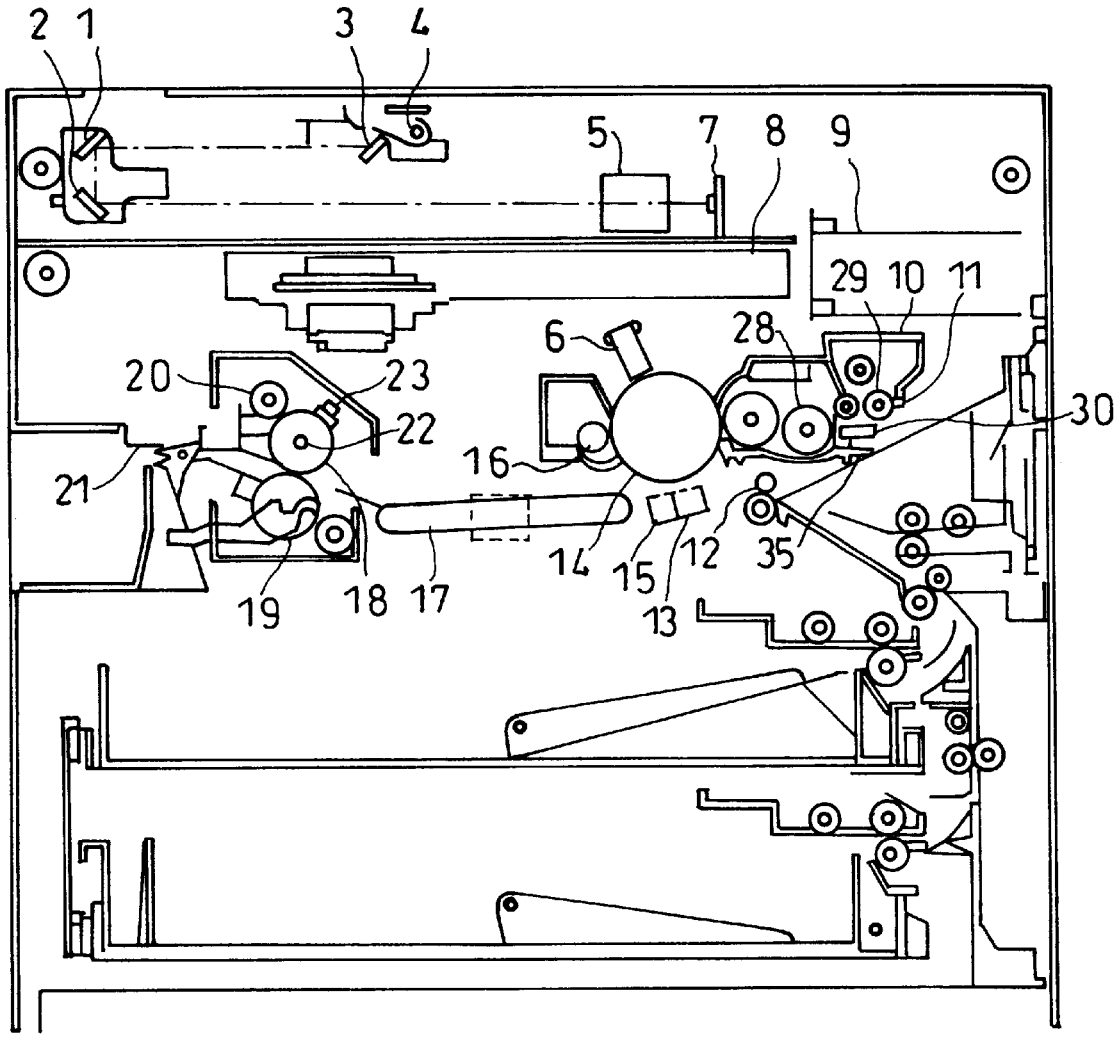
FIG. 1 is a side view depicting an arrangement of an overall image forming apparatus in accordance with an example embodiment of the present invention.

The digital copying machine used as an example image forming apparatus in the present embodiment comprises an image reading section, a paper feeding section, an image forming section, a fusing section, a paper discharging section, etc. To be more specific, as shown in FIG. 1, the image reading section of the digital copying machine includes a lamp (light source) 4, a first mirror 3, a second mirror 1, a third mirror 2, a lens 5, and a CCD substrate 7 having provided thereon a CCD element, a laser scanning unit 8, an ICU 9 for carrying image processing, etc. The paper feeding section includes a resist roller 12 and the like.

The image forming section includes a main charger unit 6, a developer bath 10, a developing bath unit 11, a transfer charger 13, a photosensitive drum 14, a separating charger 15, a cleaner 16, a stirring roller 28, a developing unit (developing device) 29, a toner hopper 30, a toner density sensor 35, etc.

The fusing section includes a suction belt 17, an upper heat roller 18, a lower heat roller 19, an upper cleaning roller 20, a discharge paper branching gate 21, a heater lamp 22, a fusing thermistor 23, etc.

Next, an image forming operation of the above-arranged image forming apparatus (digital copying machine) will be explained.

In the first place, an unillustrated original document having thereon a certain image to be copied is set to the image reading section. Then, light is irradiated to the original document from the lamp 4, for example, a halogen lamp or a fluorescent lamp, and reflected light is converged on the CCD element on the CCD substrate 7 through the first mirror 3, second mirror 1, third mirror 2, and lens 5 to form an image thereon, and the resulting image is converted to an electrical signal.

The electrical signal is processed by the ICU 9 in a predetermined manner, after which a laser beam is irradiated from the laser scanning unit 8 onto the photosensitive drum 14 in the image forming section in accordance with the electrical signal.

Since the photosensitive drum 14 is charged to a predetermined potential by the main charger unit 6, an electrostatic latent image is formed on the photosensitive drum 14 upon exposure by the laser beam. Here, toner (developer) filled in a toner box (toner withholding means) 24 for withholding toner which will be supplied to the developer bath 10 described below is charged by frictional electrification in the image forming section. Thus, toner is supplied from the developer bath 10 under these conditions, whereby the toner is attracted to the photosensitive drum 14 by a potential difference between the toner and photosensitive drum 14.

Then, an unillustrated recording paper (recording medium) which is suspended by the resist roller 12 in the paper feeding section is transported to a predetermined position near the photosensitive drum 14 as the resist roller 12 rotates. After the transported recording paper synchronizes to the photosensitive drum 14, the recording paper is overlaid on the photosensitive drum 14 around which the toner is attracted.

The transfer charger 13 is activated behind the overlaid recording paper to charge the recording paper with charges. Consequently, an electric field, through which toner powders are attracted to the recording paper from the photosensitive drum 14, is developed by the charges adhering to the recording paper.

Then, when the recording paper is separated from the photosensitive drum 14 by the separating charger 15, the toner is transferred onto the recording paper, while the toner powders remaining on the photosensitive drum 14 are removed by the cleaner 16.

The recording paper having thereon transferred the toner powders is transported to the fusing section as the suction belt 17 turns. In the fusing section, the recording paper is sandwiched by the upper heat roller 18 and lower heat roller 19, whereby a toner image formed on the recording paper is thermo-compression fusing. The fusing method is not limited to the above thermo-compression fusing, and simple compression fusing is also applicable.

The heater lamp 22 is provided inside the upper heat roller 18 used for the fusing, and a temperature thereof is controlled by the fusing thermistor 23.

The upper cleaning roller 20 removes the toner remaining on the upper heat roller 18.

A job of converting an image on the original document to digital data and making a copy of the same on the recording paper completes when the above toner removal action ends.

Next, a job of replenishing the toner to the developing unit 29 by the user or manipulator of the image forming apparatus (digital copying machine) of the present invention will be explained. In the present embodiment, a toner replenishing job at the end of the toner (empty toner) will be explained as an example. In this toner replenishing job, for example, a toner cartridge 25 is attached/detached to/from the toner box 24 to replenish toner, which will be explained in the following with reference to the accompanying drawings.

Figure 2B:
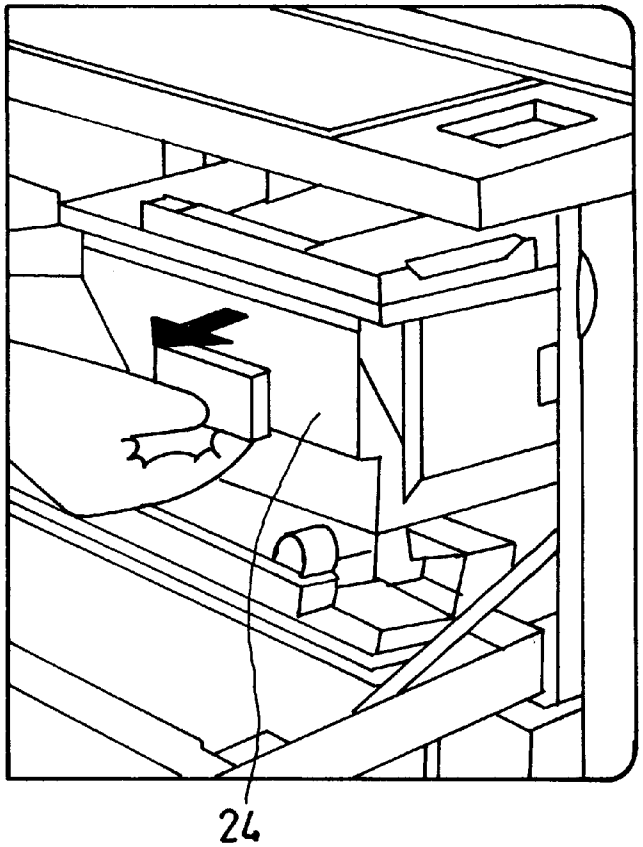
FIGS. 2(*a*) and 2(*b*) are views showing a procedure of toner filling job using a toner cartridge when the toner is replenished.
Figure 2A:
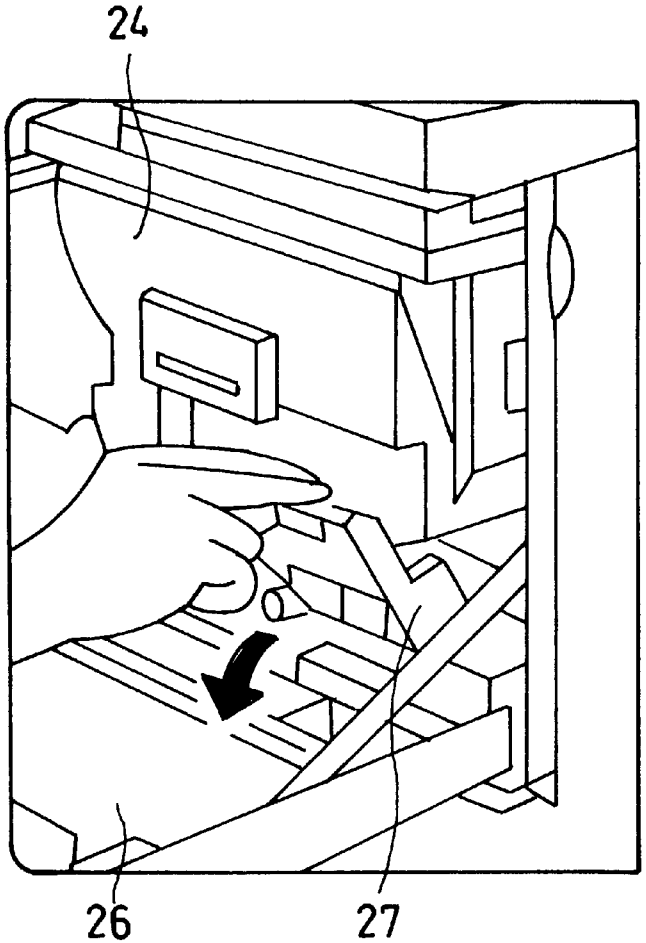

To begin with, as shown in FIG. 2(*a*), a cabinet 26, which is a front part of the main body, is opened in a direction indicated by an arrow, and a toner box lever 27 is pushed down. Then, as shown in FIG. 2(*b*), the toner box 24 is pulled out forward until it stops.

Figure 3:
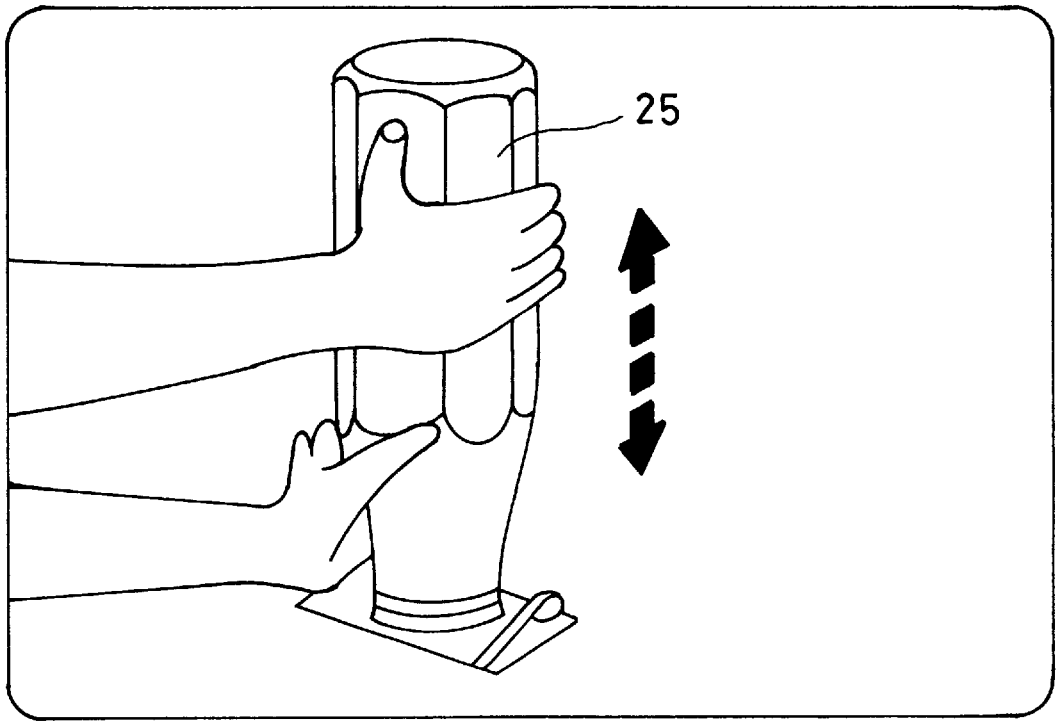
FIG. 3 is a view showing a procedure following the procedure shown in FIGS. 2(*a*) and 2(*b*)

Then, as shown in FIG. 3, a new toner cartridge 25 is shaken vertically (in a direction indicted by an arrow in the drawing) for several times, whereby the toner inside the toner cartridge 25 contains air, and the fluidity of the toner is improved. The fluidity is improved to an extent such that the toner almost turns into a liquid, and this fluid toner (hereinafter, referred to as liquid toner) is dropped to the toner box 24 naturally in the succeeding steps.

Figure 4B:
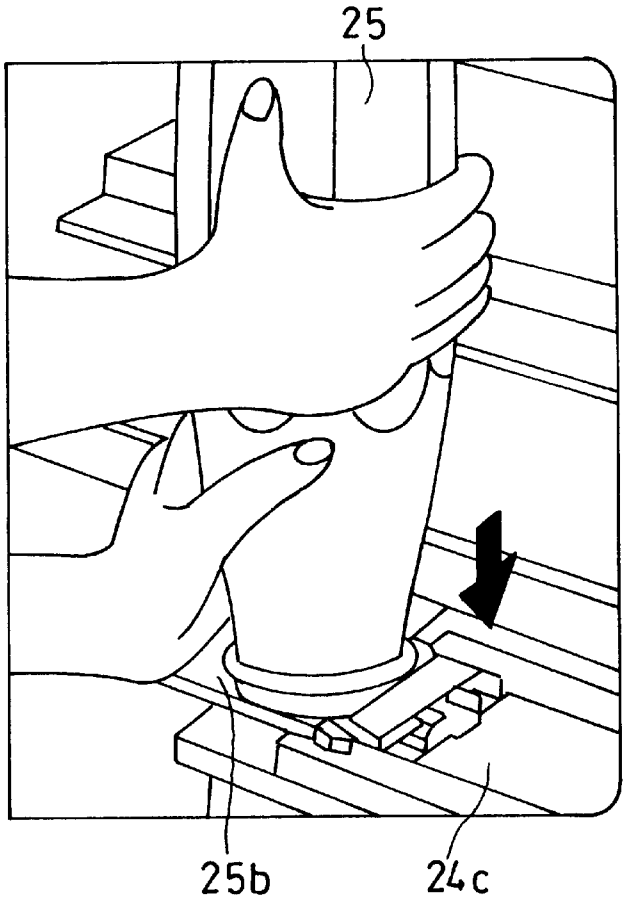
FIGS. 4(*a*) and 4(*b*) are views showing a procedure following the procedure shown in FIG. 3.
Figure 4A:
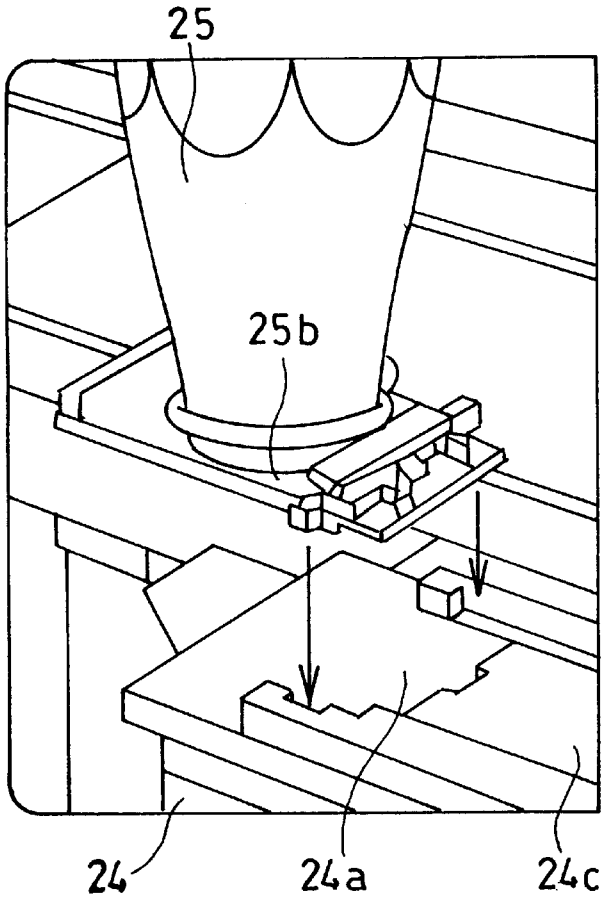

As shown in FIG. 4(*a*), a replenish opening 25*b* is formed in the toner cartridge 25 in such a manner to engage with slide mechanism formed at a top portion 24*a* of the toner box 24. The top portion 24*a* of the toner box 24 is initially covered with a shutter lid (opening/closing shutter) 24*c*, and when the replenish opening 25*b* is engaged with the slide mechanism as shown in FIG. 4(*b*), the lid 24*c* moves in a direction indicated by an arrow in FIG. 5, whereby the replenish opening 25*b* moves to a position almost directly above the top portion 24*a* of the toner box 24.

Figure 5:
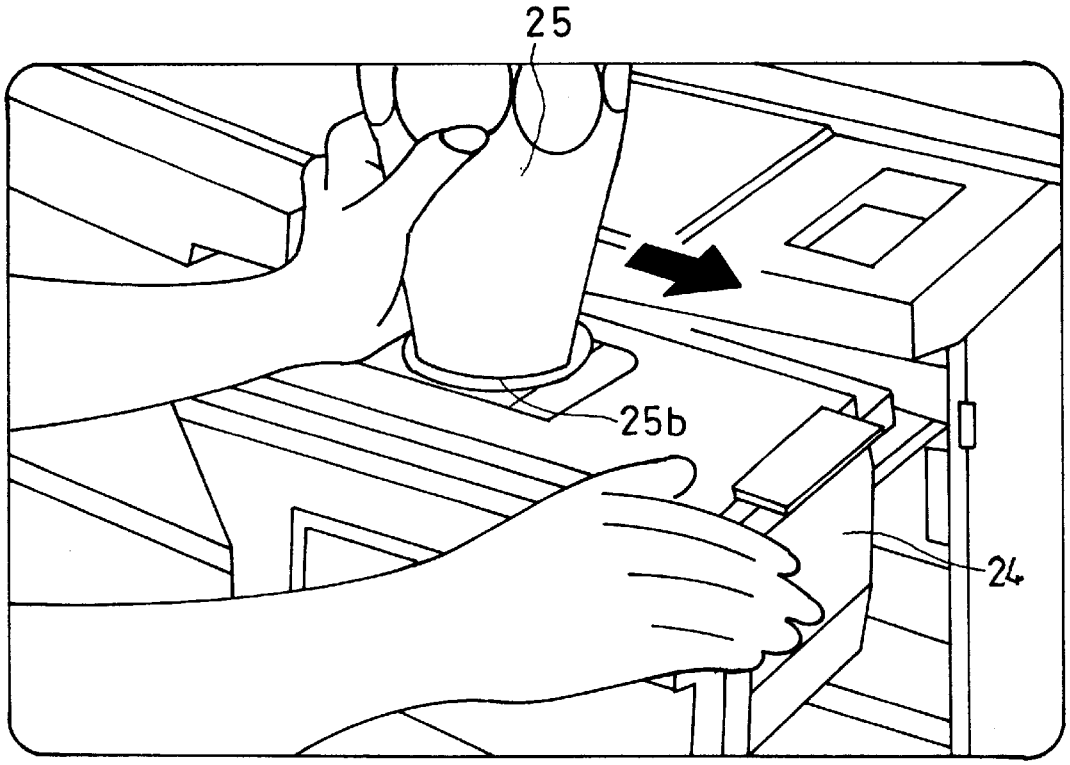
FIG. 5 is a view showing a procedure following the procedure shown in FIGS. 4(*a*) and 4(*b*)
Figure 6:
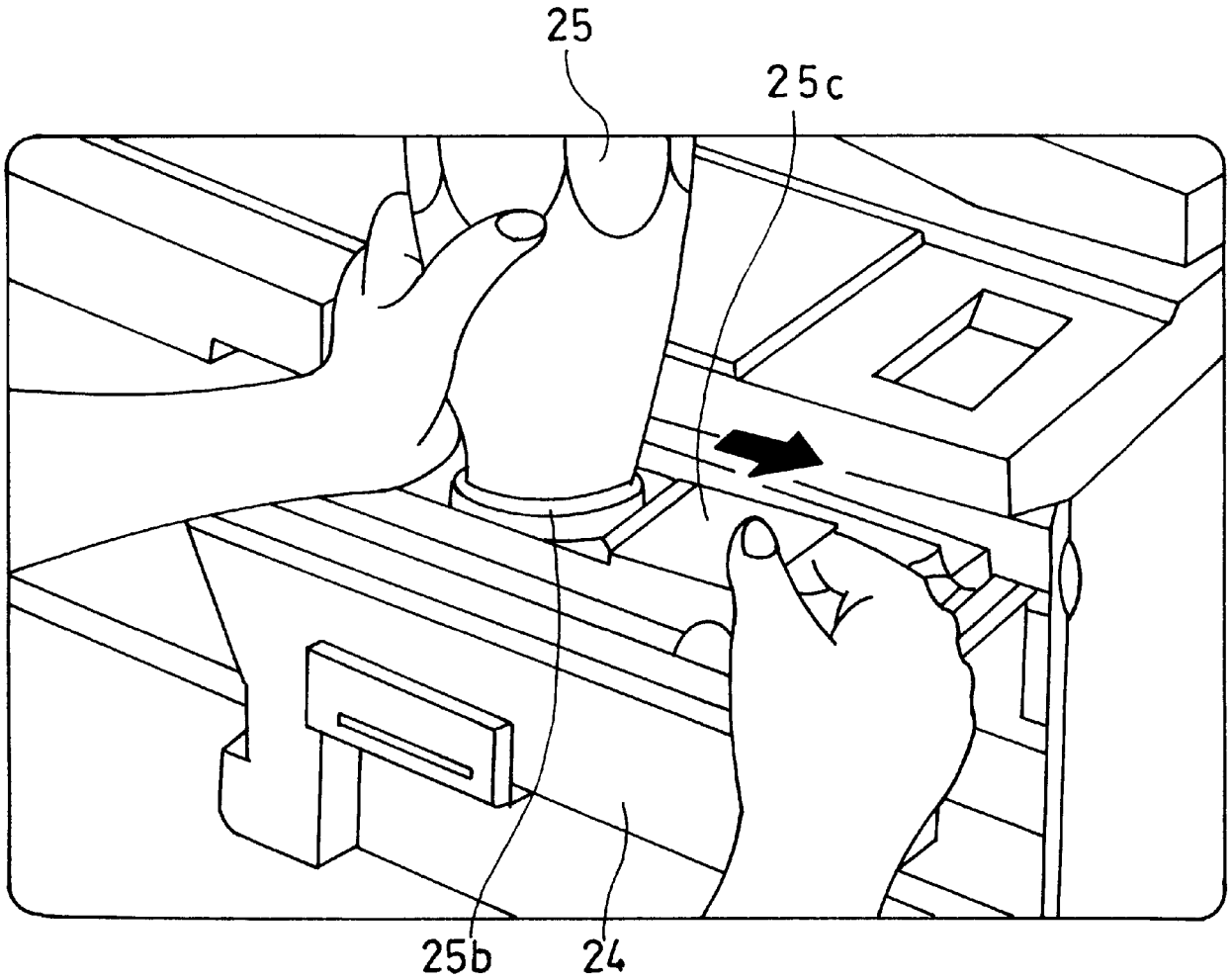
FIG. 6 is a view showing a procedure following the procedure shown in FIG. 5.

When the toner cartridge 25 moves to a position almost directly above the toner box 24 as shown in FIG. 5, the user/manipulator pulls out a sealing member 25*c* provided at the replenish opening 25*b* while holding the toner cartridge 25 so as not to move as shown in FIG. 6, and pours the toner into the toner box 24.

Figure 7:
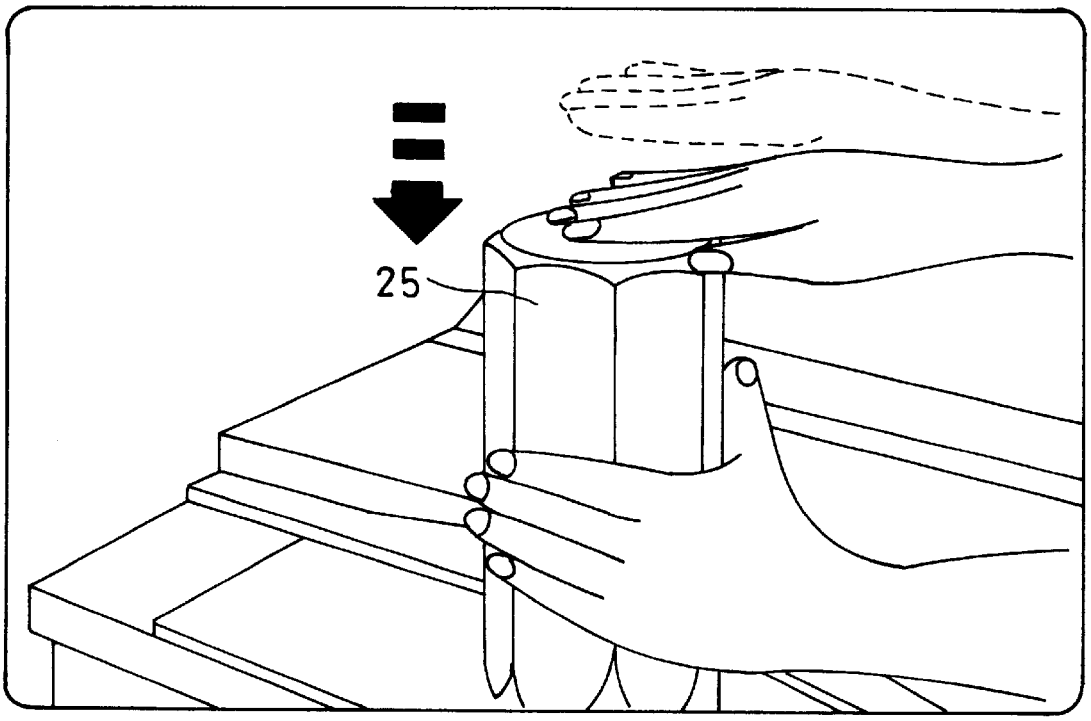
FIG. 7 is a view showing a procedure following the procedure shown in FIG. 6.

It takes some time until the entire toner is poured into the toner box 24, and in the present embodiment, it takes 30 seconds or so. Here, it is preferable to tap the toner cartridge 25 at the top for several times as shown in FIG. 7, so that the residual toner adhering to the interior of the toner cartridge 25 falls off.

Figure 8:
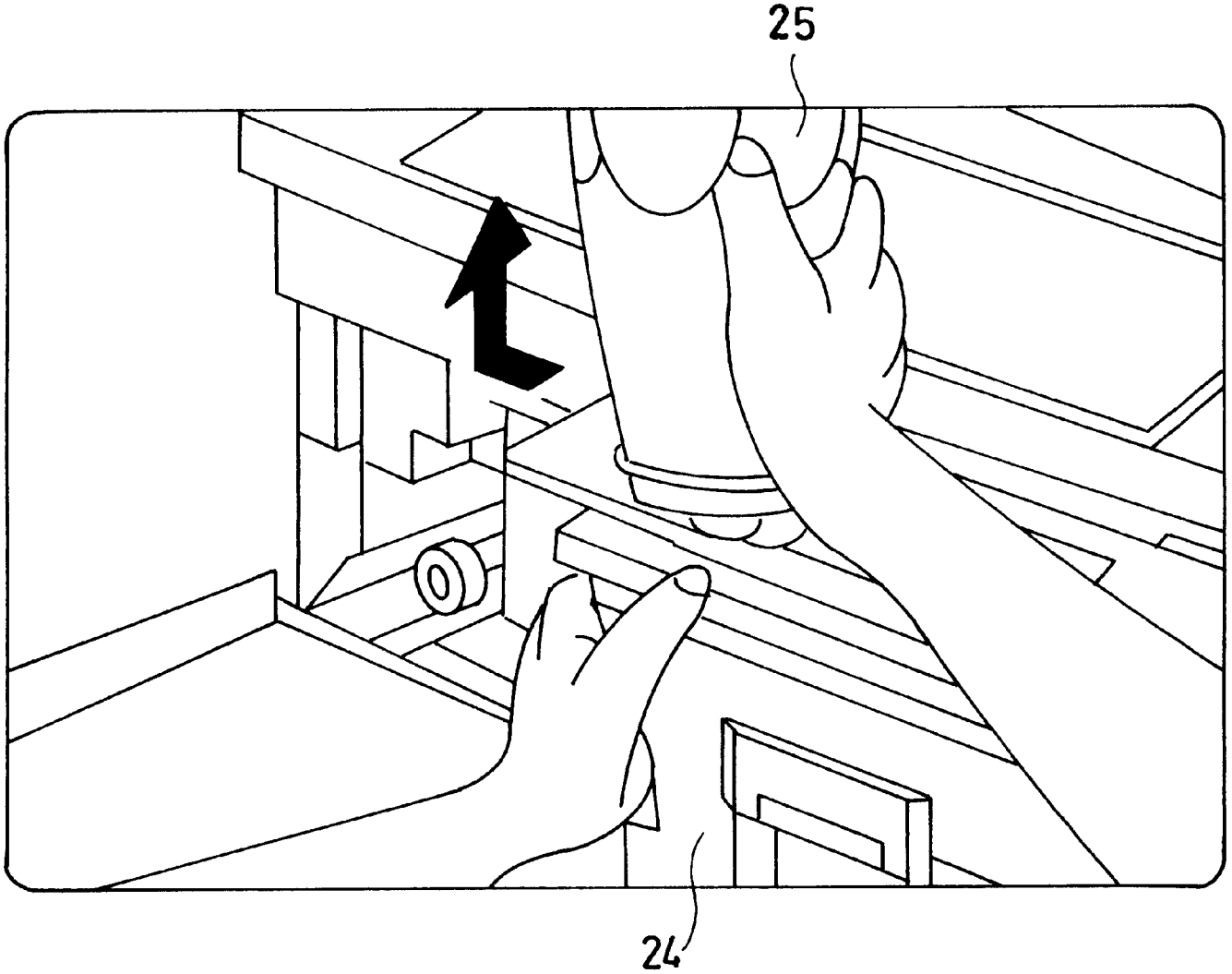
FIG. 8 is a view showing a procedure following the procedure shown in FIG. 7.
Figure 9B:
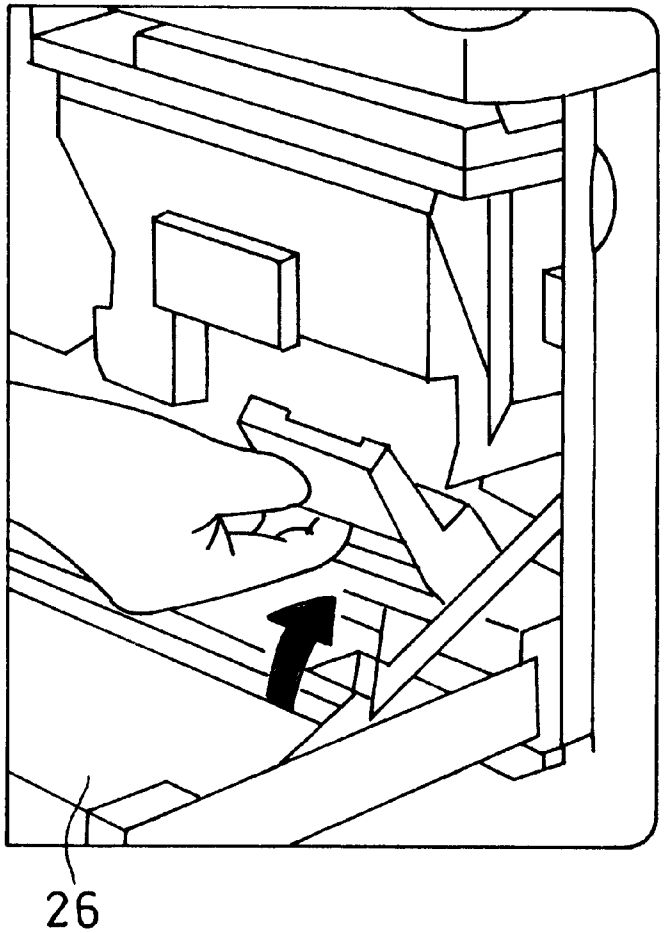
FIGS. 9(*a*) and 9(*b*) are views showing a procedure following the procedure shown in FIG. 8.
Figure 9A:
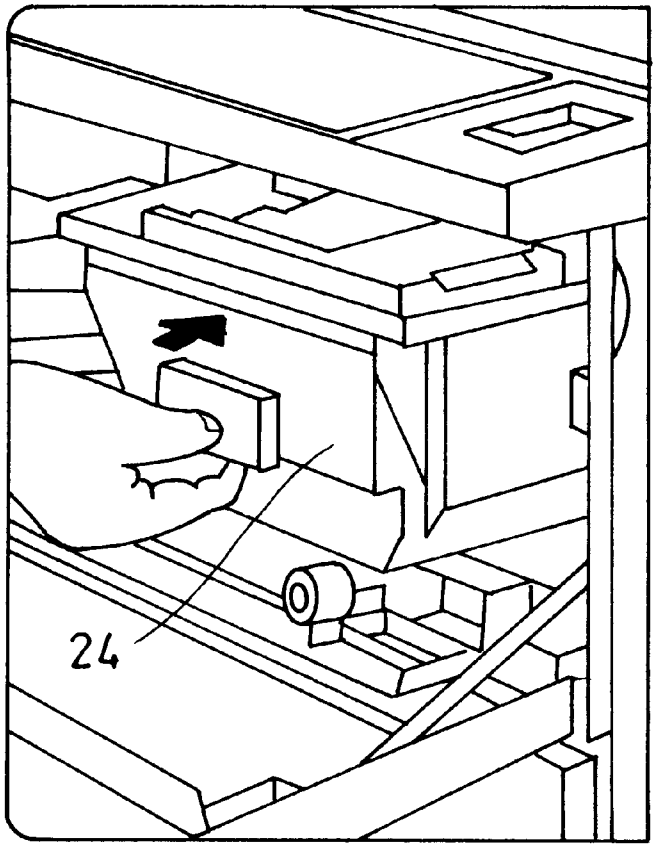

When the above toner filling job is completed, the empty toner cartridge 25 is moved in a direction indicated by an arrow in FIG. 8 to detach the toner cartridge 25 from the toner box 24. Later, as shown in FIG. 9(*a*), the toner box 24 is pushed backward to its original position gently, and as shown in FIG. 9(*b*), the toner box lever 27 is lifted up in a direction indicated by an arrow. Then, the toner filling job is completed, and the front surface cabinet 26 is closed.

Figure 10:
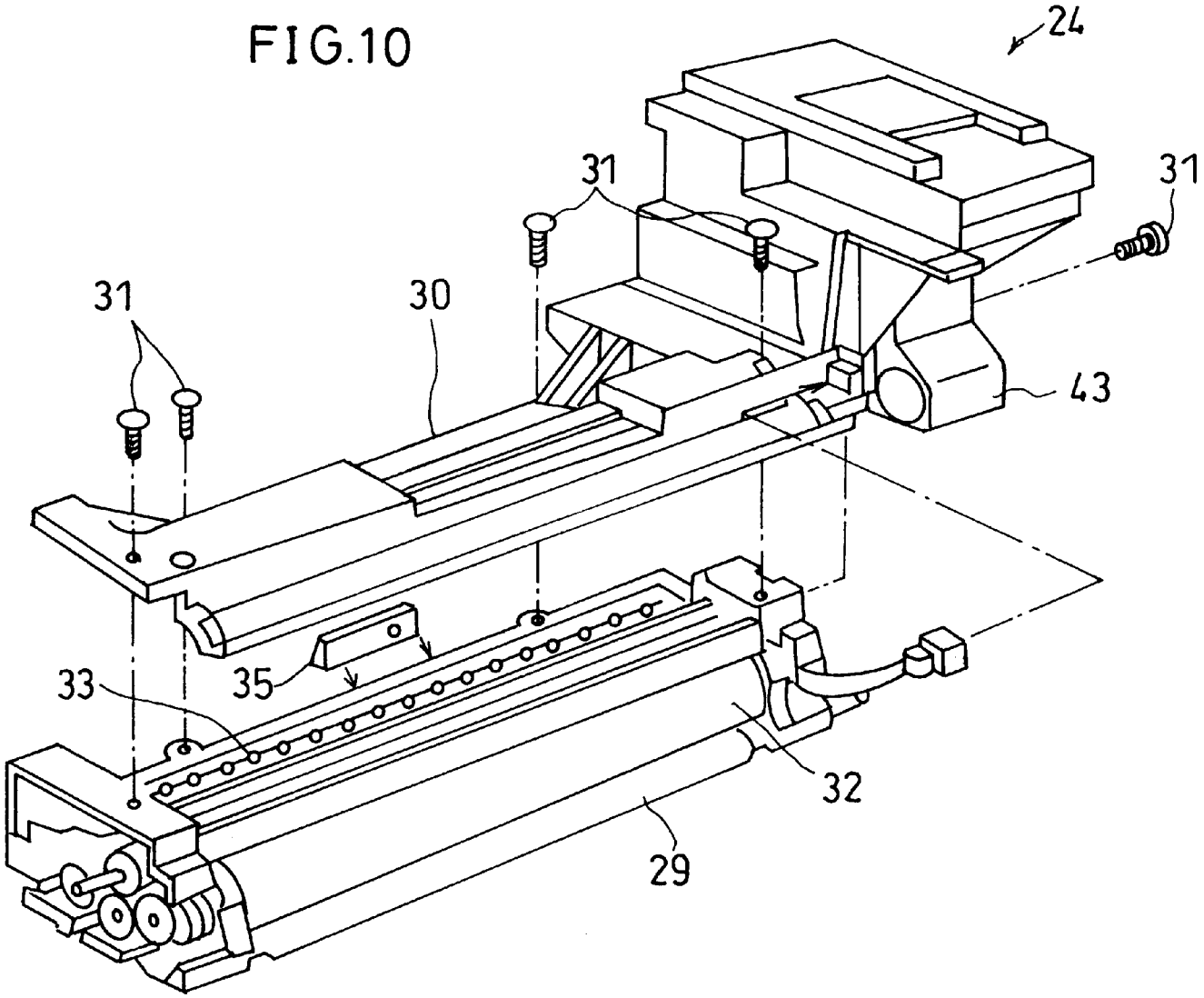
FIG. 10 is an exploded perspective view depicting an arrangement of a developing unit provided to the image forming apparatus of FIG. 1.

As shown in FIG. 10, the developing unit (developing device) 29 provided in the image forming apparatus (digital copying machine) of the present invention includes a developing sleeve 32, a toner transportation screw 33, the toner density sensor 35, etc. Also, a toner hopper 30 is attached to the upper portion of the developing unit 29. The toner box 24 serving as the toner withholding means is provided at one end of the toner hopper 30. Further, although it is not illustrated in the drawing, a toner transportation section serving as toner transportation means is provided below the toner box 24.

The toner hopper 30 and developing unit 29 are assembled with a plurality of fixing vises 31 in such a manner that parts of their respective casings are fitted to each other. For this reason, as shown in FIG. 10, the developing unit 29 and toner hopper 30 are formed into one body.

The developing sleeve 32 rotates to bring the brush of the toner into contact with the surface of the photosensitive drum 14, so that an electrostatic latent image is developed. This developing method is generally referred to as a magnetic brush developing method. The toner density sensor 35 is placed at the center in the longitudinal direction of the developing unit 29 to detect a density of the toner inside the developing unit 29. The toner transportation screw 33 transports the toner all over the developing bath 10 formed along the interior of the developing unit 29 (in the longitudinal direction of the developing unit 29).

As previously mentioned, the toner box 24 withholds the toner replenished from the toner cartridge 25, and the toner is further replenished to the developing unit 29 from the toner box 24. Here, the toner is transported to the developing unit 29 by the toner transportation section provided below the toner box 24.

Figure 11:
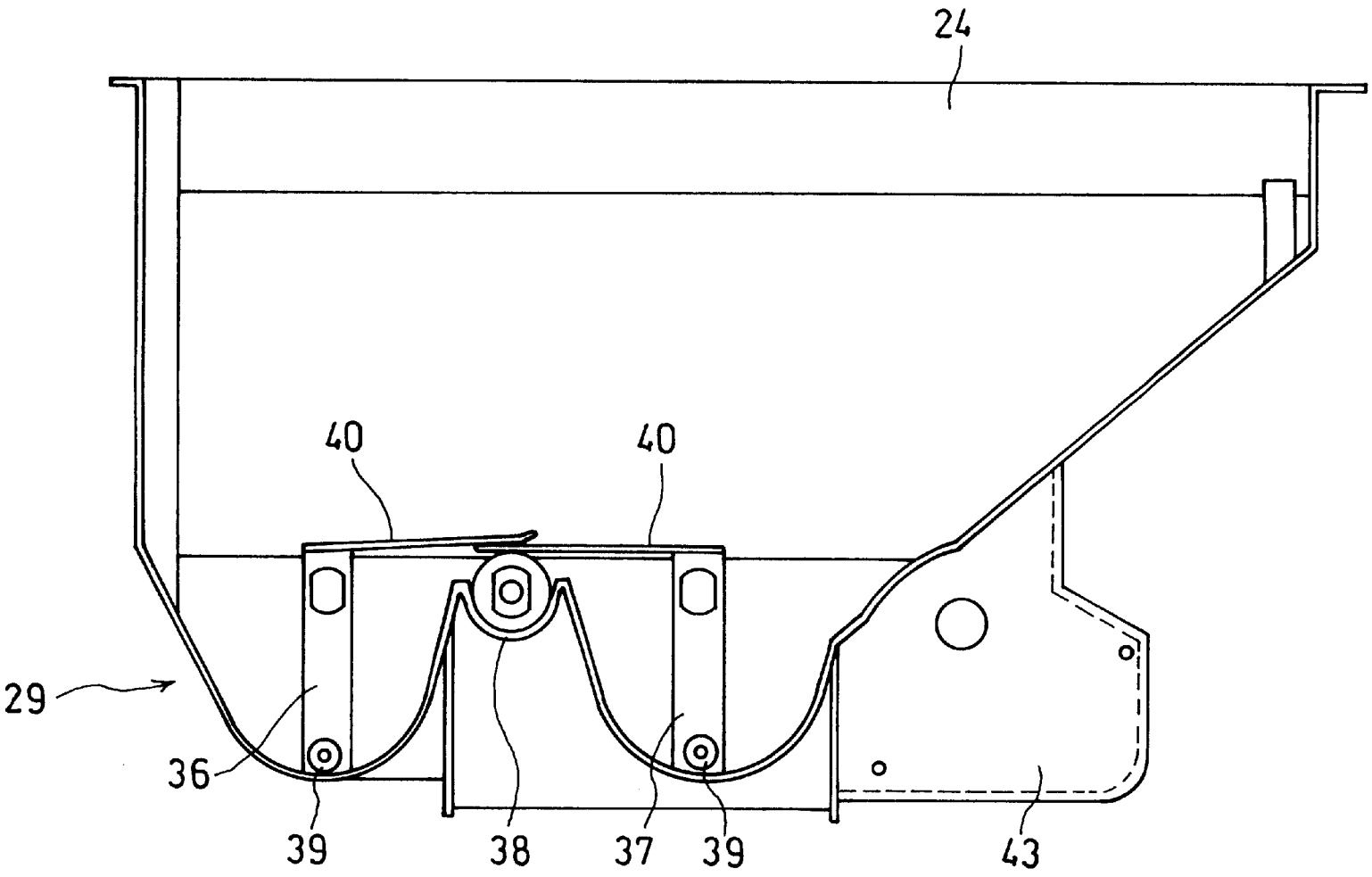
FIG. 11 is a cross section depicting an arrangement of a toner box provided to the image forming apparatus of FIG. 1.

The arrangement of the toner box 24 provided in the image forming apparatus (digital copying machine) of the present invention in the cross section along the longitudinal direction will be explained. As shown in FIG. 11, two toner stirring sections (toner stirring means) 36 and 37 are provided below the toner box 24, and a transportation screw 38 is provided somewhere between the toner stirring sections 36 and 37.

The transportation screw 38 forms a part of the toner transportation section (toner transportation means) that transports the toner to the developing unit 29.

As shown in FIG. 11, each of the toner stirring sections 36 and 37 includes a spring (spring member) 39 for stirring the toner inside the toner box 24, and a lifting section (lifting member) 40 for supplying the toner to the transportation screw 38. The toner stirring sections 36 and 37 are arranged to stir the toner inside the toner box 24.

Next, how a driving force is transferred to the toner stirring sections 36 and 37 through the transportation screw 38 provided therebetween in the toner box 24 will be explained. First, how a toner replenishing signal is outputted from the toner density sensor 35 will be explained.

The toner density sensor 35 detects the toner density based on a change in magnetic permeability of the toner inside the developing bath 10, and the toner density thus detected is compared with a predetermined reference value. When the toner density drops below the reference value and becomes low, a toner replenishing signal of a magnitude corresponding to the shortage is outputted to an unillustrated toner replenishing circuit.

Figure 12:
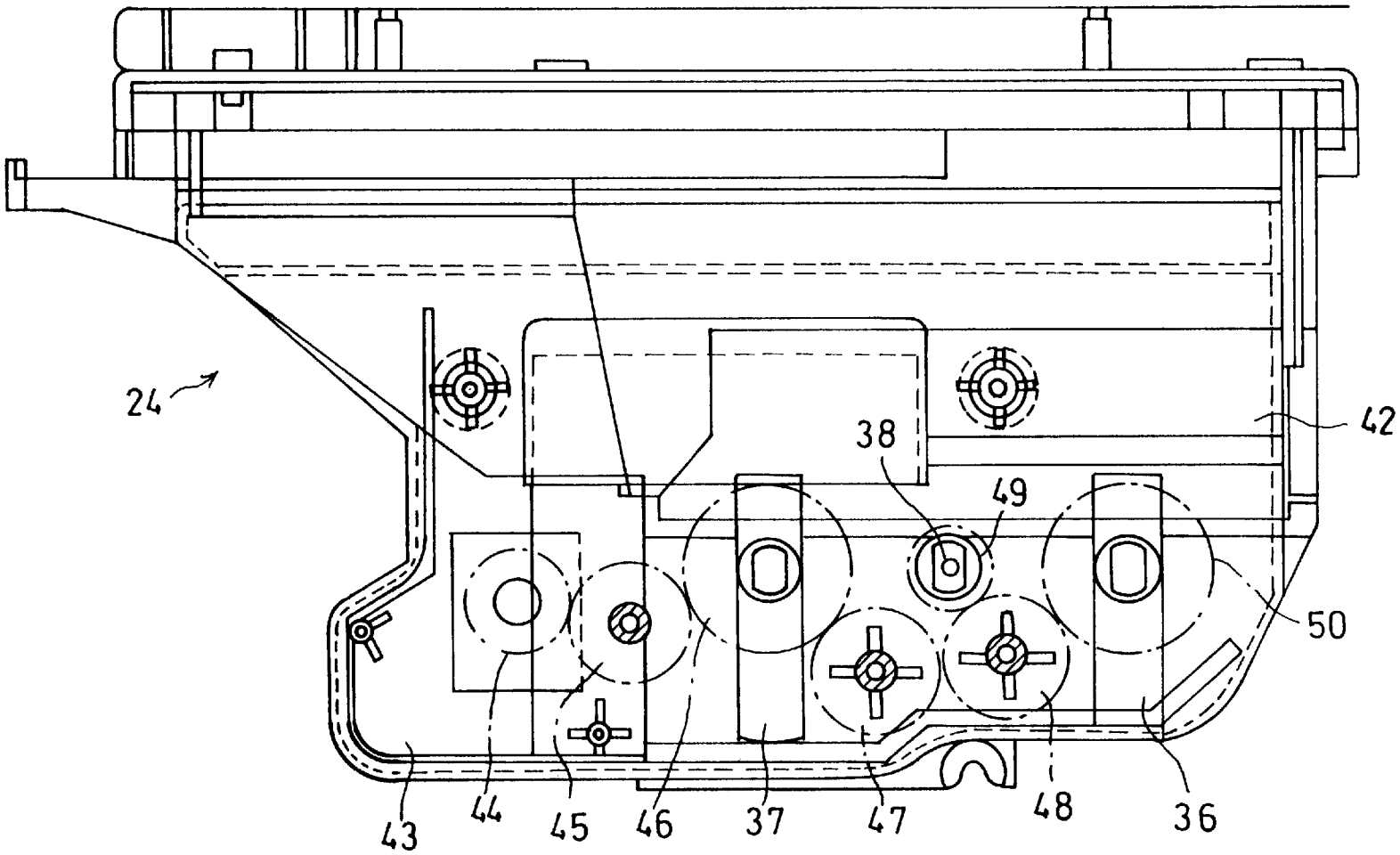
FIG. 12 is a side view of the toner box of FIG. 11.

Next, how the toner stirring sections 36 and 37 and transportation screw 38 rotate will be explained. As shown in FIG. 12, the toner box 24 includes, at the bottom, gears 44, 45, 46, 47, 48, 49, and 50, which are linked to each other in a rotatable manner, and a driving motor 43 for driving each of the gears 44 through 50.

The gears 46 through 50 are provided to drive the toner stirring sections 37 and 36. The gear 49 is responsible for the rotation of the transportation screw 38. The gears 45, 47, and 48 are idle gears to make the other gears (gears 46, 49, and 50) rotate in association.

Figure 13:
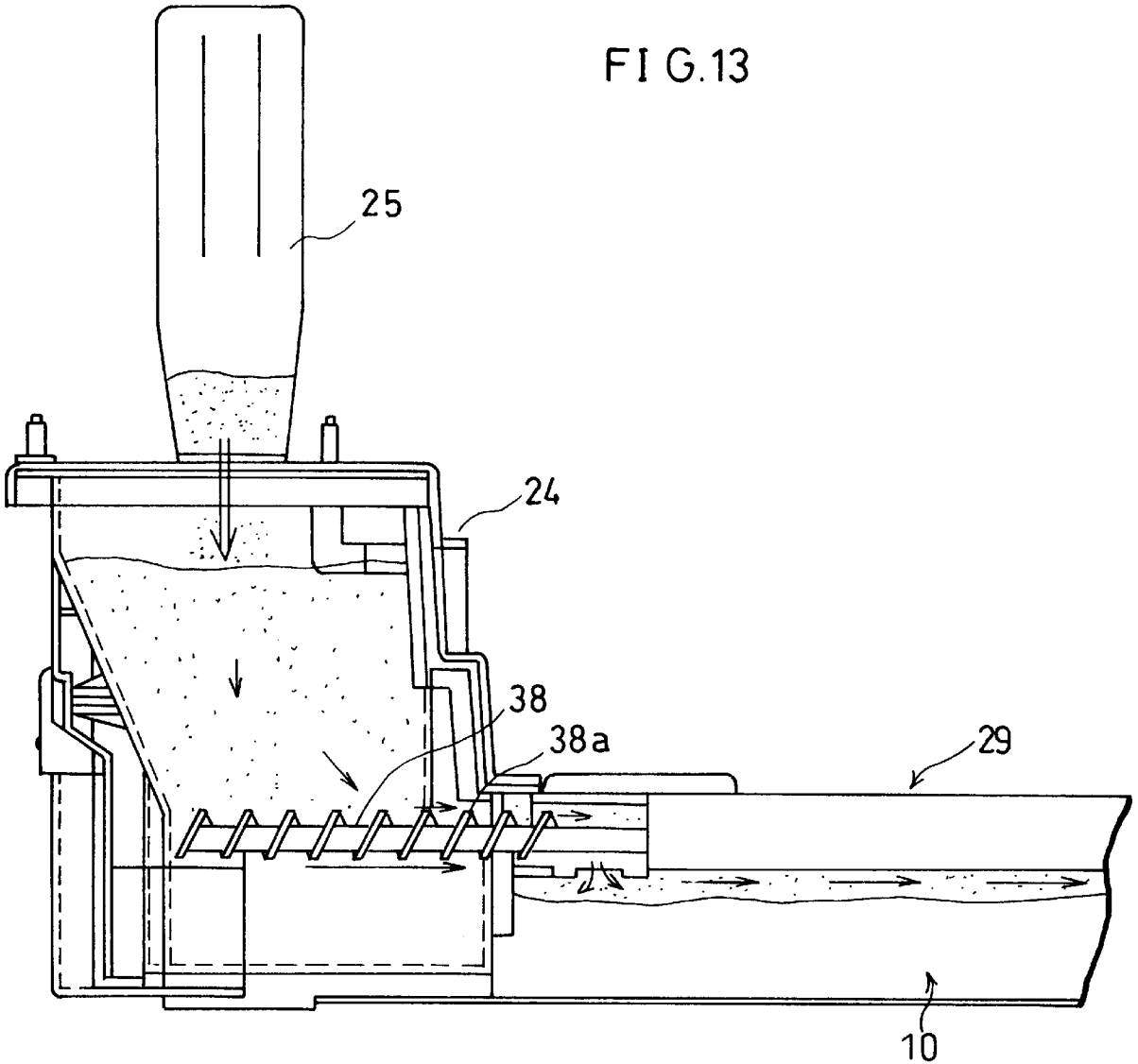
FIG. 13 is a cross section depicting an arrangement of a developing unit and a toner box provided to the image forming apparatus of FIG. 1 without a pipe section.

After the toner replenishing signal is outputted, the toner box 24 withholds the replenished toner from the toner cartridge 25 inside as shown in FIG. 13. Then, the driving motor 43 is activated to rotate each of the gears 44 through 50. As each gear rotates, the transportation screw 38 and the toner stirring sections 36 and 37 (not shown in FIG. 13) are driven. Consequently, the toner is transported toward the developing unit 29, whereby the toner is supplied all over the developing bath 10 (in a direction indicated by arrows in the drawing).

Figure 14:
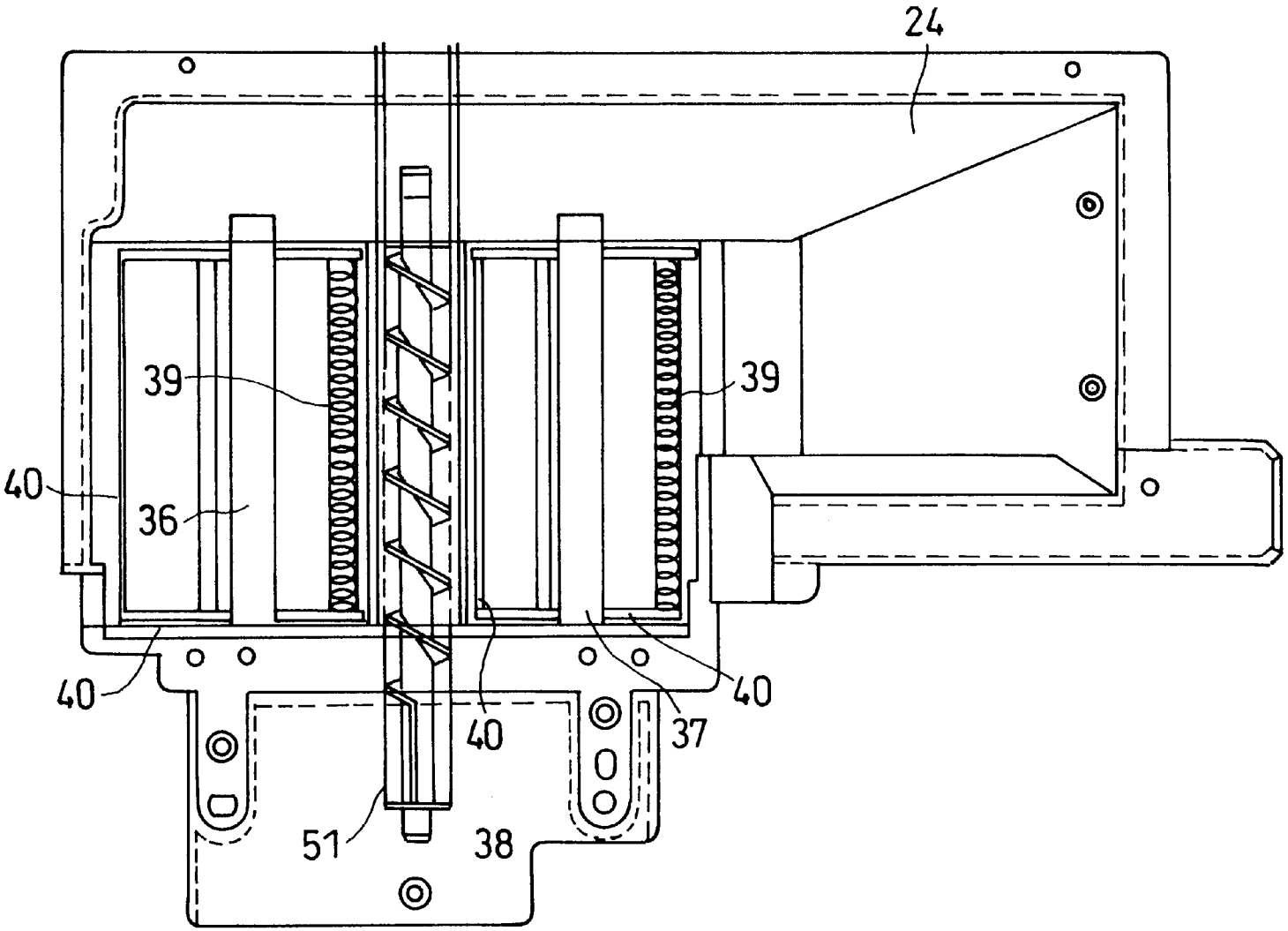
FIG. 14 is a top view of the toner box of FIG. 11.

As shown in FIG. 14, the toner stirring sections 36 and 37 and transportation screw 38 are, if the toner box 24 is seen from the above, provided in a direction that intersects at right angles with the longitudinal direction of the toner box 24. The toner stirring sections 36 and 37 are supported by an unillustrated supporting shaft and driven to rotate as the gears 50 and 46 rotate. Also, to stir the toner inside the toner hopper 31 better, the spring 39 and lifting section 40 are provided for each of the toner stirring sections 36 and 37. Further, the transportation screw 38, provided to be sandwiched by the toner stirring sections 36 and 37, also rotates in association with the gear 49.

The image forming apparatus (digital copying machine) of the present invention is characterized in that the toner transportation path is controlled when the toner is replenished to the developing unit (developing device) 29 provided in the digital copying machine in the above-described copying process. In other words, it is characterized by the arrangement that toner replenishing means (toner box 24) for replenishing the toner to the developing unit 29 includes, in addition to the transportation screw 38, a pipe-wise member for covering the transportation screw 38 along a shaft (supporting shaft) direction thereof.

Although it will be described below, the pipe-wise member is provided to cover the transportation screw 38 v which transports the toner to the developing unit 29 provided inside the toner replenishing means (toner box 24). Thus, it has become possible to prevent the liquid toner transported by the transportation screw 38 from flowing into the developing unit 29.

The digital copying machine of the present invention including the pipe-wise member can be modified in various manners, and the modifications will be detailed below by way of examples.

EXAMPLE 1

In the present example, a pipe section (pipe-wise member or control pipe member) 51 is provided in such a manner to cover the transportation screw 38 provided at the bottom of the toner box 24. According to this arrangement, it has become possible to control the toner transportation path, and hence to prevent the liquid toner from flowing into the developing unit 29.

In case that the pipe section 51 is not provided, as shown in FIG. 13, the liquid toner, replenished by falling down from the toner cartridge 25 naturally at the upper portion of the toner box 24, moves in a direction indicated by arrows in the drawing.

Without the pipe section 51 for covering the transportation screw 38, as shown in FIG. 13, a large quantity of toner will be flown into the developing unit 29 through a space 38*a* of the toner transportation opening (a route of the transportation screw 38), and the toner keeps flowing in until the space of the developing unit 29 is filled out.

In the drawing, a portion indicated by black dots represents the liquid toner, and a portion indicated by diagonal shades represents the toner transported and withheld in the developing unit 29 in a normal manner. Here, "the toner transportation opening" means an opening or a space which is provided near the transportation screw 38 and communicates through the developing unit 29.

Figure 15:
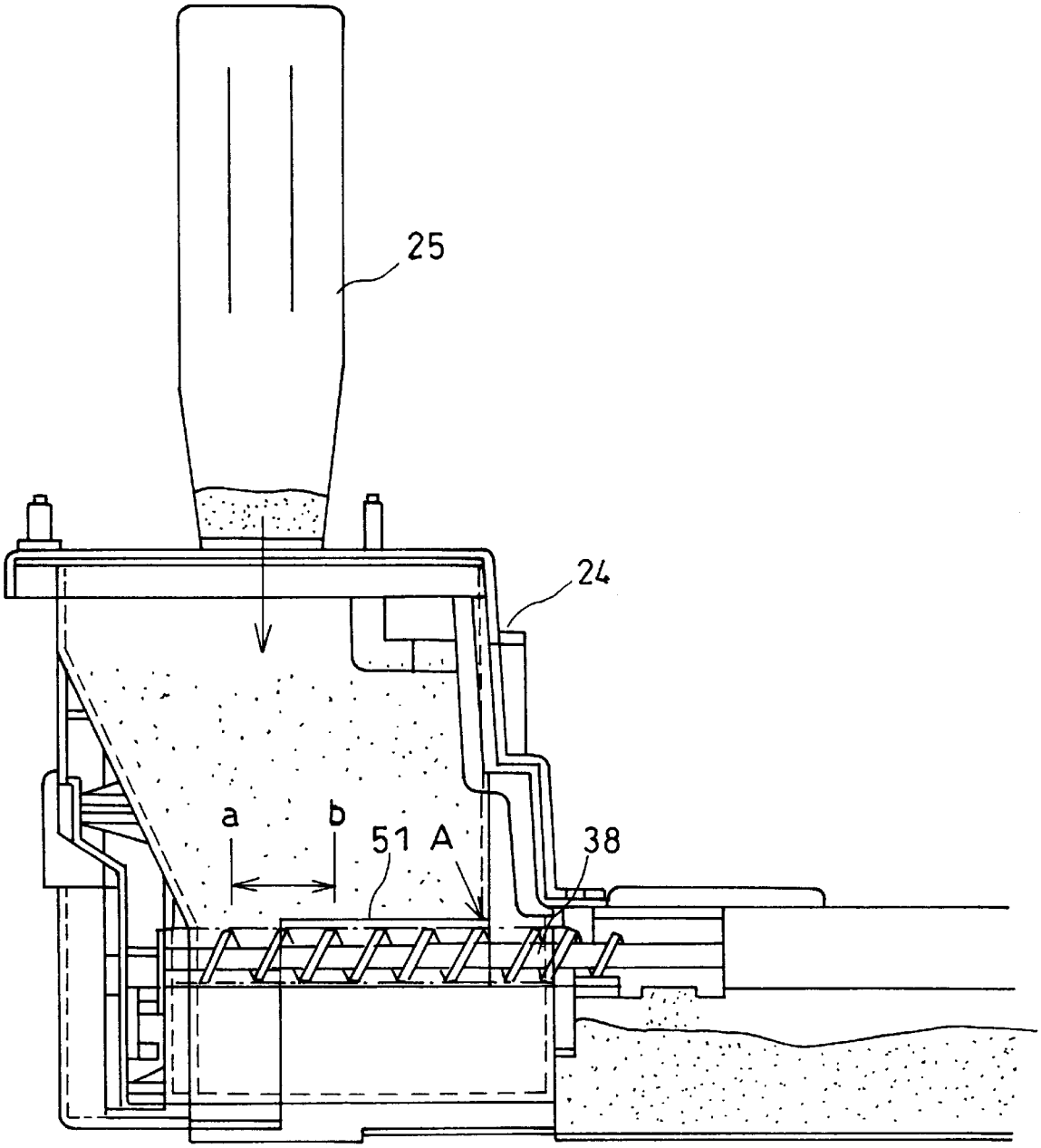
FIG. 15 is an enlarged cross section depicting an arrangement of a pipe section formed in the developing unit and toner box provided to the image forming apparatus of FIG. 1.

Thus, in the present example, the pipe section 51 is provided to cover the transportation screw 38 as shown in FIG. 15. Here, a length of the pipe section 51 is about half the length of the exposed portion of the transportation screw 38 from the end A at the developing unit 29 (indicated by a small letter b in the drawing) or longer, and shorter than a length such that covers most of the exposed transportation screw 38 (indicated by a small letter a in the drawing).

When the length of the pipe section 51 is within the above range, the flowing of the toner to the developing unit 29 can be controlled, and there arises substantially no problem as to the toner follow-up property with respect to the developing unit 29. Thus, inconveniences that may affect the operation of the image forming apparatus (digital copying machine) can be avoided.

As has been explained, the dimension of the pipe section 51 in the longitudinal direction is preferably set to a dimension such that does not cover the exposed portion of the transportation screw 38 completely in the longitudinal direction, more specifically, a dimension such that covers the exposed portion of the transportation screw 38 from the end A at the developing unit 29 to the opposite end in the longitudinal direction not completely, but almost completely. If the dimension is within the above range, the flowing of the liquid toner to the developing unit 29 can be suppressed effectively.

Although the concrete result is not provided herein, it is already confirmed from the experiments that there will be no problem if the pipe section 51 is long enough to cover the half or more than the half of the exposed portion of the transportation screw 38.

As has been explained, the pipe section 51 is arranged to cover the transportation screw 38, in other words, to cover most of the toner transportation opening provided near the transportation screw 38. Consequently, it has become possible to suppress the flowing of the toner to the developing unit 29.

EXAMPLE 2

In the present example, dimensions of a space between an inside diameter of the pipe section 51 that covers the transportation screw 38 and an exterior portion of the transportation screw 38 will be discussed.

Figure 16:
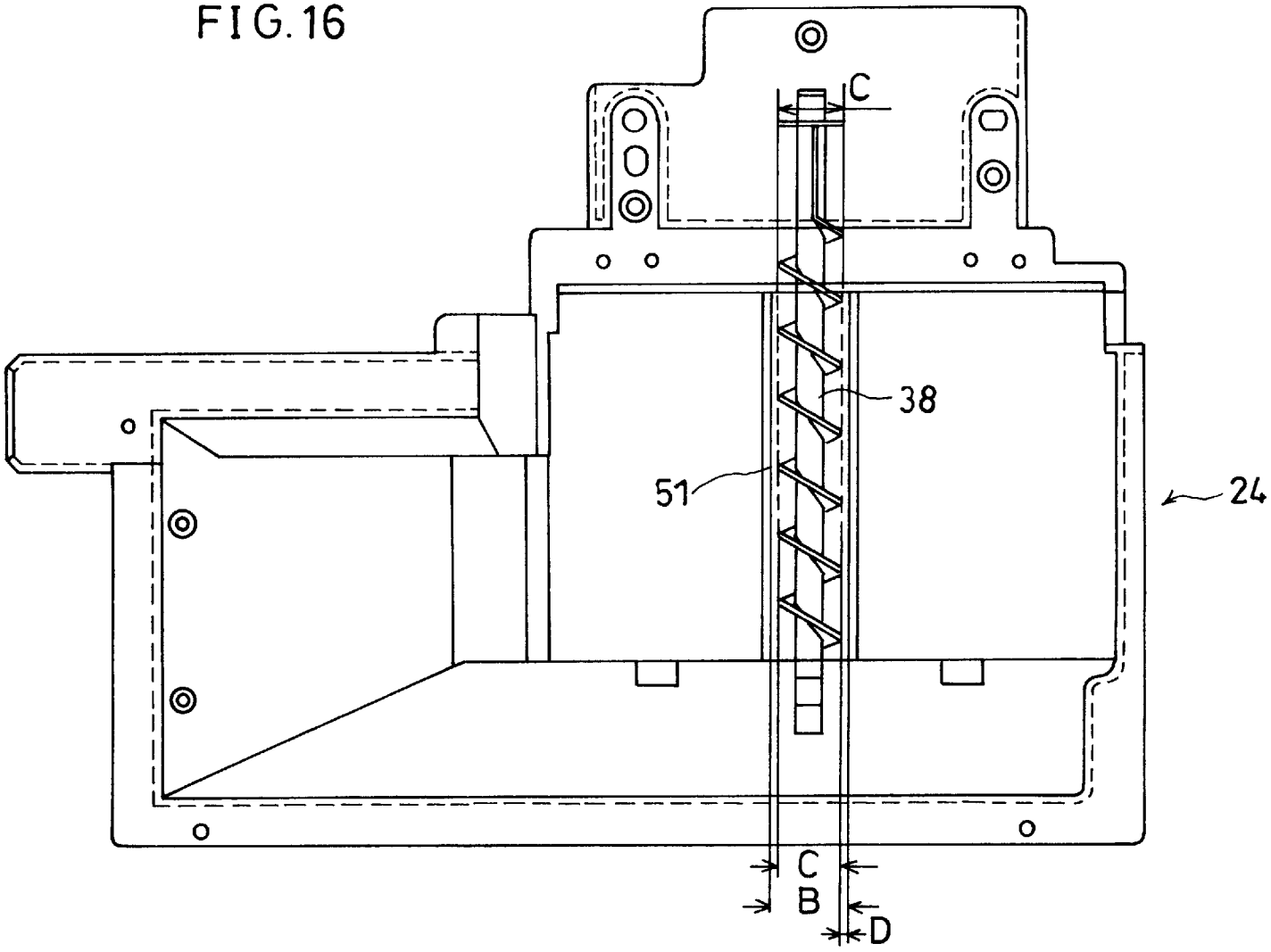
FIG. 16 is a view explaining a relation of dimensional tolerance of a transportation screw and the pipe section in an image forming apparatus in accordance with an example of the present invention.

More specifically, as shown in FIG. 16, let B be a dimension of the inside diameter of the pipe section 51 that covers the transportation screw 38, and C be a dimension of the exterior portion of the transportation screw 38, then the comparison between the inside diameter B and exterior portion C always results: inside diameter B and exterior portion C. Under these conditions, how a difference between the inside diameter B and exterior portion C, that is, a space between the pipe section 51 and transportation screw 38, affects a quantity of the liquid toner flowing into the developing bath 10 (developing unit 29) is checked, and an optimal dimension for the space is obtained from the experiments.

Since the pipe section 51 is provided to cover the transportation screw 38 as shown in FIG. 16, let D be a dimension of the space between the pipe section 51 and transportation screw 38, then space D=(inside diameter B−exterior portion C)/2.

In the present example, for instance, the inside diameter B=15 mm+0.4 mm and the exterior portion C=15 mm−0.2 mm. Under these conditions, the experiments are conducted by taking the deflection of the transportation screw 38 during the rotary operation and tolerance scattering of the components into account.

Table 1 below shows the relation between the space D between the inside diameter B of the pipe section 51 and the exterior portion C of the transportation screw 38, and a quantity of the liquid toner flown to the developing bath 10 (developing unit 29).

TABLE 1

| SPACE D BETWEEN INSIDE DIAMETER B AND EXTERIOR PORTION C (mm) | QUANTITY OF TONER FLOWN TO DEVELOPING UNIT (g) |
|---|---|
| 0–0.3 | 0.04 |
| 0.3–0.5 | 2.20 |
| 0.5–1.1 | 10.5 |
| 1.1–1.5 | 19.7 |
| 0.5–2.0 | 30.5 |
| NO PIPE-WISE MEMBER | 45.5 |

Table 1 above reveals that the setting condition of the exterior portion C of the transportation screw 38 and the inside diameter B of the pipe section 51, that is, the size of the space D, affects significantly a quantity of the toner flown to the developing bath 10 (developing unit 29).

The flowing of the toner does not have to be prevented completely, and is allowed to some extent. Here, a quantity of toner allowed to flow to the developing bath 10 (developing unit 29) varies with a capacity of the developing unit 29 and the like, and it is impossible to control a quantity of the flowing toner very strictly. However, it should be appreciated that it is preferable to suppress the flowing toner to the least quantity.

Table 1 above reveals that when the space D is larger than 0.5 mm, a quantity of the flowing toner surges (to be more specific, increases to 10.5 g from 2.20 g) Table 1 above does not specifically show, but when the space D becomes larger than 0.5 mm, there arises inconveniences, such as the dispersion of the toner inside the image forming apparatus (digital copying machine) and smear on a recording paper. Thus, it is preferable to set the space D up to 0.5 mm.

As has been explained, by controlling the dimension of the space D between the inside diameter B of the pipe section 51 that covers the transportation screw 38 and the external portion C of the transportation screw 38, the adverse effects caused by the flowing of the liquid toner can be suppressed significantly, and an image quality can be further improved.

EXAMPLE 3

In the present example, the space D between the inside diameter B of the pipe section 51 and the exterior portion C of the transportation screw 38 gradually becomes smaller toward the toner replenish opening of the developing bath 10 (the opening provided at the end of the developing bath 10 touching the toner box 24).

Figure 17:
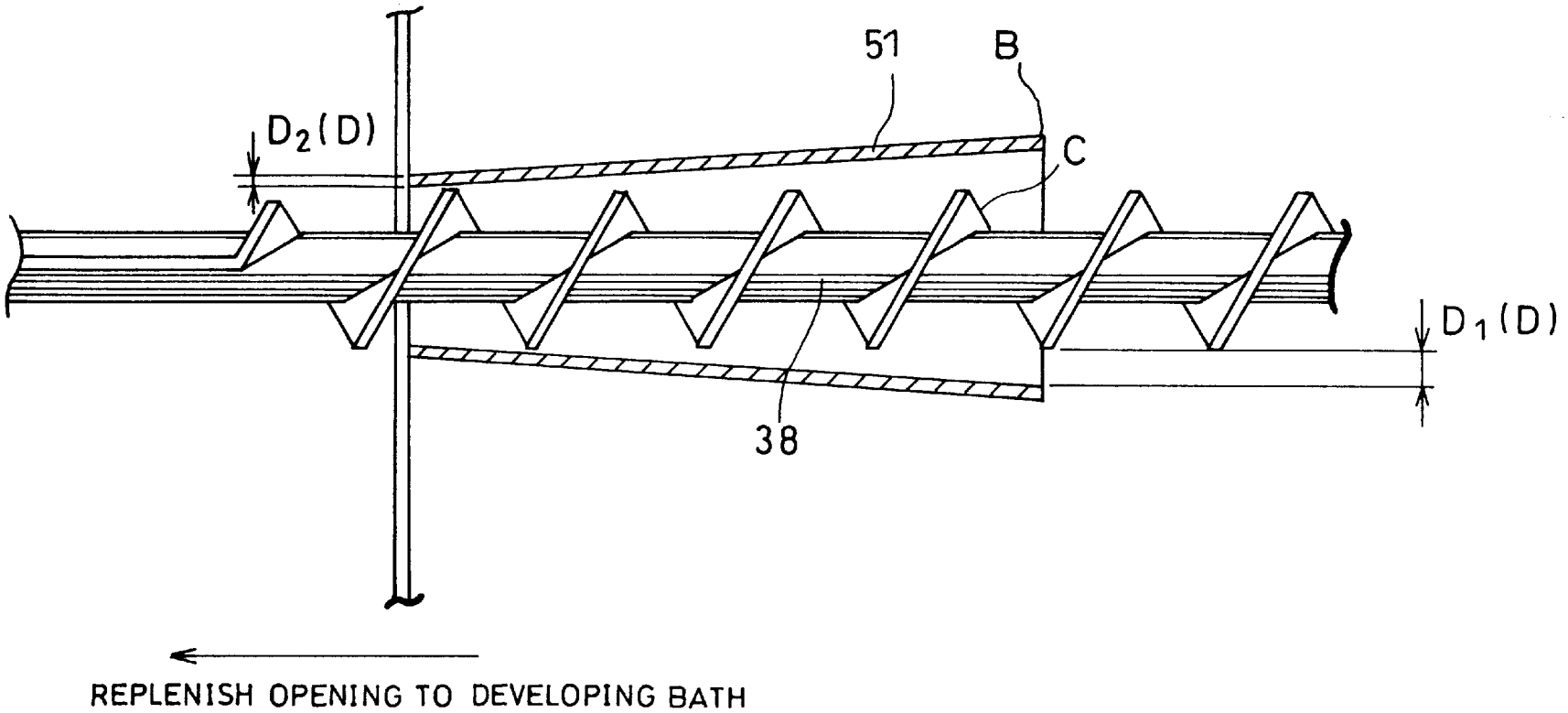
FIG. 17 is a view explaining a shape and a placement state of the transportation screw and pipe section in an image forming apparatus in accordance with another example of the present invention.

More specifically, as shown in FIG. 17, the pipe section 51 that covers the transportation 38 is arranged in such a manner that the space D becomes smaller toward the replenish opening of the developing bath 10 in a direction indicated by an arrow. In the present example, the space D at the wider end is denoted as $D_1$, and the space D at the narrower end (the end at the replenish opening) is denoted as $D_2$, and $D_1$=1.2 mm and $D_2$=0.15 mm. As previously mentioned, the space D becomes smaller gradually from the wider end to the replenish opening end.

A quantity of the flowing toner is confirmed using the pipe section 51 of the above dimension and the transportation screw 38. Then, a quantity of the flowing toner is substantially the same when the space D is set up to 0.5 mm in Example 2 above. Thus, according to the above arrangement, the flowing of the toner can be suppressed like the arrangement of Example 2 above.

Further, the arrangement of the present example can offer another advantage. That is, in case of the pipe whose space D becomes smaller toward the replenish opening, the toner follow-up property to the developing bath 10 can be stabilized as soon as the toner is replenished to the toner box 24.

In the following, examples of a toner flow suppressing section (toner flow suppressing means) for suppressing the flow of the toner from the space D will be explained.

EXAMPLE 4

In the present example, a toroidal sheet member made of an elastic material is provided partially to an interior of the pipe section 51 as the toner flow suppressing section.

Figure 18:
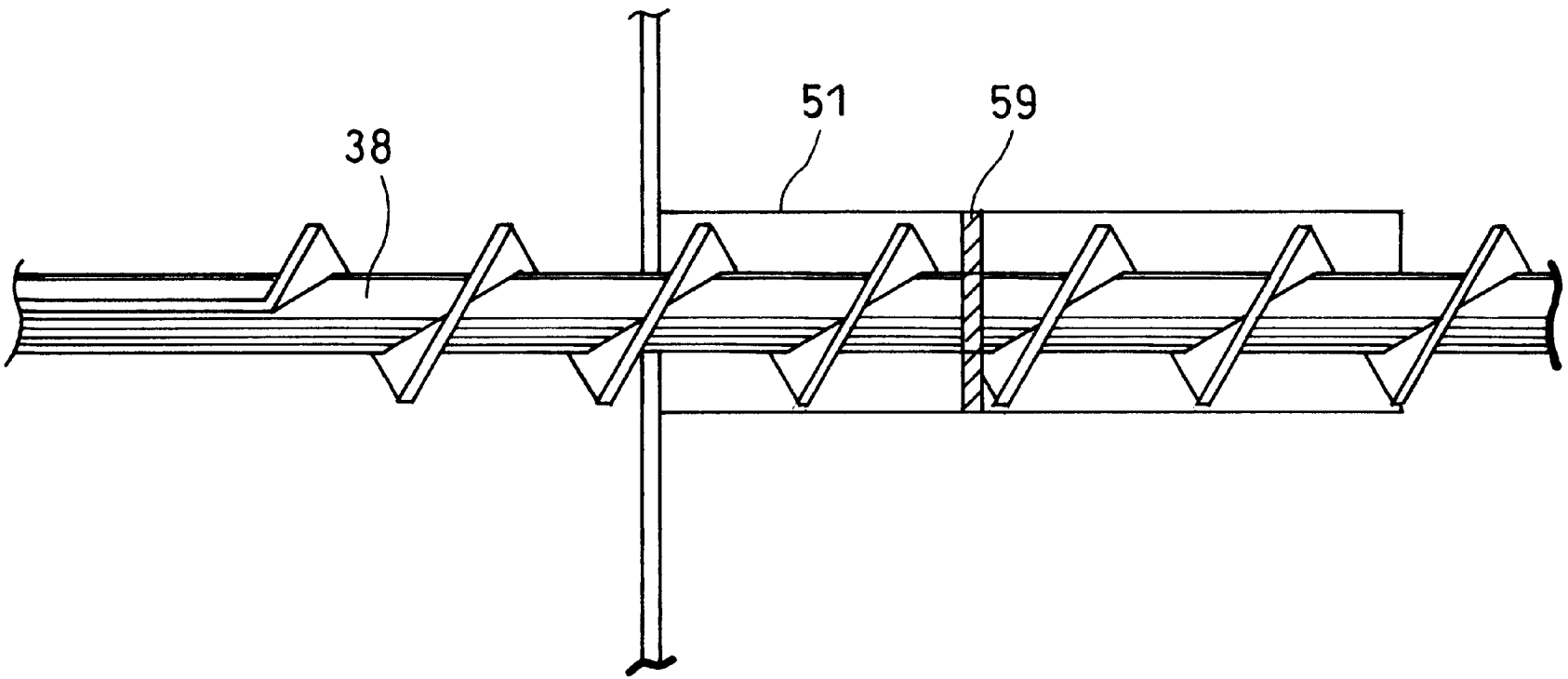
FIG. 18 is a view explaining a state that a toroidal elastic element is provided in addition to the transportation screw and pipe section in an image forming apparatus in accordance with still another example of the present invention.
Figure 19:
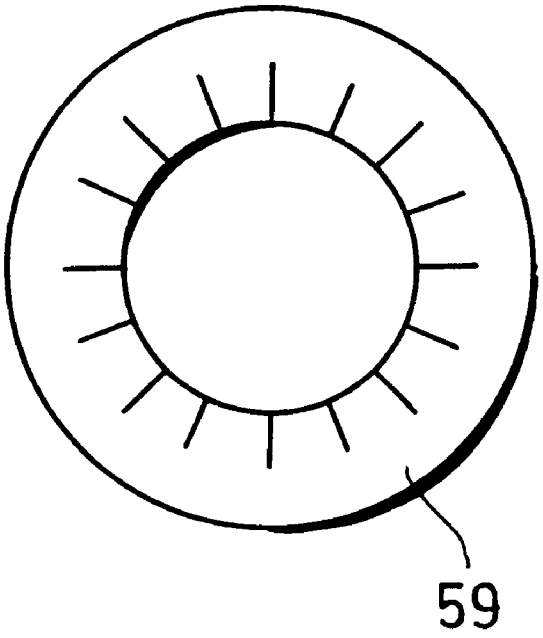
FIG. 19(*a*) is a front view depicting a shape of the toroidal elastic element provided to the pipe section of FIG. 18.
Figure 19:
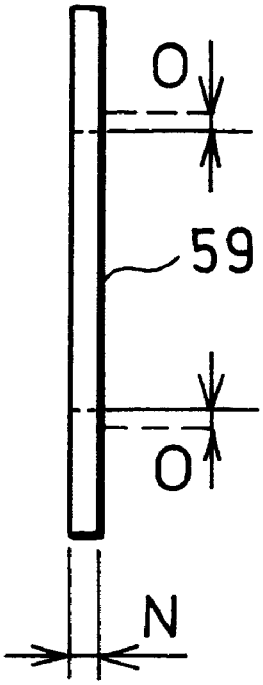

More specifically, as shown in FIG. 18, a toroidal sheet element (sheet member) 59 made of urethane or the like is provided inside the pipe section 51 near the center thereof, for example. As shown in FIG. 19(*a*), the sheet element 59 has radial cuts around an end touching the transportation screw 38, that is, around the hole end of a toroidal shape. By providing the above sheet element 59, an increase of the rotation torque of the transportation screw 38 can be suppressed.

It turns out from more concrete experiments that a thickness N of the sheet element 59 shown in FIG. 19(*b*) is preferably in a range between 0.5 mm and 1 mm. Since the sheet element 59 has the radial cuts as shown in FIG. 19(*a*), even if the sheet element 59 jams with a blade section 54 of the transportation screw 38 and touches the same, an increase of the rotation torque of the transportation screw 38 can be suppressed.

It turns out from the experiments that a jamming quantity O of the sheet element 59 with the blade section 54 of the transportation screw 38 (see FIG. 19(*b*)) is preferably in a range between 1 mm and 2 mm.

Figure 20:
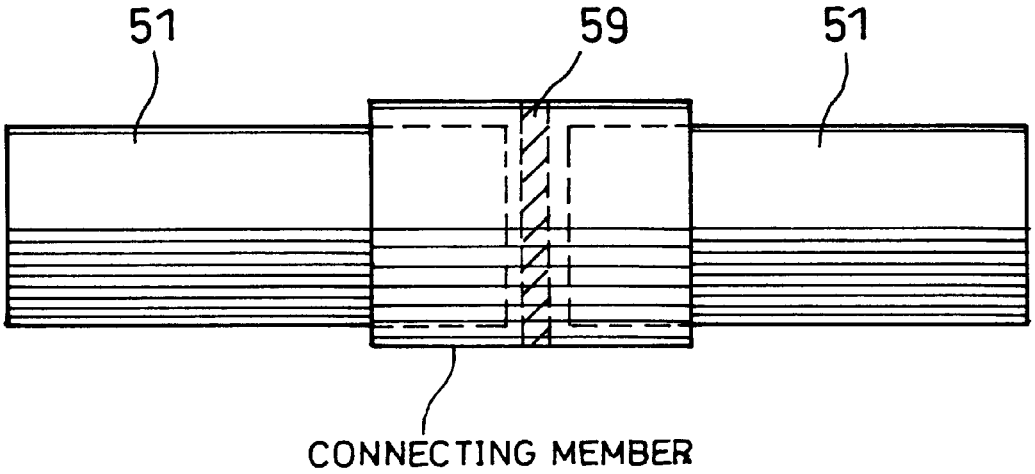
FIG. 20 is a view explaining a placement state of the toroidal elastic element of FIGS. 19(*a*) and 19(*b*) provided to the pipe section of FIG. 18.

The position of the sheet element 59 inside the pipe section 51 is not limited to near the center as shown in FIG. 18, and the sheet element 59 can be provided at any position as long as the transportation screw 38 can be set to desired rotation torque. Here, as shown in FIG. 20, if the pipe section 51 has a connected portion, it is preferable to place the sheet element 59 to the connected portion, so that the sheet element 59 is also covered with a connecting member. According to the above arrangement, the sheet element 59 can be readily attached.

EXAMPLE 5

In the present example, a part of the central portion of the pipe section 51 is made of a cylindrical expandable/contractible elastic material, while both the end portions are made of a material whose shape does not change, such as resin.

Figure 21:
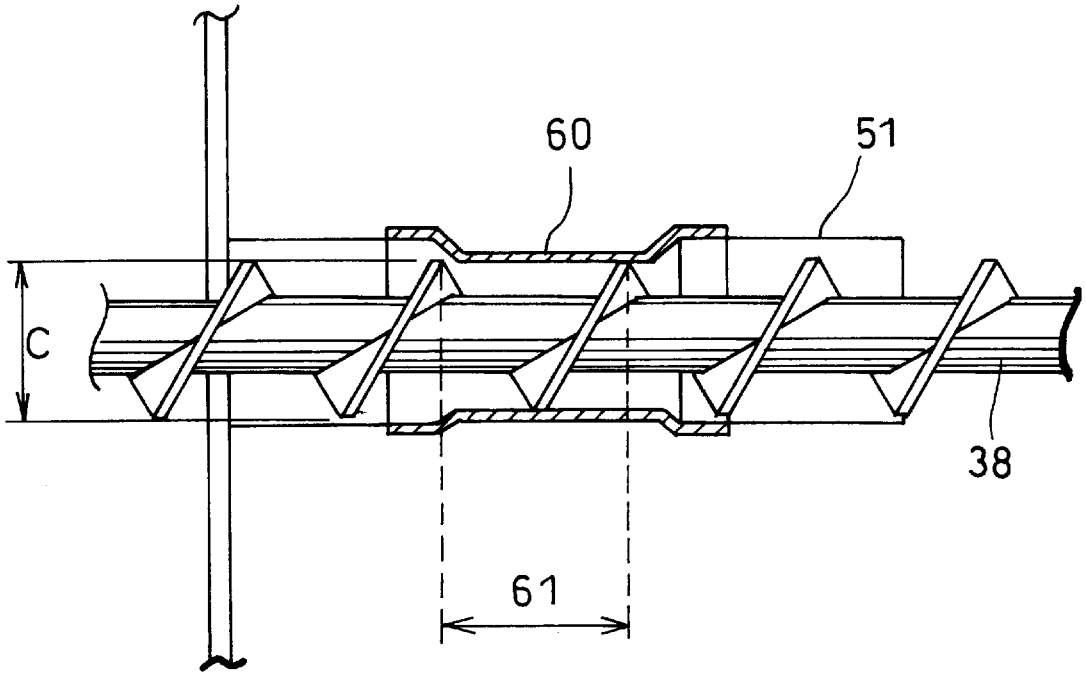
FIG. 21 is a view explaining a shape and a placement state of the transportation screw and pipe section in an image forming apparatus in accordance with still another example of the present invention.

More specifically, as shown in FIG. 21, both the end portions of the pipe section 51 that covers the transportation screw 38 are made of resin, while the central portion of the same is an expandable/contractible elastic part (elastic member) 60 made of urethane or the like. In other words, the elastic part 60 serves as the toner flow suppressing section herein.

The elastic part 60 has an inside diameter such that allows the contact with the blade section 54 while the transportation screw 38 rotates. Since the elastic part 60 is expandable/contractible, the rotation of the transportation screw 38 is not interfered. Thus, the formation of a space (equivalent to the space D in Example 2 above) between the blade section 54 of the transportation screw 38 and the pipe section 51 can be prevented. Consequently, it has become possible to suppress the flowing of the liquid toner into the developing bath 10 (developing unit 29) effectively.

The spiral blade section 54 formed on the transportation screw 38 is the exterior portion of the transportation screw 38. Here, a length of the elastic part 60 of the pipe section 51 in an axial direction is preferably as long as or longer than a pitch 61 at which the spiral blade section 54 makes a full turn (see FIG. 21 for 1 pitch of the spiral blade section 54). In other words, if the elastic part 60 touches the transportation screw 38 in a length as long as or longer than the pitch 61 at which the blade section 54 makes a full turn, the flowing of the toner can be suppressed in a satisfactory manner.

In the present example, the elastic part 60 is made of urethane of 1 mm thick, and a satisfactory result is obtained by making the inside diameter of the elastic part 60 as the same dimension as the exterior portion C of the transportation screw 38 or 1 mm smaller. However, since the setting of the inside diameter varies with expanding/contracting property of a material used for the elastic part 60, it should be appreciated that the inside diameter is not limited to the above set values.

EXAMPLE 6

In the present example, as the toner flow suppressing section, a member made of an elastic material is provided partially to the inner surface of the pipe section 51 to prevent the formation of the space D between the pipe section 51 and transportation screw 38, and this member is arranged to touch the blade section 54 of the transportation screw 38.

Figure 22:
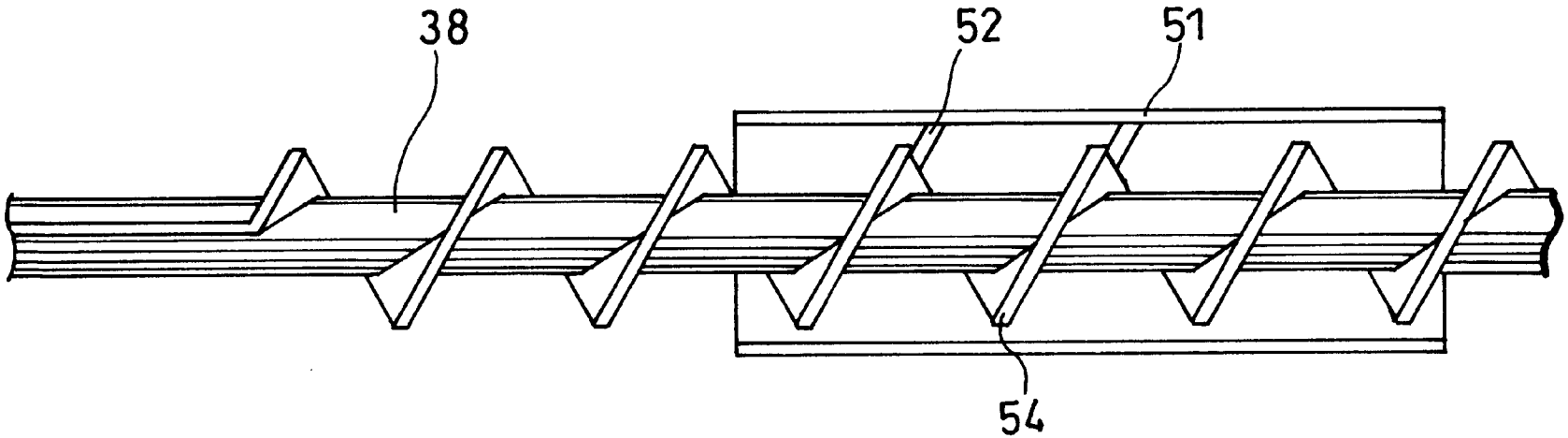
FIG. 22 is a view explaining a placement state of an elastic element provided to an interior of the pipe section in an image forming apparatus in accordance with still another example of the present invention.

More specifically, as shown in FIG. 22, an elastic element (elastic member) 52 made of urethane or the like is bonded to the inner surface of the pipe section 51 along the arc of the spiral blade section 54 of the transportation screw 38. The elastic element is flexible because it is made of an elastic material, and for this reason, the blade section 54 of the transportation screw 38 is allowed to rotate even when the elastic element 52 touches the blade section 54.

The space D between the transportation screw 38 and pipe section 51 can be prevented by providing the elastic element 52 to the inner surface of the pipe section 51 that covers the transportation screw 38 in the above manner. Consequently, the adverse effect caused by the flowing of the liquid toner can be reduced significantly.

In the present example, urethane is used as the elastic material for making the elastic element 52. However, it should be appreciated that the elastic material is not limited to urethan, and elastic materials of various kinds are applicable as well.

EXAMPLE 7

In the present example, a thickness, an ejected width, and an engaged width of the elastic element 52 of Example 6 above with respect to the pipe section 51 will be discussed.

Figure 23:
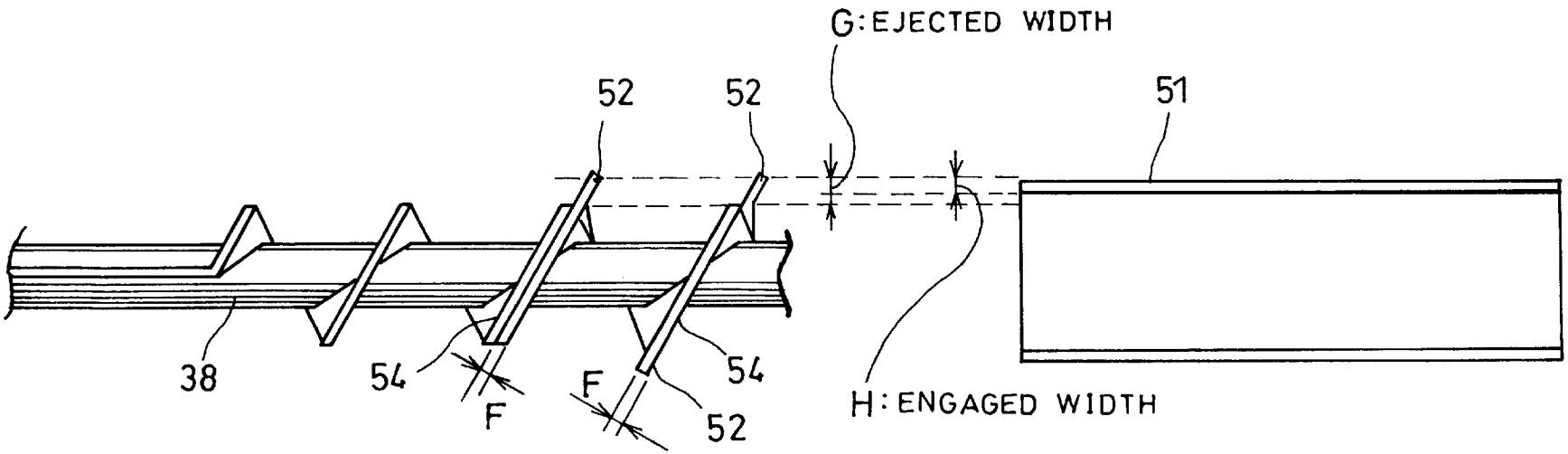
FIG. 23 is a view explaining a dimensional relation of the elastic element and transportation screw of FIG. 22.

As shown in FIG. 23, "the ejected width of the elastic element 52" means a width of a portion of the elastic element 52 provided to the inner surface of the pipe section 51 that ejects toward the transportation screw 38, which is referred to as an ejected width G hereinafter. On the other hand, as shown in FIG. 23, "the engaged width of the elastic element 52" means, when the elastic element 52 is provided to the pipe section 51, a width of a portion of the elastic element 52 that engages with the main body of the pipe section 51, which is referred to as an engaged width H hereinafter. Also, the thickness of the elastic element 52 is referred to as a thickness F.

If the thickness F, ejected width G, and engaged width H of the elastic element 52 are set too large, contact resistance between the inner surface of the pipe section 51 and the transportation screw 38 increases. When this happens, the rotation of the transportation screw 38 is locked, thereby possibly causing inconveniences, such as applying too much load onto the driving circuit or driving mechanism of the transportation screw 38.

Thus, in the present example, optimal ranges for the thickness F, ejected width G, engaged width H are determined from the experiments. That is, an optimal range for the thickness F is between 0.1 mm and 0.2 mm; an optimal range for the ejected width G is between 1 mm and 2 mm, and an optimal range for the engaged width H is between 0 mm and 1.5 mm. When the elastic element 52 is formed within the above specified ranges, the flowing of the toner can be reduced in a satisfactory manner.

EXAMPLE 8

In the present example, a brush member is wrapped around along the blade section 54 of the transportation screw 38 as the toner flow suppressing means.

Figure 24:
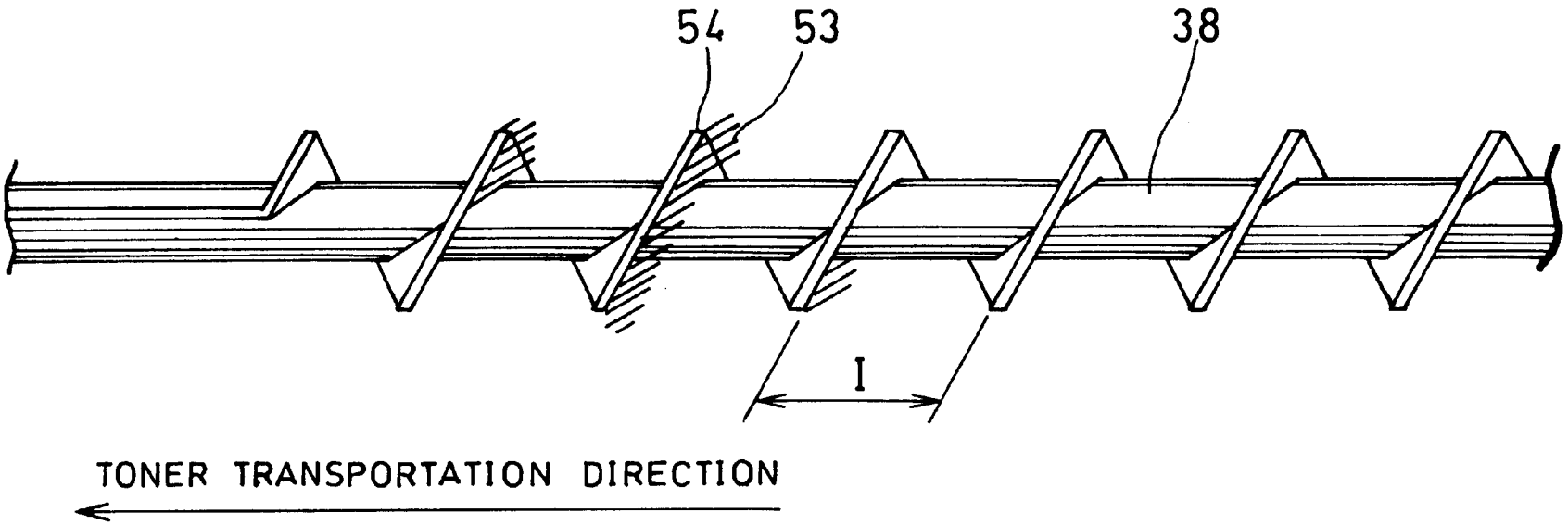
FIG. 24 is a view explaining a placement state of a brush attached to the transportation screw in an image forming apparatus in accordance with still another example of the present invention.

More specifically, as shown in FIG. 24, a brush (brush member) 53 is wrapped around fixedly along the blade section 54 near an end portion in a direction in which the toner is transported in the transportation screw 38.

The brush 53 may possibly reduce a quantity of the toner transported to the developing bath 10 (developing unit 29). However, this can be prevented by placing the brush 53 to the transportation screw 38 at an adequate position.

Also, "the adequate position of the brush 53" means a placement state where the brush 53 is wrapped around the transportation screw 38 within the pipe section 51 in a width up to ⅓ of the width of a pitch I of the blade section 54 of the transportation screw 38 in one or two turns of the pitch of the blade section 54. This specific position is obtained as a result of the experiments.

Figure 25:
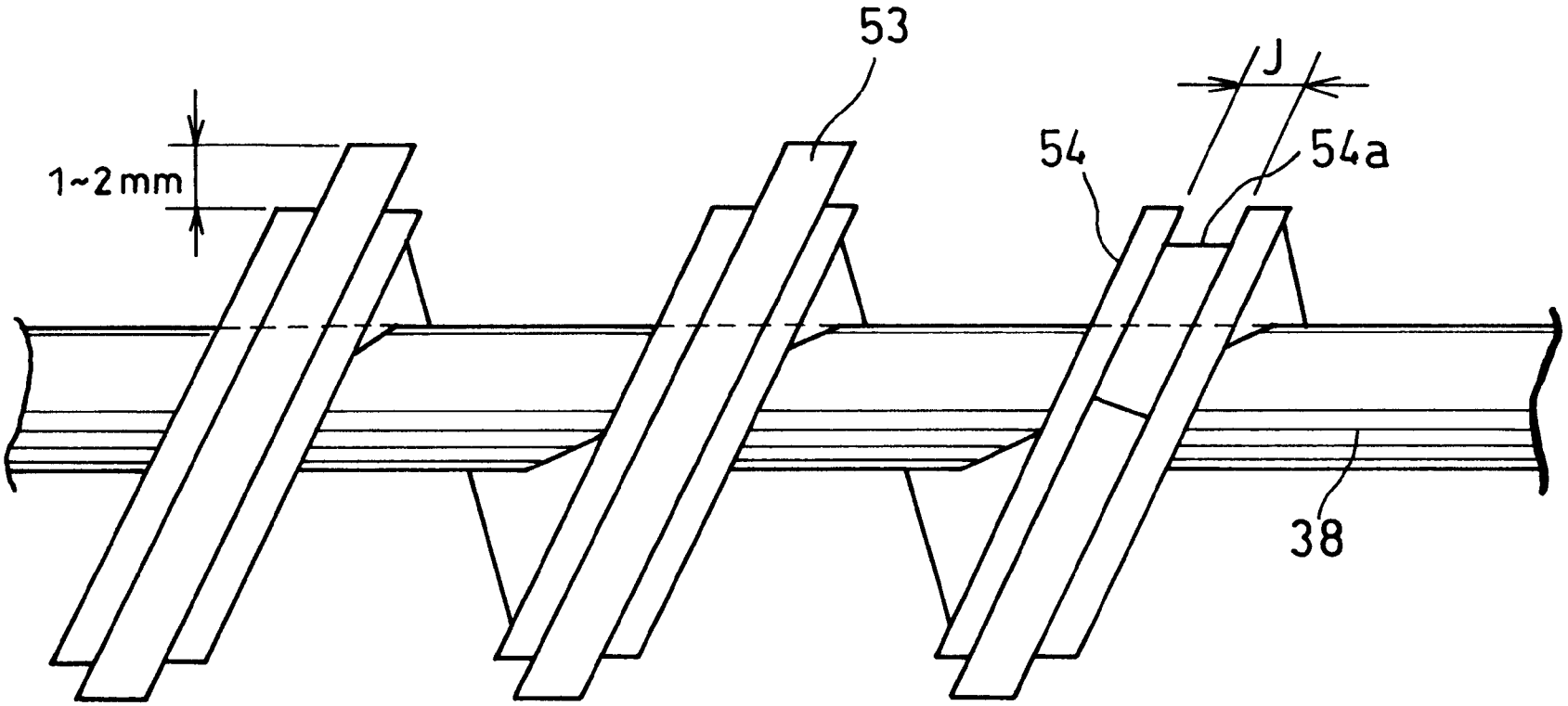
FIG. 25 is a view explaining another placement state and a dimensional relation of the brush of FIG. 24.

It is more preferable to attach the brush 53 to the transportation screw 38 in a manner shown in FIG. 25.

That is, a groove portion 54*a* having a width J=2–3 mm is formed at the top end of the blade section 54 of the transportation screw 38, and the brush 53 is fitted into the groove portion 54*a*. In this arrangement, it is preferable that the bristles of the brush 53 are long enough to protrude from the exterior portion C of the transportation screw 38 by 1–2 mm.

The flowing of the liquid toner can be reduced without affecting a quantity of the toner transported by providing the brush 53 to the transportation screw 38 in such a manner to rotate and contact the inner surface of the pipe section 51.

EXAMPLE 9

In the present example, a spring member is wrapped around the transportation screw 38 as the toner flow suppressing section.

Figure 26:
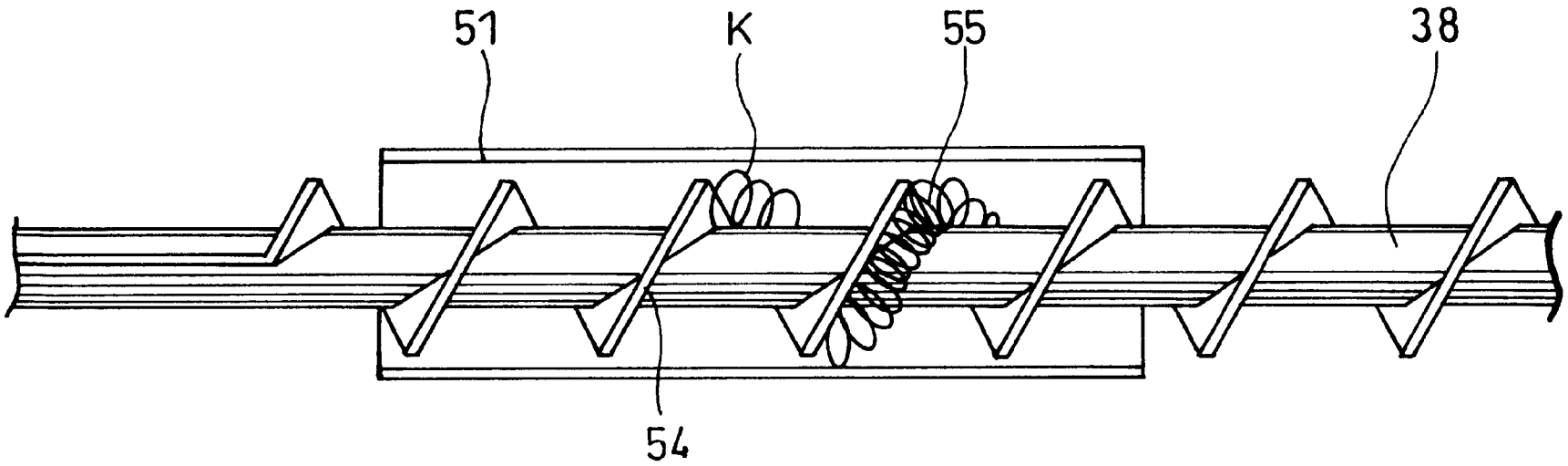
FIG. 26 is a view explaining a placement state of a spring attached to the transportation screw in an image forming apparatus in accordance with still another example of the present invention.

More specifically, as shown in FIG. 26, a spring (spring member) 55 is wrapped around along the blade section 54 and supporting shaft (shaft axis) of the transportation screw 38. Here, at least one turn of the spring 55 is wrapped around the spiral blade section 54 of the transportation screw 38 and the exterior portion K of the spring 55 touches the inner surface of the pipe section 51.

If the spring 55 is too weak, the spring 55 is stretched. On the other hand, if the spring 55 is too strong, the resistance with the inner surface of the pipe section 51 increases to an extent such that increases the rotation torque of the transportation screw 38. When this happens, there occur inconveniences, such as abnormal noise, and the lock phenomenon of the rotation of the transportation screw 38.

In the present example, by taking the result of the experiment into consideration, the spring 55 is designed to be of a linear shape L having a diameter of 0.2–0.3 mm to render an optimal strength. The flowing of the liquid toner can be prevented effectively by providing the above-designed spring 55 to the transportation screw 38 in such a manner that a tolerance of ±0.3 mm is allowed for the exterior portion K of the spring 55 with respect to the inside diameter of the pipe section 51.

EXAMPLE 10

In the present example, fixing means of the spring 55 used in Example 9 above will be further discussed.

Figure 27A:
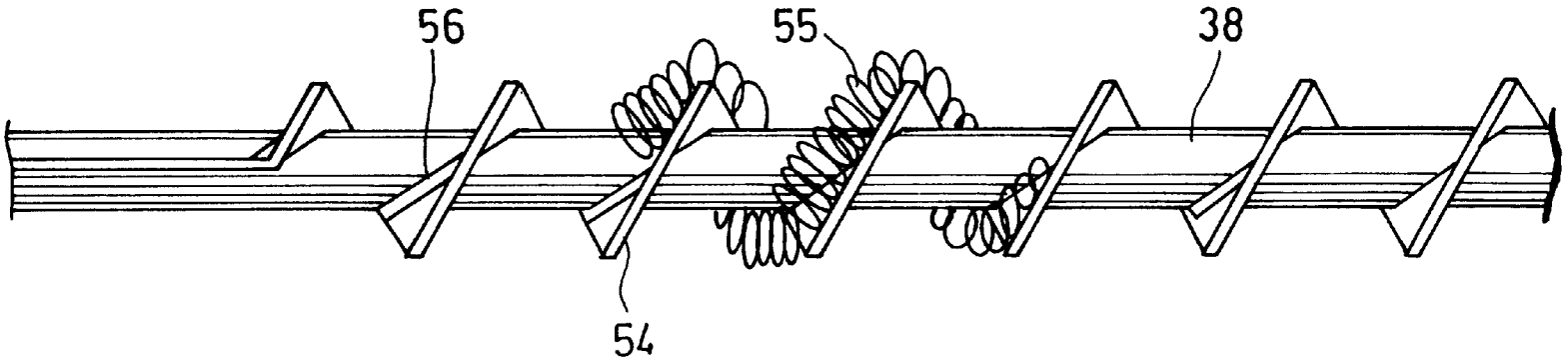
FIGS. 27(*a*) and 27(*b*) are views showing a state in which the spring of FIG. 26 is fixed to the transportation screw with a screw guide (linear member)
Figure 27B:
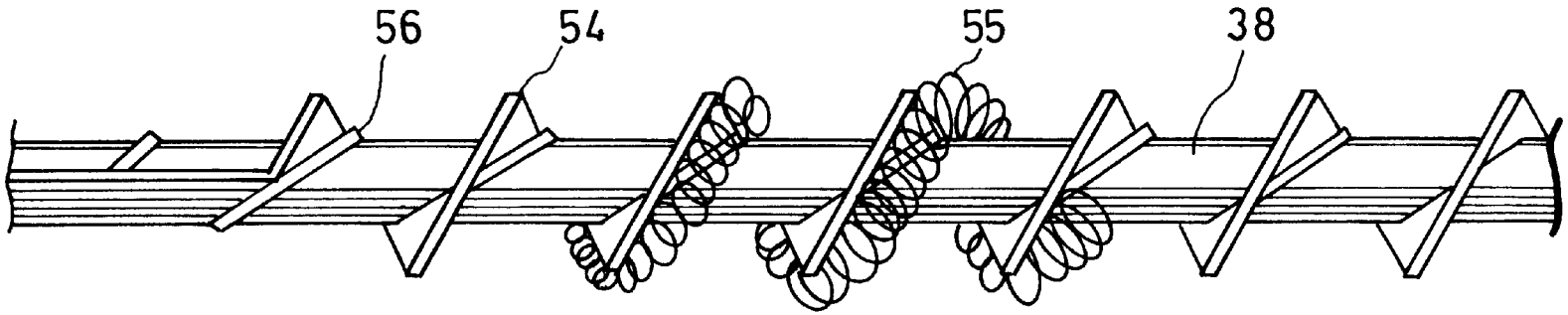

As shown in FIGS. 27(*a*) and (*b*), it is preferable to use, as fixing means for fixing the spring 55, a screw guide 56 (wire herein) made of a linear member and wrapped around along the pitch of the blade section 54 of the transportation screw 38. The spring 55 is fitted through the screw guide 56 first and thence wrapped around the transportation screw 38.

Here, the experiments reveal that, as shown in FIG. 27(*a*) or 27(*b*), the spring 55 must be provided on only one of the two surfaces of the blade section 54 of the transportation screw 38; otherwise, a quantity of the toner transported to the developing bath 10 (developing unit 29) is reduced undesirably.

EXAMPLE 11

In the present example, further to Example 10 above, the fixing means of the spring 55 used in Example 9 above will be discussed.

Figure 28A:
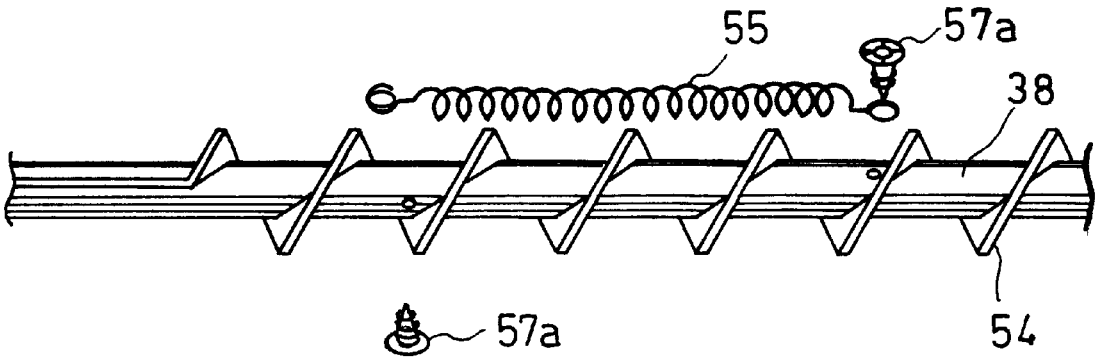
FIGS. 28(*a*) through 28(*c*) are views explaining other methods of fixing the spring of FIG. 26 to the transportation screw.
Figure 28B:
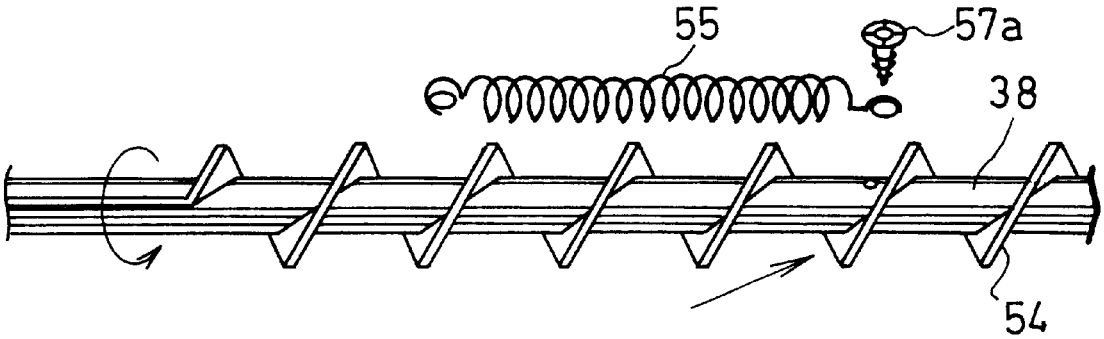
Figure 28C:
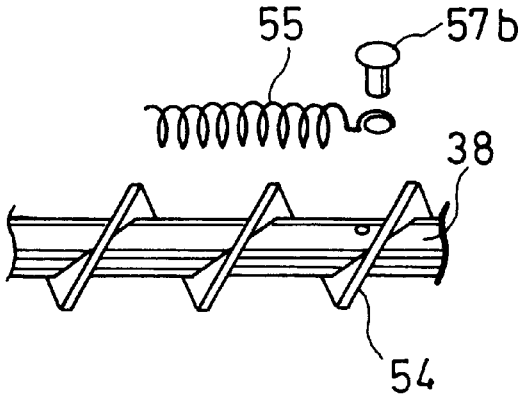

In Example 10 above, the spring 55 is fixed by the screw guide 56, but in the present example, the spring 55 is fixed by being stopped with a vise (vises) as shown in FIGS. 28(*a*) through (*c*). More specifically, as shown in FIG. 28(*a*), the both ends of the spring 55 are made into a shape suitable for being stopped with vises 57*a*, and holes are made in the supporting shaft of the transportation screw 38 in advance, so that the vises 57*a* are fitted therein. Accordingly, the spring 55 can be fixed by merely being fixed with the vises 57*a*.

Also, as shown in FIG. 28 (*b*), even when the spring 55 is stopped by the vise 57*a* at one end alone, the spring 55 can be fixed without practically causing any problem. Further, as shown in FIG. 28(*c*), the spring 55 can be fixed by a pin 57*b* of a press-fit type. This arrangement can offer a merit that the assembling becomes easier.

Note that, however, according to the arrangement using the spring 55, the spring 55 must rotate as the transportation screw 38 rotates while keeping contact with the inner surface of the pipe section 51. For this reason, the spring 55 provided inside the pipe section 51 is placed along the surface of the blade section 54 of the transportation screw 38 in the same manner as shown in FIG. 27 (*a*) or 27(*b*).

In the present example, unlike Example 10 above, the spring 55 is not entirely supported by the screw guide 56. Thus, it is not preferable to place the spring 55 as shown in FIG. 27(*b*), that is, on the surface of the blade section 54 opposing to the direction in which the toner is transported, because the spring 55 is not fixed to the transportation screw 38 in a secure manner. Therefore, the spring 55 must be placed along the surface of the blade section 54 in the direction in which the toner is transported as shown in FIG. 27(*a*).

In the present example, the spring 55 may be fixed by other methods. For example, cuts may be provided to the screw shaft or blade section 54 of the transportation screw 38.

Figure 29:
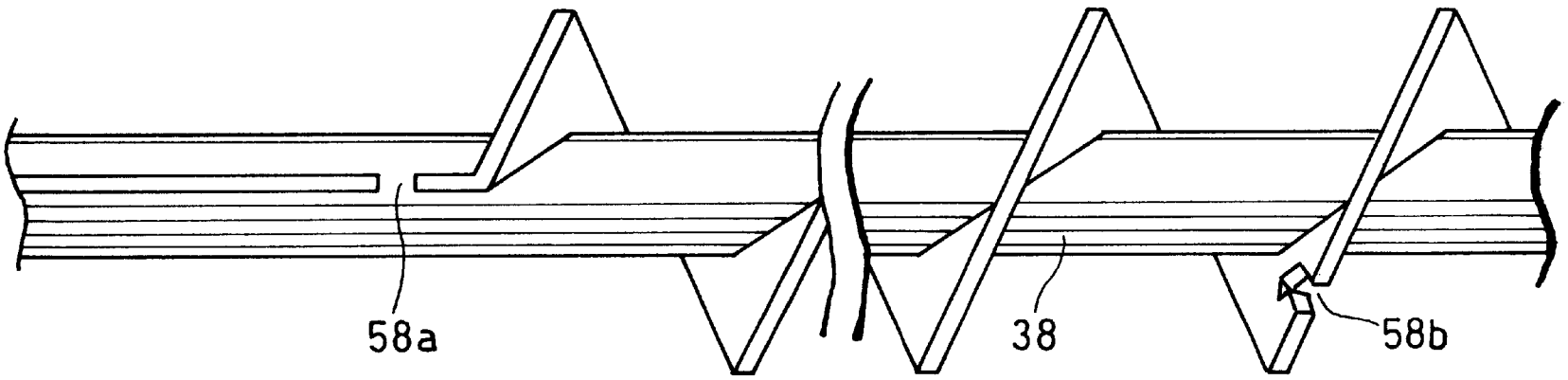
FIG. 29 is a view explaining cuts formed in the transportation screw to fix the spring of FIG. 26 to the transportation screw.
Figure 30:
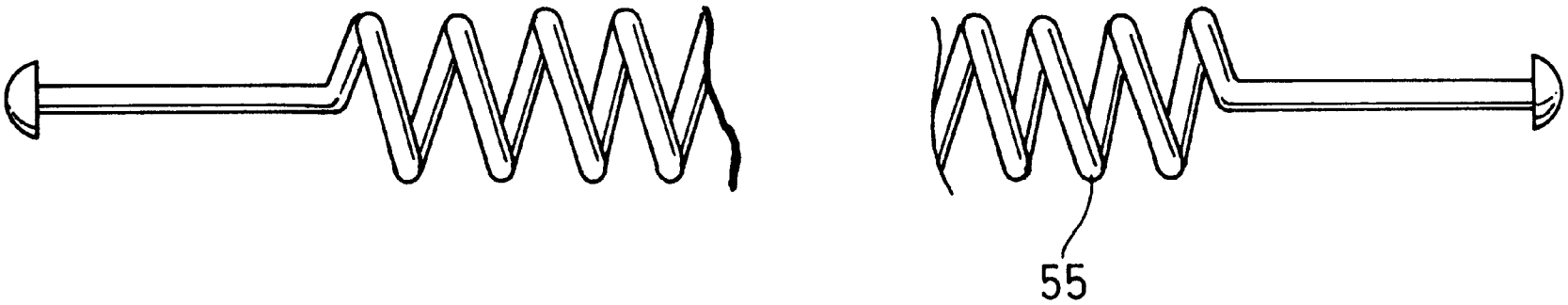
FIG. 30 is a view explaining an arrangement of a spring which can be fixed to the transportation screw using the cuts of FIG. 29.

More specifically, as shown in FIG. 29, a cut 58*a* is provided to the screw shaft of the transportation screw 38 at the end in the toner transportation direction and another cut 58*b* is provided to the blade section 54 at an adequate position. Correspondingly, the ends of the spring 55 are made into a shape so that they can be hooked by the cuts 58*a* and 58*b*. Thus, the spring 55 can be fixed to the transportation screw 38 by being fitted into the cuts 58*a* and 58*b* at the ends, respectively.

The method using the cuts as above can omit special fixing members, thereby offering a merit that the fixing process of the spring 55 can be simplified and the assembling efficiency is improved.

In the examples described above (Examples 1 through 11), in order to prevent the liquid toner from flowing into the developing unit 29, the toner flow suppressing sections of different arrangements are adopted to the transportation screw 38 that transports the toner. In contrast, in the examples described below, a toner transportation opening (toner discharge opening) of the transportation screw 38 is allowed to close with a lifting member provided to each of the toner stirring sections 36 and 37 for the same purpose.

In other words, in each of the examples described below, a lifting section (lifting member) 40 is provided at a top portion of each of the toner stirring sections 36 and 37 provided inside the toner box 24 in such a manner to close the top portion of the transportation screw 38 whenever the toner is replenished. The flowing of the toner is controlled by this arrangement.

Here, the lifting sections 40 do not have to close the transportation screw 38 completely. For example, a length of each lifting section 40 can be set in such a manner that the upper portion of the exposed portion of the transportation screw 38 overlaps both the lifting sections 40, or the former is spaced apart for a predetermined amount from the latter. Even when either of the above arrangements is adopted, the flowing of the liquid toner to the developing unit 29 can be suppressed.

Although the examples are described in detail below, the results obtained from each example are set forth in Table 2 below to show that a quantity of the toner flowing to the developing bath 10 varies with the setting conditions of the lifting section(s) 40, and so does the effect of preventing the flowing of the toner.

TABLE 2

| | SET CONDITIONS FOR LIFTING MEMBER | QUANTITY OF TONER FLOWN TO DEVELOPING UNIT (g) |
|---|---|---|
| ① | LIFTING MEMBERS ARE OVERLAPPED ABOVE TRANSPORTATION SCREW | 3.25 |
| ② | TOP END OF EACH LIFTING MEMBER IS MADE INTO ARC & MEMBERS ARE OVERLAPPED ABOVE TRANSPORTATION SCREW | 0.15 |
| ③ | LIFTING MEMBER IS MADE INTO DOUBLE-LAYER STRUCTURE | 0.18 |
| ④ | TOP END OF LIFTING MEMBER IS CURVED | 0.25 |

TABLE 2-continued

| | SET CONDITIONS FOR LIFTING MEMBER | QUANTITY OF TONER FLOWN TO DEVELOPING UNIT (g) |
|---|---|---|
| ⑤ | LIFTING MEMBER IS REINFORCED SO AS NOT TO BEND | 0.15 |
| ⑥ | ELASTIC MEMBER IS PROVIDED TO SIDE SURFACE OF LIFTING MEMBER IN addition TO ARRANGEMENT ③ | 0.08 |
| | NO CONDITIONS | 45.50 |

EXAMPLE 12

An arrangement of the present example for preventing the flowing of the toner is the arrangement ① in Table 2 above, that is, the lifting sections 40 are overlapped above the transportation screw 38.

Figure 31:
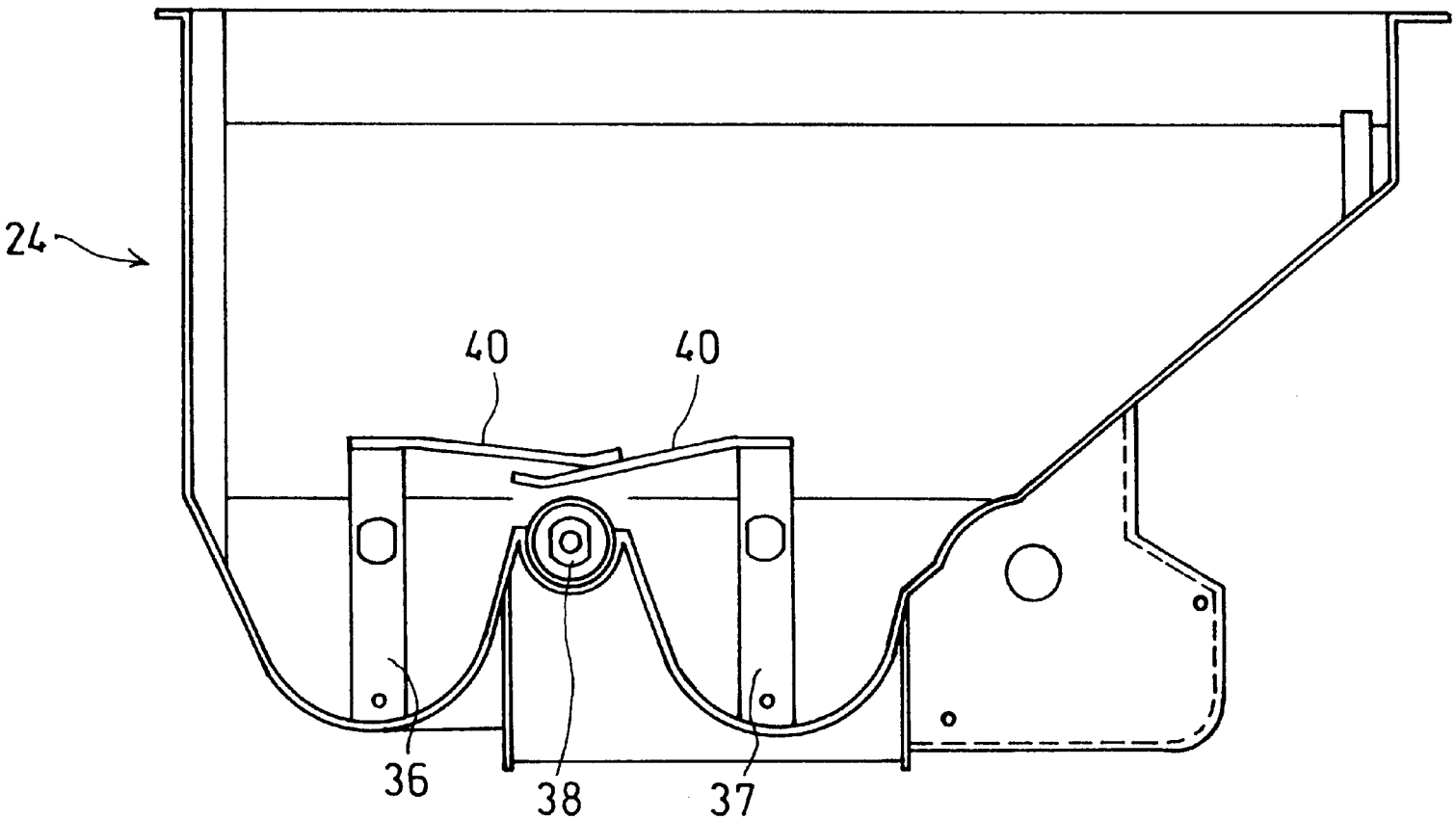
FIG. 31 is a cross section depicting an arrangement of a toner box in an image forming apparatus in accordance with still another example of the present invention.

More specifically, as shown in FIG. 31, the lifting sections 40 are used as an arrangement (flowing toner preventing means) for preventing the toner from flowing into the developing unit 29. The lifting section 40 is provided to the top portion of each of the toner stirring sections 36 and 37 installed inside the toner box 24.

In the present example, each lifting section 40 is made of a PET film and has a thickness T of 0.2 mm or so. The lifting section 40 not only lifts up the toner, but also functions to close the toner transportation opening above the transportation screw 38. Thus, it has become possible to prevent the liquid toner from flowing into the developing unit 29 before it reaches the toner transportation opening in the toner hopper 30. It should be appreciated that, however, the material and arrangement of the lifting section 40 are not limited to the above disclosure.

Figure 32:
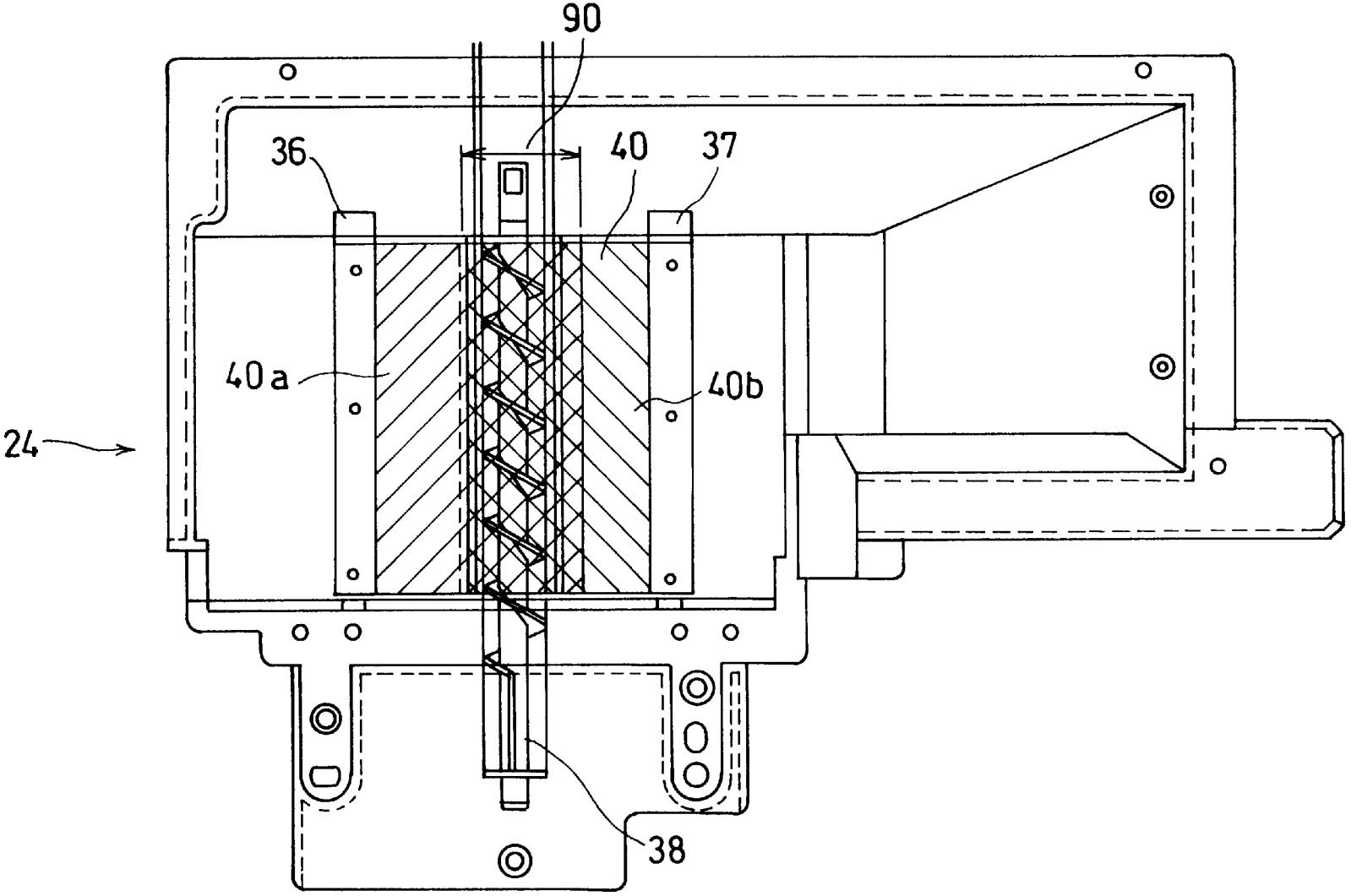
FIG. 32 is a top view explaining a state of the toner box of FIG. 31.

When the toner box 24 is seen from the above, a state that the lifting sections 40 overlap each other is indicated by a crosshatched area 90 in FIG. 32 where two diagonally shaded portions overlap each other. More specifically, the lifting section 40*a* (portion with a diagonal shade that slants to the left in the drawing) provided at the top portion of the toner stirring section 36 overlaps the other lifting section 40*b* (portion with a diagonal shade that slants to the right in the drawing) provided at the top portion of the toner stirring section 37 above the transportation screw 38 (the area 90 where two diagonal lines cross each other). This arrangement makes it possible to control the liquid toner supplied from the top portion of the toner box 24 from flowing into the developing unit 29.

The lifting sections 40 overlap each other above the transportation screw 38 at specific timing, such as initial setting and toner replenishment. An arrangement to let the lifting sections 40 overlap each other at the above timing is not especially limited, and for example, as shown in FIGS. 33(*a*) and 33(*b*), a method of using a driving section for rotating the transportation screw 38 and toner stirring sections 36 and 37 by means of the aforementioned driving motor 43 can be used.

As shown in FIG. 12, the driving section is furnished with a plurality of gears linked to each other. In the present example, of all these gears, a mark 63 indicating a portion having difference reflectance is provided to a part of the gear 46 that drives the toner stirring section 36. The mark 63 is detected by a light reflection type detector 64.

Figures 33A, 33B:
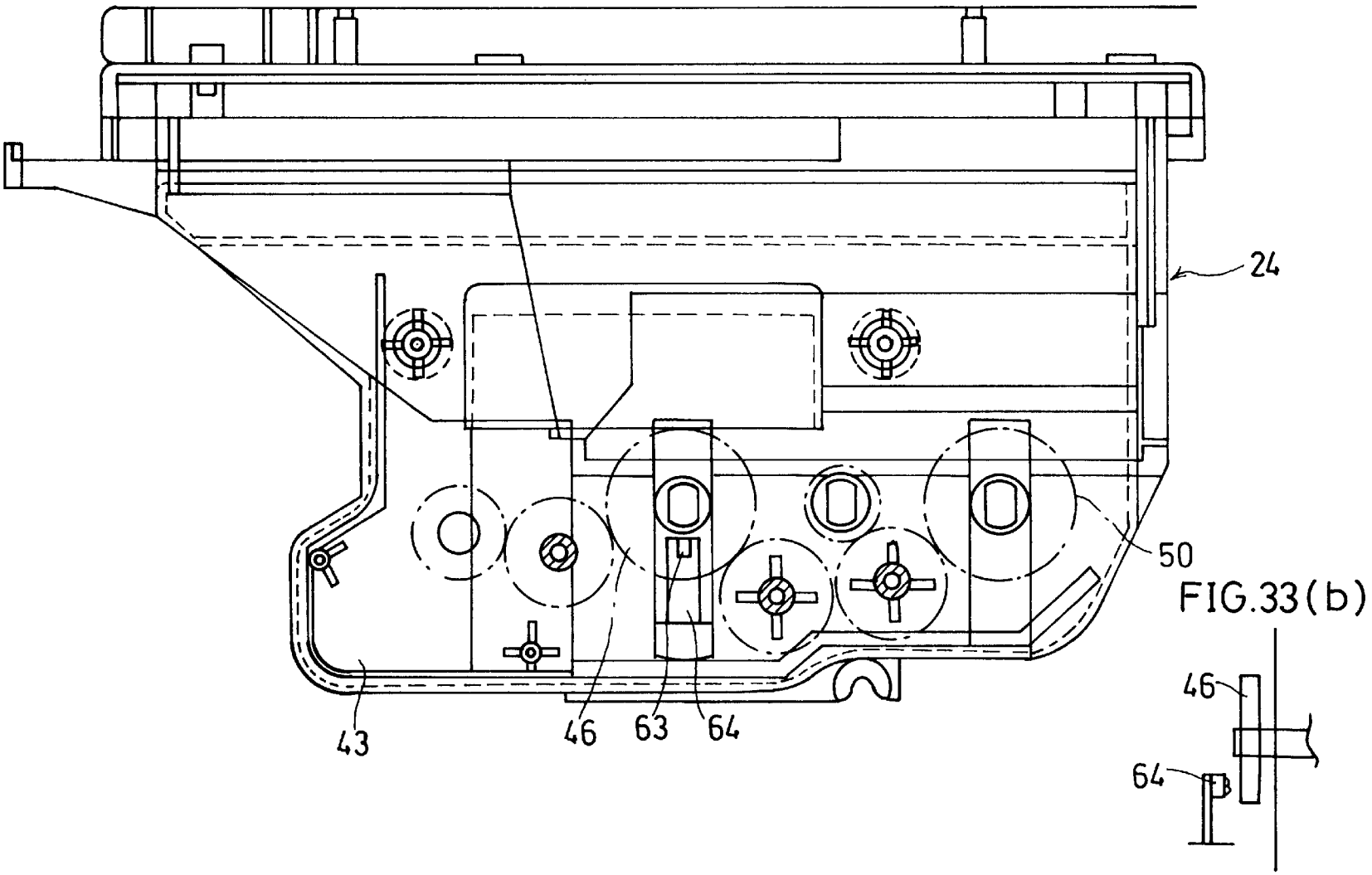
FIG. 33(*a*) is a side view depicting an arrangement of a driving section of the toner box of FIG. 31.

Thus, it is arranged in such a manner that the gear 46 is stopped when the light reflection type detector 64 reads the mark 63 as shown in FIG. 33(*b*), whereupon the lifting sections 40 overlap each other. When the stop point of the mark 63 on the gear 46 is arranged to match with the stop position of the lifting sections 40, the lifting sections 40 always stop at a predetermined position to close the toner transportation opening at the initial setting or toner replenishment.

Besides the method of using the light reflection type detector 64, the mark 63 can be detected by any other method. For example, if the mark 63 is arranged in various manners, it can be detected by a method using a light transmission type detector or using methods other than optical method, such as a mechanical switch or the like.

EXAMPLE 13

An arrangement of the present example for preventing the flowing toner is the arrangement ② in Table 2 above, that is, the top end of each lifting section 40 is made into an arc and the lifting sections 40 are overlapped each other above the transportation screw 38.

Figure 34:
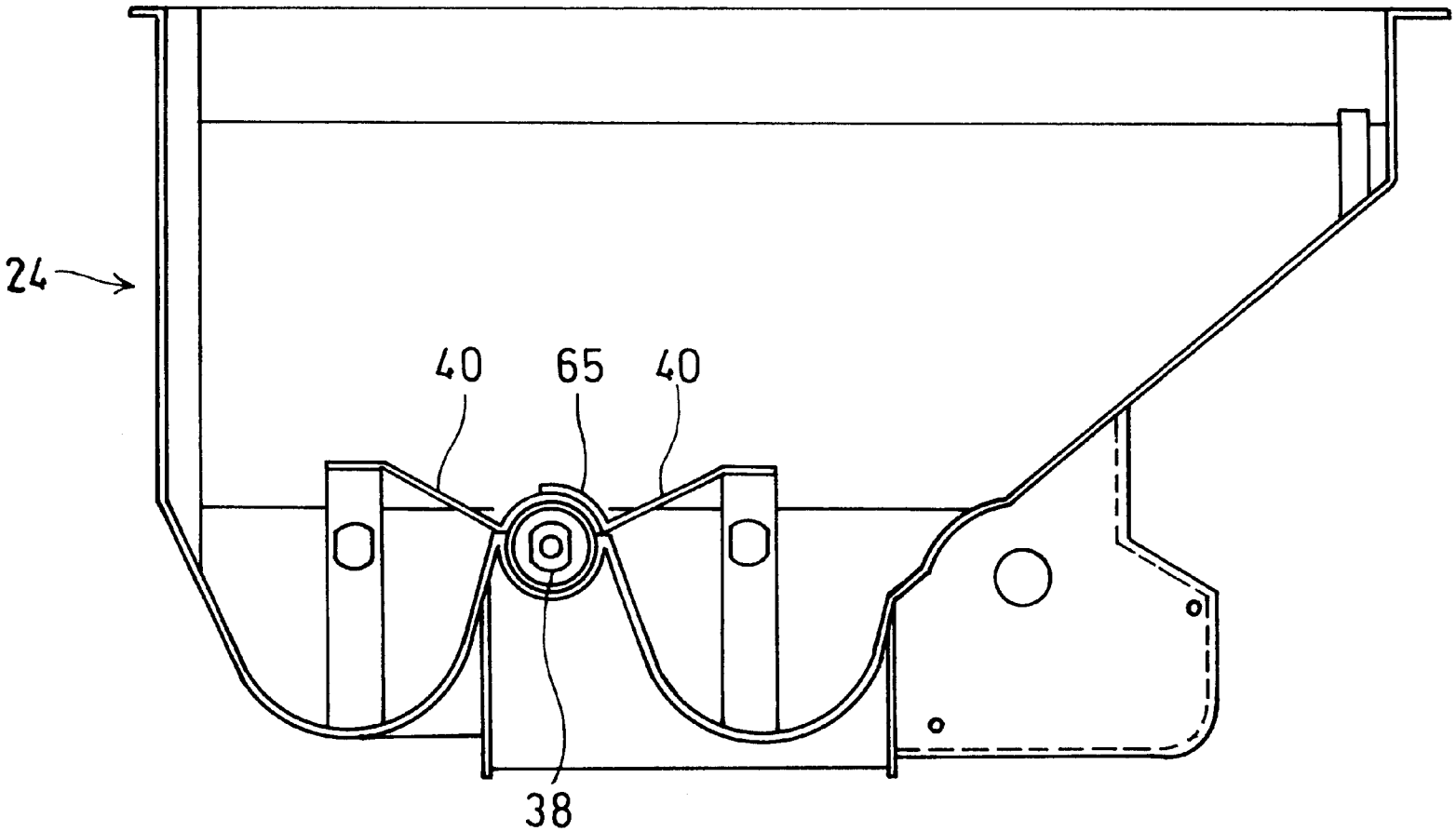
FIG. 34 is a cross section depicting an arrangement of a toner box in an image forming apparatus in accordance with still another example of the present invention.

More specifically, as shown in FIG. 34, a portion of each lifting section 40 that comes directly above the transportation screw 38 when the lifting sections 40 overlap each other, that is, an end portion 65 of each lifting section 40 is made into an arc. It is preferable that the arc shape conforms to a shape of the transportation screw 38 so as to close the toner transportation opening in a secure manner. This arrangement makes it possible to prevent the flowing of the liquid toner effectively, because the toner transportation opening can be controlled to leave the least space.

EXAMPLE 14

An arrangement of the present example for preventing the flowing of the toner is the arrangement ③ in Table 2 above, that is, each lifting section 40 is made into a double-layer structure.

Figure 35:
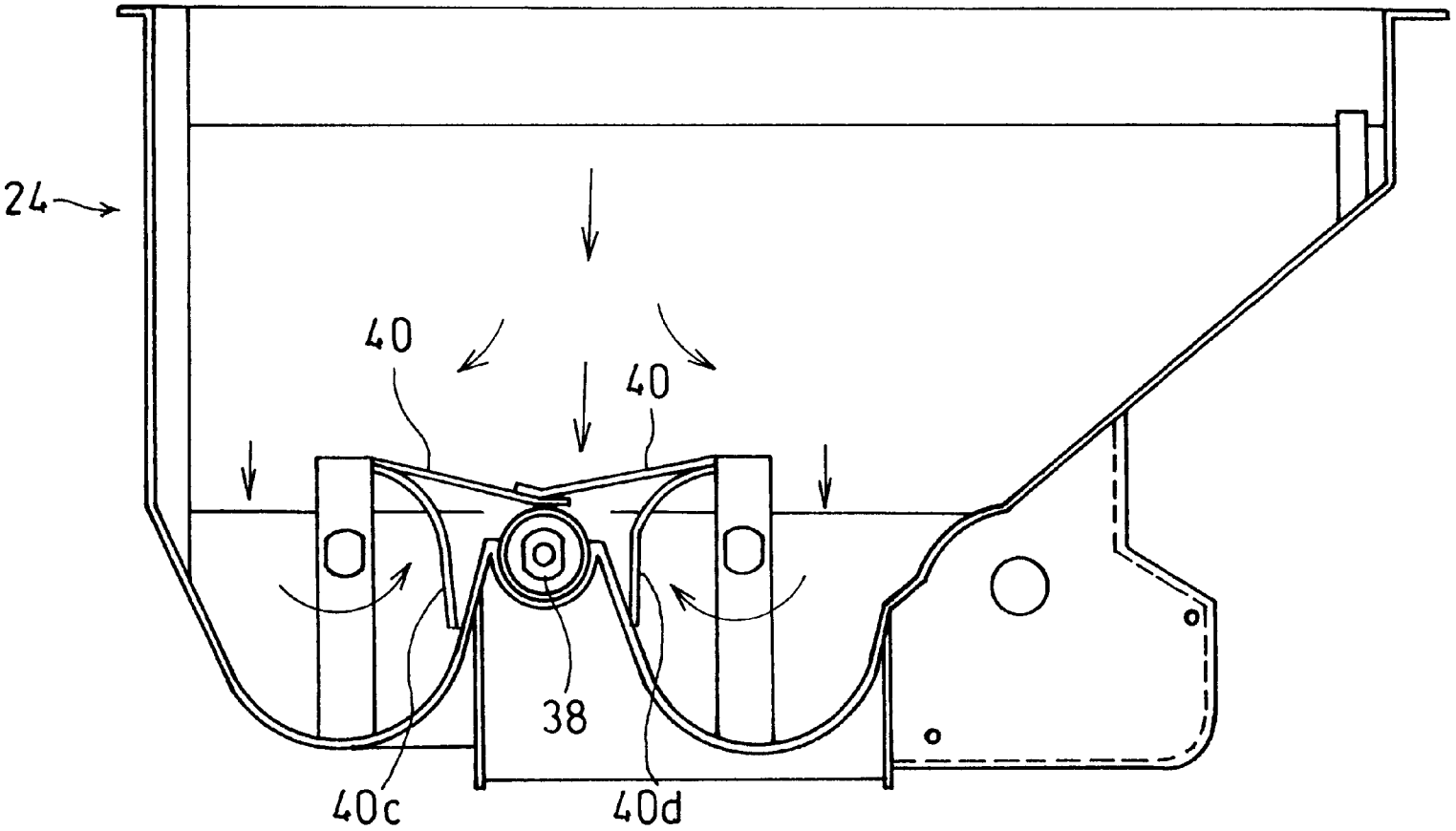
FIG. 35 is a cross section depicting an arrangement of a toner box in an image forming apparatus in accordance with still another example of the present invention.

More specifically, as shown in FIG. 35, additional lifting sections 40*c* and 40*d* are provided respectively to the lifting sections 40 at the lower end, whereby each lifting section 40 is made into a double-layer structure. This arrangement makes it possible to ensure the control of the liquid toner flowing into the toner box 24 from its side surface (in a direction indicated by arrows in the drawing.)

It should be appreciated that, however, the structural arrangement of the lifting section 40 is not limited to the double-layer structure as shown in FIG. 35, and it can be a multi-layer structure having more than two layers.

Figure 36:
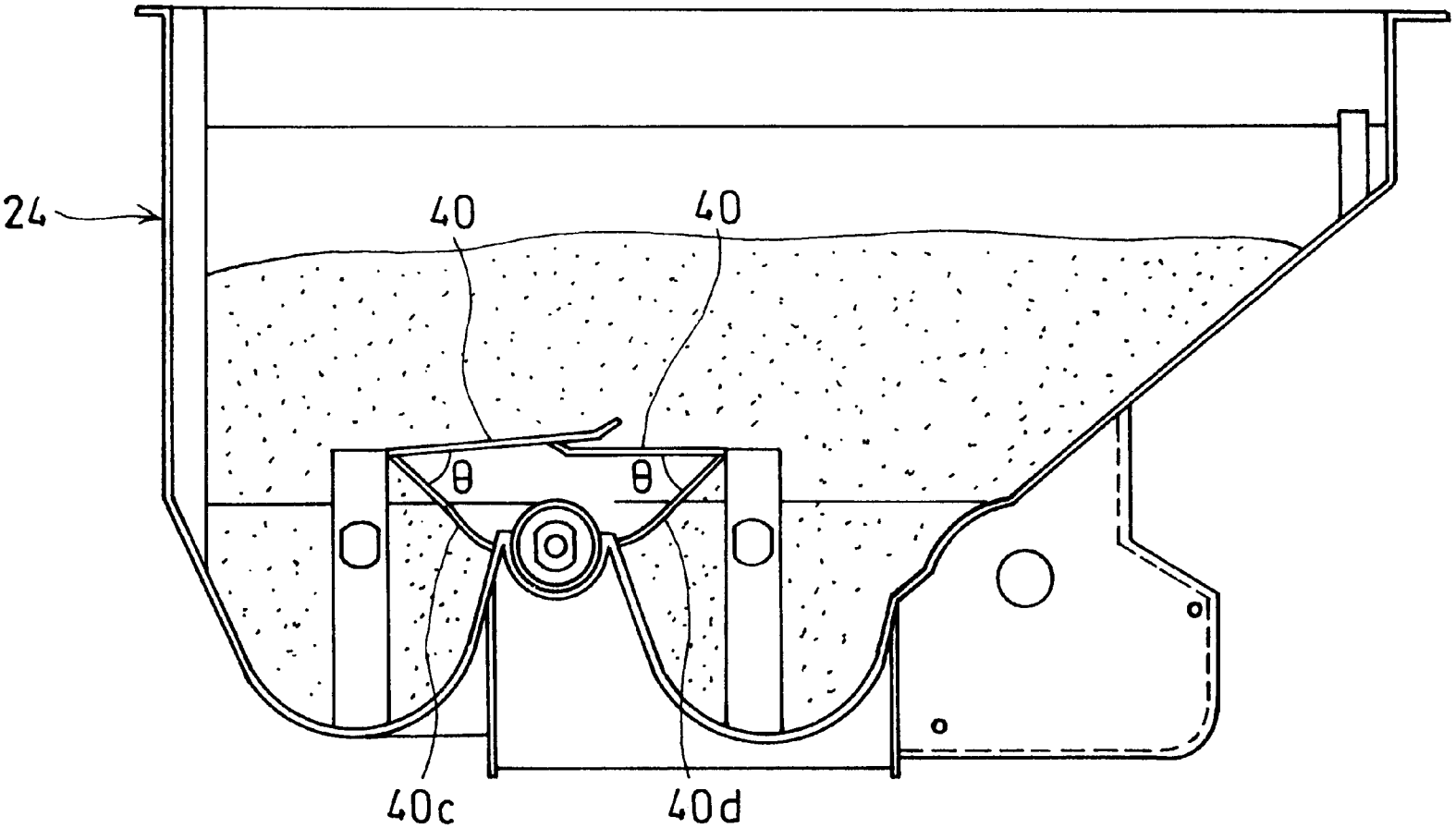
FIG. 36 is a cross section depicting an arrangement of lifting sections provided to the toner box of FIG. 35.

Further, the overlap condition of the lifting sections 40 and each of the lifting sections 40*c* and 40*d* in the second layer is not especially limited. In the present example, as shown in FIG. 36, an angle of the lifting sections 40*c* and 40*d* with respect to their respective lifting sections 40 during the rotary operation is an acute angle (herein, 45°–90°), for example. Consequently, the toner box 24 can withhold the toner to its full capacity by adopting the above arrangement.

In other words, as shown in FIG. 36, an angle θ of the lifting sections 40 with respect to each of the lifting sections 40*c* and 40*d* is set to an acute angle, preferably in a range between 45° and 90°. Consequently, not only the flowing of the liquid toner can be prevented, but also a capacity of a portion other than the diagonally shaded portion in the drawing (a portion into which the toner is not allowed to enter temporarily) can be minimized. In short, it has become possible to prevent a reduction of an overall capacity of the toner box 24.

EXAMPLE 15

An arrangement of the present example for preventing the flowing toner is the arrangement ⑤ in Table 2 above, that is, the lifting sections 40 are reinforced so as not to bend.

Figure 37:
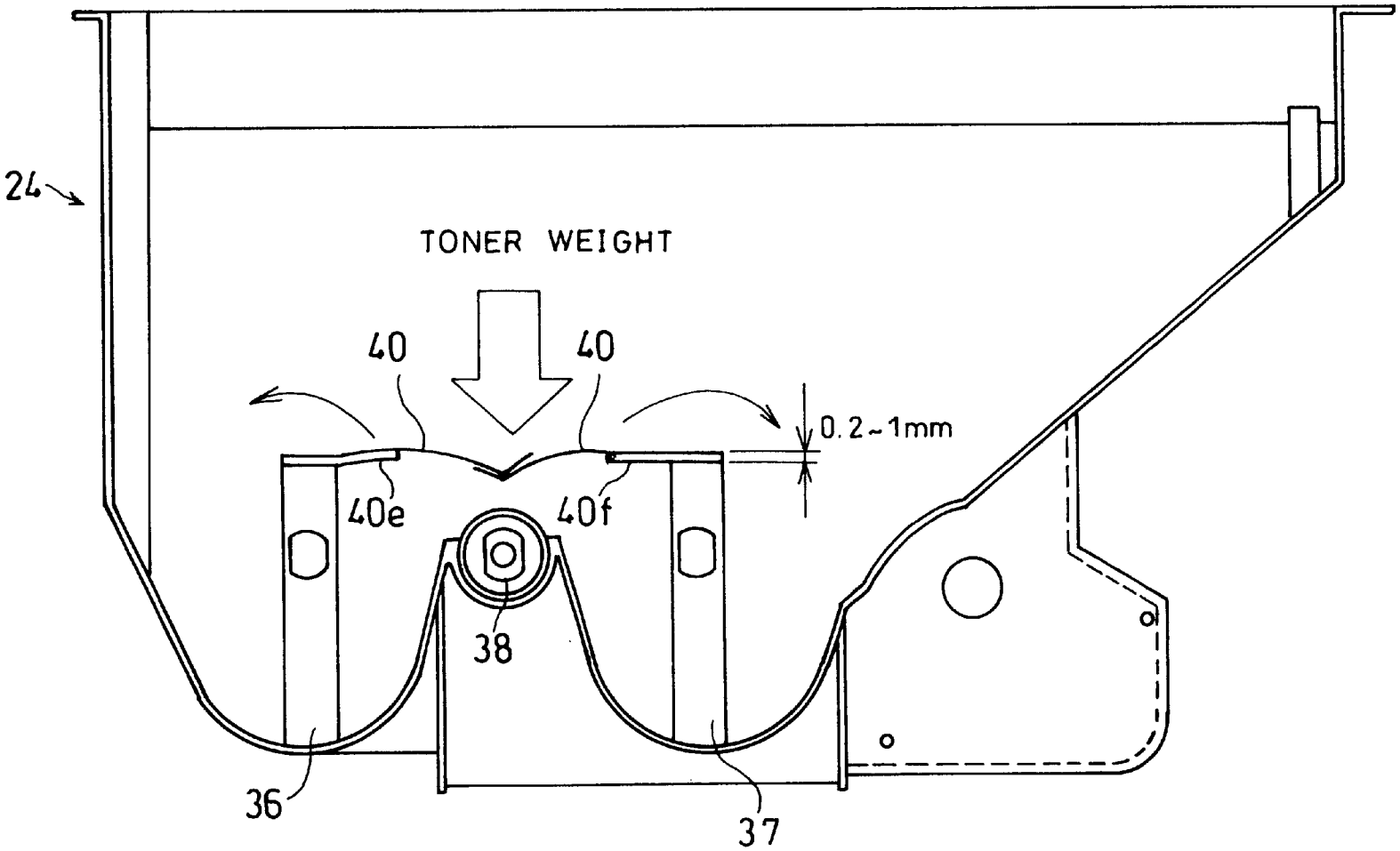
FIG. 37 is a cross section depicting an arrangement of a toner box in an image forming apparatus in accordance with still another example of the present invention.

As shown in FIG. 37, reinforcing films 40*e* and 40*f* made of a PET film at least as thick as the lifting sections 40 and thinner than 1 mm are provided to the back surfaces of the lifting sections 40 (herein, a PET film having a thickness T of 0.2 mm or so) provided with respect to a direction in which the toner stirring sections 36 and 37 rotate.

The bending of the lifting sections 40 caused by the weight of the toner applied when the toner is replenished can be prevented by providing the reinforced films 40*e* is and 40*f*. Consequently, it has become possible to prevent the formation of a space between the two overlapping lifting sections 40, and hence the toner leakage.

In the present example, the reinforcing films 40*e* and 40*f* are provided to the back surfaces of the lifting sections 40 as the reinforcing member, however, it should be appreciated that the arrangement is not limited to the above disclosure, and the reinforcing members can be provided to the front surfaces instead. Further, the reinforcing member can be provided to both the surfaces.

Figure 47:
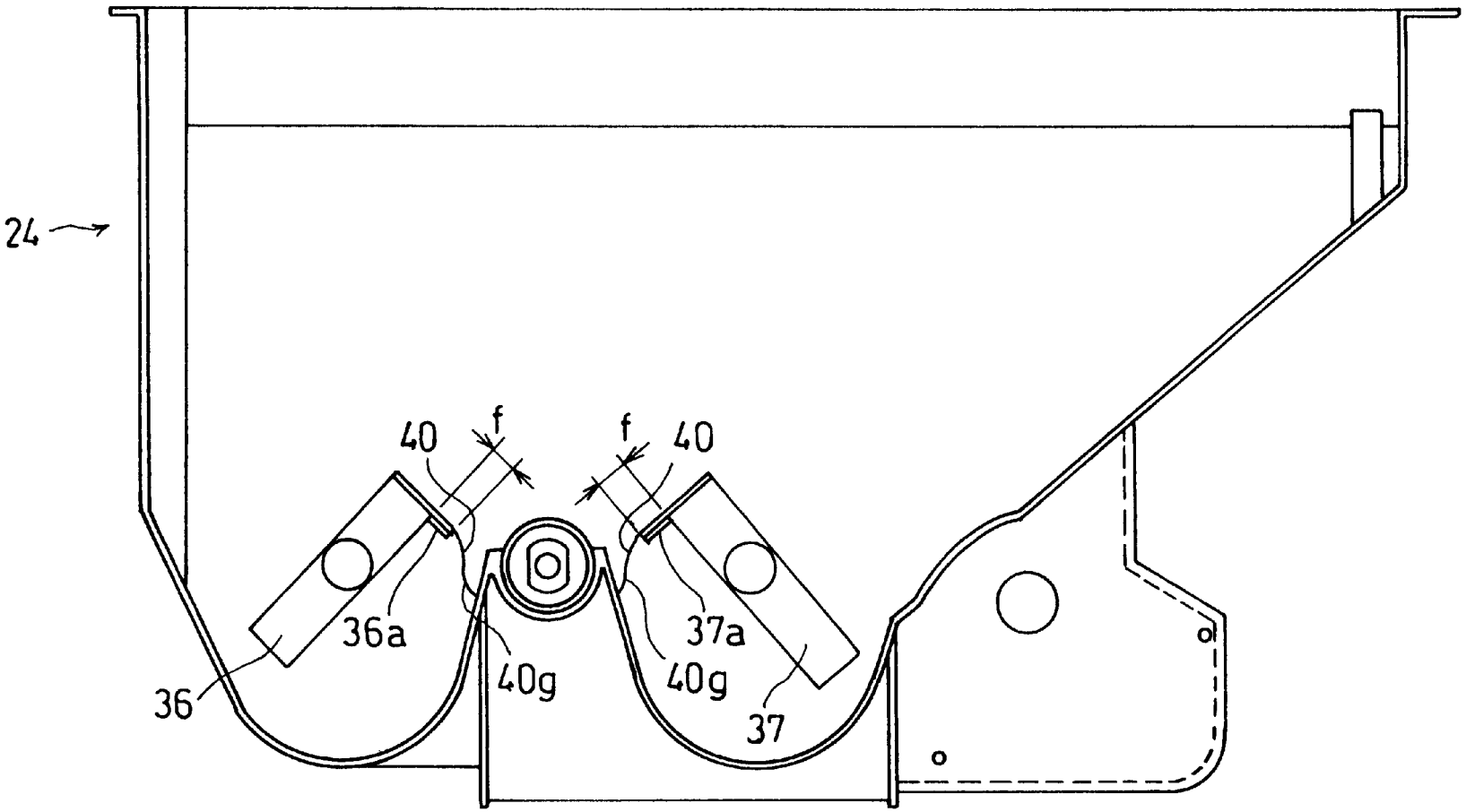
FIG. 47 is a cross section depicting an arrangement of a toner box in an image forming apparatus in accordance with still another example of the present invention.

Alternatively, the lifting sections 40 can be reinforced by a method shown in FIG. 47. That is, the portions that overlap the lifting sections 40 at the end portions 36*a* and 37*a* of the toner stirring sections 36 and 37 are formed to protrude outward. In this case, a dimension f of the protrusion at the end portions 36*a* and 37*a* is 5 mm or so. According to this arrangement, the strength of the lifting sections 40 can be improved in an adequate manner.

When the dimension f of the protrusion of the end portions 36*a* and 37*a* is 5 mm or so, the end portions 36*a* and 37*a* prevent the top end portions 40*g* of the lifting sections 40 from being reinforced exceedingly, thereby allowing lifting portions 40 to maintain the flexibility of the PET film. Thus, even when the top end portions 40*g* causes friction with the wall surface of the toner box 24, the toner stirring sections 36 and 37 can rotate in a satisfactory manner without increasing the rotation torque thereof exceedingly.

Figure 48:
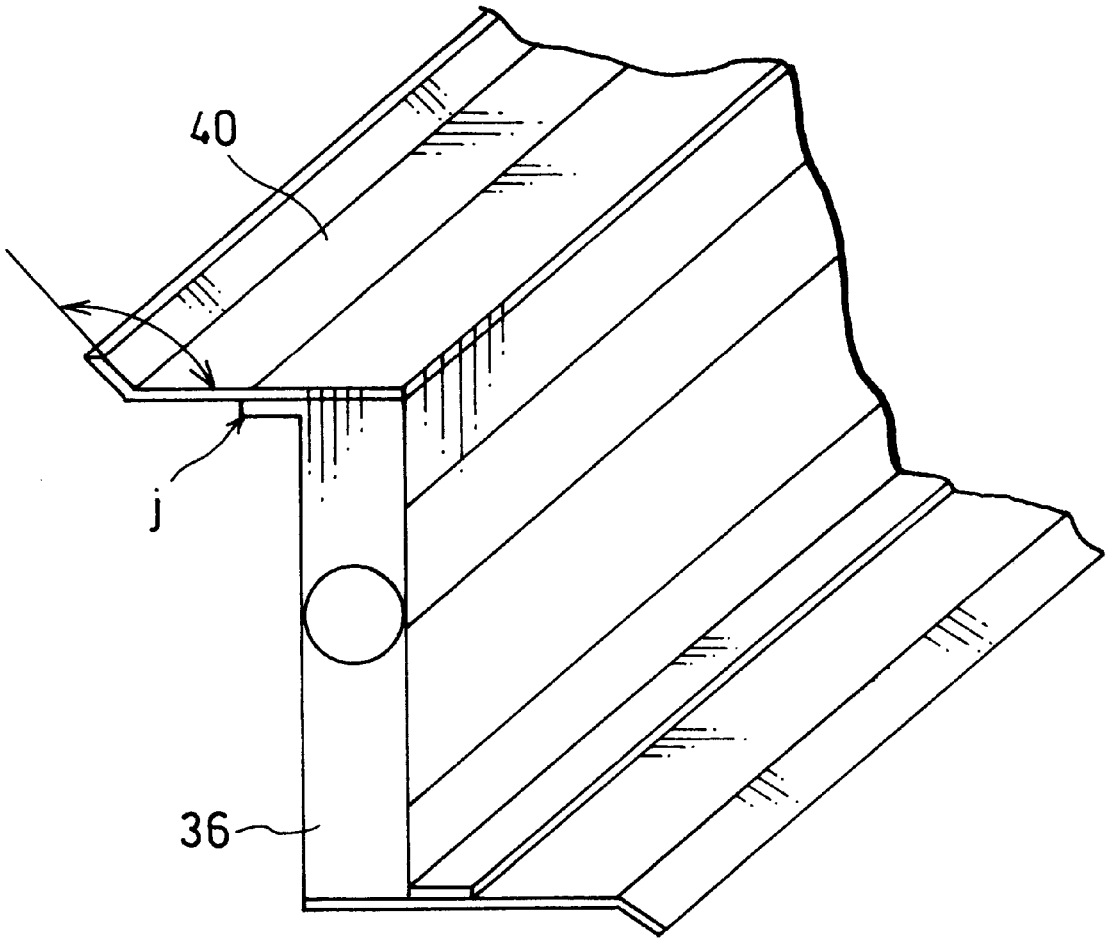
FIG. 48 is a view explaining an arrangement of a lifting section provided to the toner box of FIG. 47.

Besides the case that the lifting sections 40 are made of a PET film, the above arrangement of protruding the end portions 36*a* and 37*a* of the toner stirring sections 36 and 37 can be applied to a case where the lifting section 40 and toner stirring section 36 are formed into one body as shown in FIG. 48. In other words, a portion (diagonally shaded portion) of the toner stirring section 36, used as an attachment surface to which the lifting section 40 is attached, is formed in a protruding shape. Consequently, the strength can be improved in an inexpensive manner. A dimension j of the protrusion is same as the aforementioned dimension f of the protrusion, that is, 5 mm or so.

EXAMPLE 16

An arrangement of the present example for preventing the flowing of the toner is the arrangement ④ in Table 2 above, that is, the top end portions of the lifting sections 40 are curved.

Figure 38:
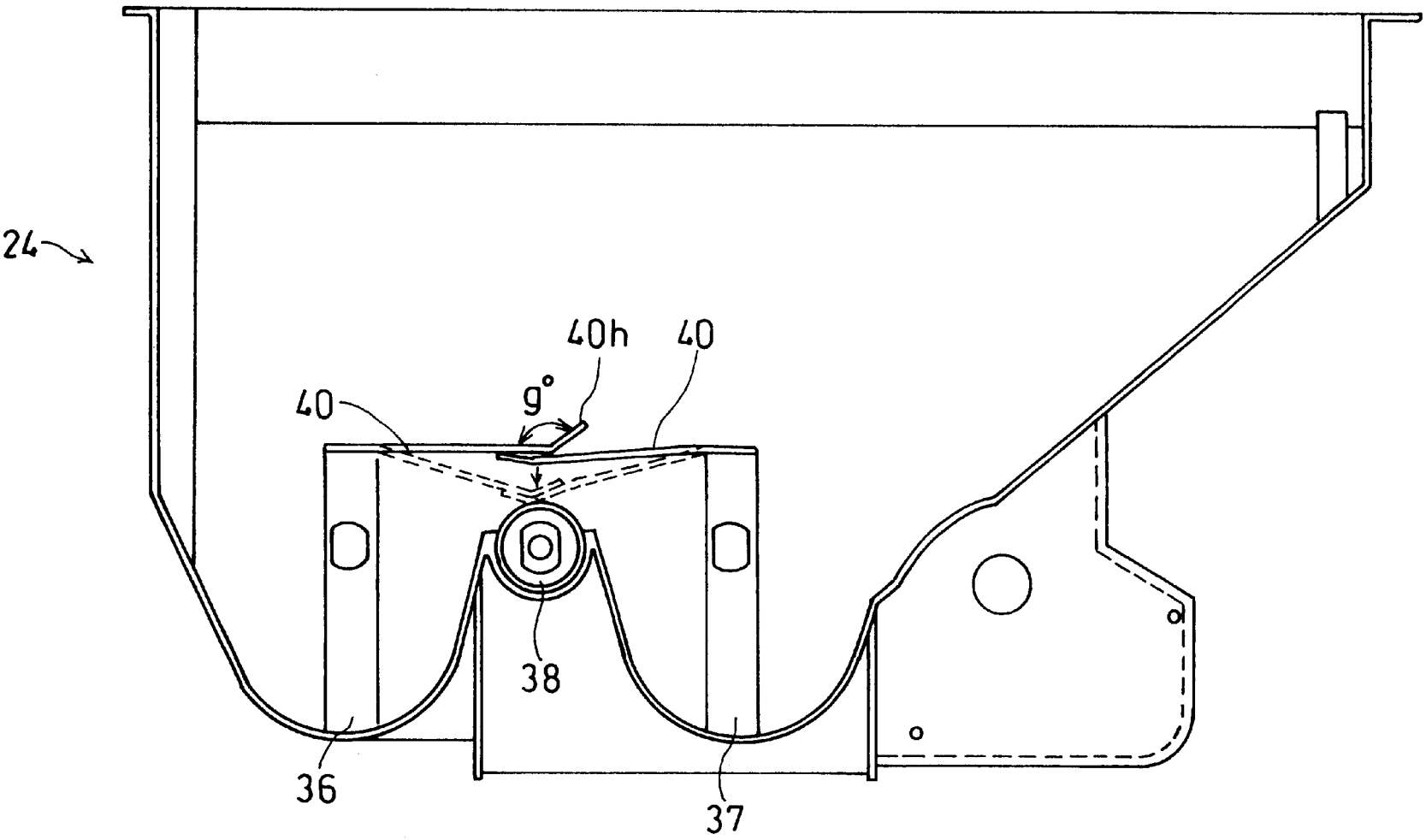
FIG. 38 is a cross section depicting an arrangement of a toner box in an image forming apparatus in accordance with still another example of the present invention.

More specifically, as shown in FIG. 38, the top end portion of each lifting section 40 is curved with respect to a rotation direction at an obtuse angle g° to form a bent portion 40*h*. The obtuse angle g° is in a range between 100° and 150° in the present example. In case that the toner is supplied from the upper portion of the toner box 24, the weight of the toner deforms the lifting sections 40 as is indicated by a dot line.

Thus, the bent portions 40*h* formed at the top end portions of the lifting sections 40 engage with each other as the lifting sections 40 deform, thereby making it possible to block the flow of the toner effectively. Consequently, the bent portions 40*h* can improve the effect of lifting up the toner to the toner transportation opening by means of the lifting sections 40 and the effect of preventing the flowing of replenished liquid toner.

EXAMPLE 17

An arrangement of the present example for preventing the flowing of the toner is the arrangement ⑥ in Table 2 above, that is, in addition to the arrangement ③ (making the lifting sections 40 into a double-layer structure), an elastic member is provided to a side surface of each lifting section 40.

Figures 39A, 39B:
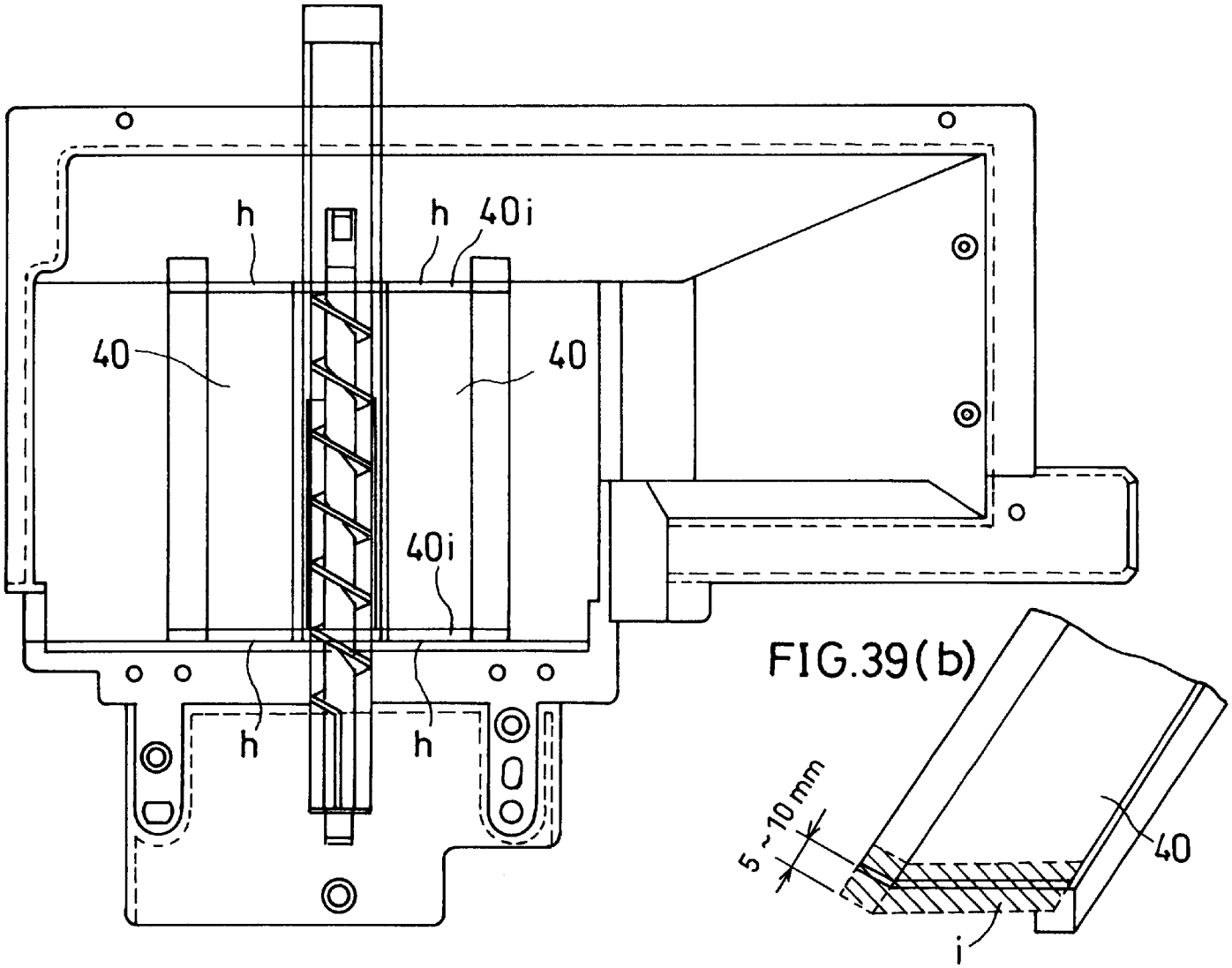
FIG. 39(*a*) is a top view explaining the toner box in an image forming apparatus in accordance with still another example of the present invention.

More specifically, as shown in FIG. 39(*a*), an elastic element (elastic member) 40*i* made of urethane or the like is placed to the side surface (diagonally shaded portion in the drawing) of each lifting sections 40. This arrangement makes it possible to prevent leakage of the toner from a side wall portion h when the lifting section 40 turns.

It should be appreciated that a material of the elastic element 40*i* is not limited to urethane, and the elastic element 40*i* can be of various kinds of elastic materials.

In the present example, as a result of the experiments, a thickness t of the elastic material 40*i* (urethane member herein) is set to 0.5 mm–1 mm, and the dimension of the protrusion from the end portion of the lifting section 40 is set to 5–10 mm as shown in FIG. 39(*b*). Consequently, the side surface portion can be sealed in a satisfactory manner without causing problems, such as a change in rotation torque of the toner stirring sections 36 and 37 or deformation of the lifting sections 40.

Of all the examples discussed above, the flowing of the toner is suppressed by adding various kinds of arrangements to the transportation screw 38 in Examples 1 through 11, whereas in Examples 12 through 17, the flowing of the toner is suppressed by using the lifting sections 40 provided to the toner stirring sections 36 and 37. In contrast, the examples explained below are arranged to further include flowing toner preventing means in the toner box 24.

EXAMPLE 18

In the present example, when the toner cartridge 25 is placed at the top portion of the toner box 24 to replenish the toner, an opening/closing shutter (lid) 24*c* of the toner box 24 is moved in association with a vibration plate 66 provided inside the toner box 24, so that the vibration plate 66 serves as the flowing toner preventing means.

Figure 40:
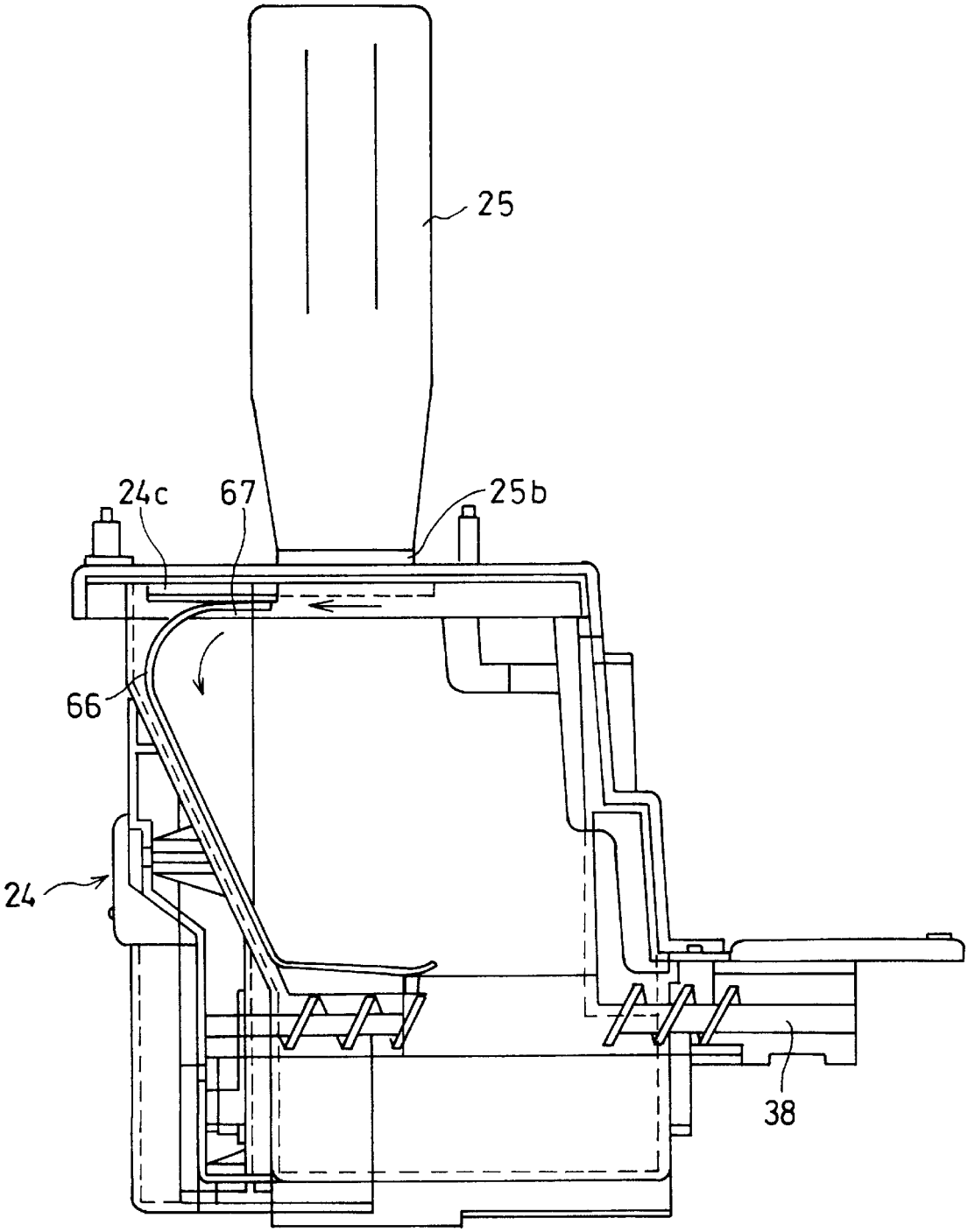
FIG. 40 is a cross section showing how a vibration plate moves inside the toner box in an image forming apparatus in accordance with still another example of the present invention.

An example arrangement to let the opening/closing shutter 24*c* move in association with the vibration plate 66 is shown in FIG. 40. That is, an end portion of the vibration plate 66 is fixed to a back surface portion 67 (interior of the toner box 24) of the opening/closing shutter 24*c* touching the replenish opening 25*b* of the toner cartridge 25.

Figure 41:
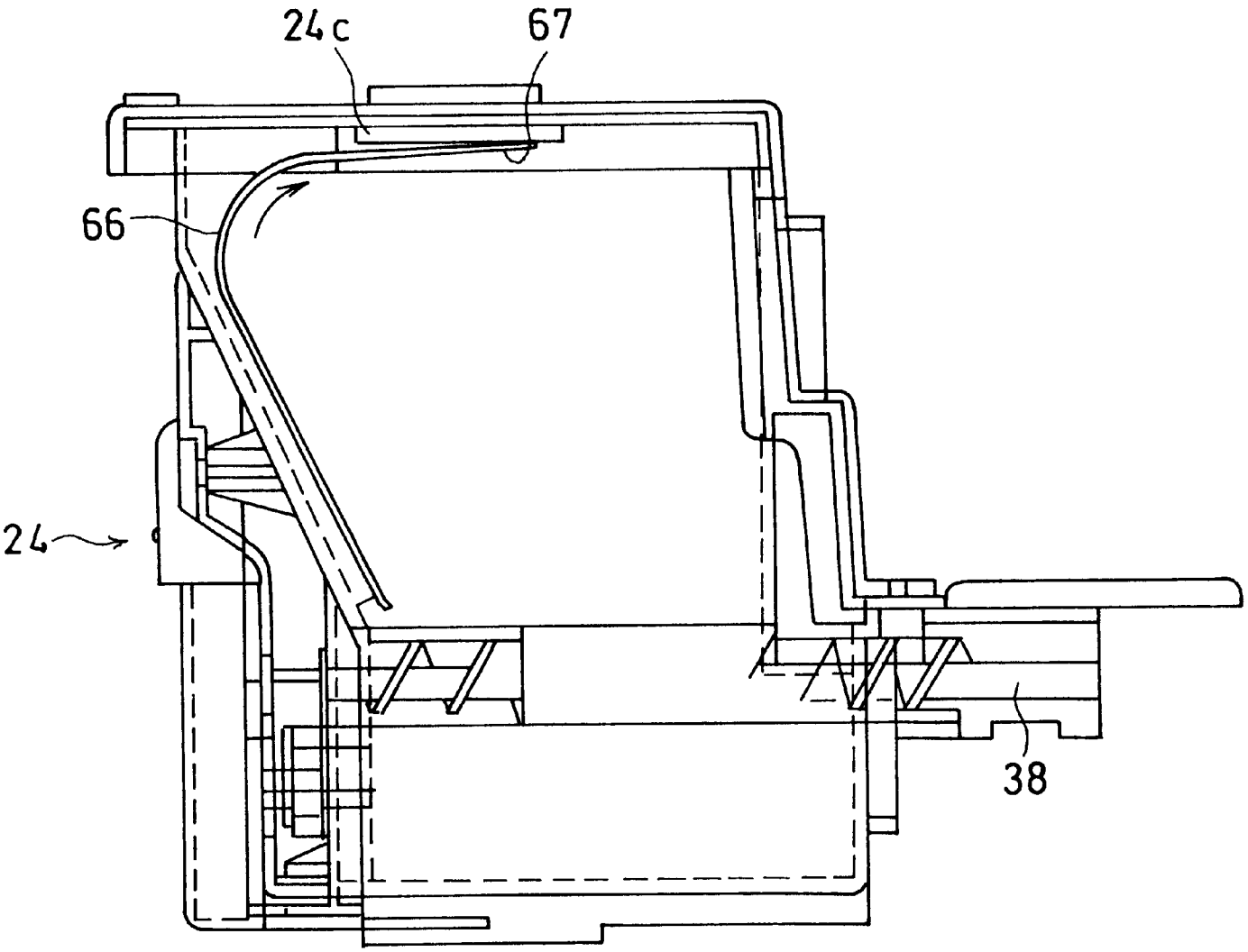
FIG. 41 is a cross section showing a state where the vibration plate has not moved in the toner box of FIG. 40.

In case that the toner cartridge 25 is not attached to the toner box 24, the vibration plate 66 is placed along the wall surface (tilted wall surface in the left side of FIG. 41) of the toner box 24 as shown in FIG. 41. In contrast, when the toner cartridge 25 is attached to the toner box 24, since the end portion of the vibration plate 66 is fixed to the back surface portion 67 of the opening/closing shutter 24*c* as shown in FIG. 40, the vibration plate 66 slides along the wall surface of the toner box 24 while being bent adequately, and moves in a direction indicated by an arrow.

The other end portion of the moved vibration plate 66 that is not fixed to the back surface portion 67 reaches the bottom surface of the toner box 24, whereby it covers the top portion (toner transportation opening) of the transportation screw 38. Thus, when the toner is replenished from the toner cartridge 25, the liquid toner can be controlled effectively so as not to flow through a space of the transportation screw 38.

The vibration plate 66 is not especially limited, and in the present example, a PET film having a thickness of 0.1–0.2 mm is used, for example. Accordingly, the opening/closing shutter 24*c* can move in association with the vibration plate 66 without causing any problem in its opening/closing action. Consequently, the toner transportation opening can be closed in a satisfactory manner.

EXAMPLE 19

In the present example, flowing toner preventing means is provided inside the toner box 24, and the adhesion of the toner to the flowing toner preventing means is suppressed by giving adequate vibrations to the flowing toner preventing means.

Figure 42:
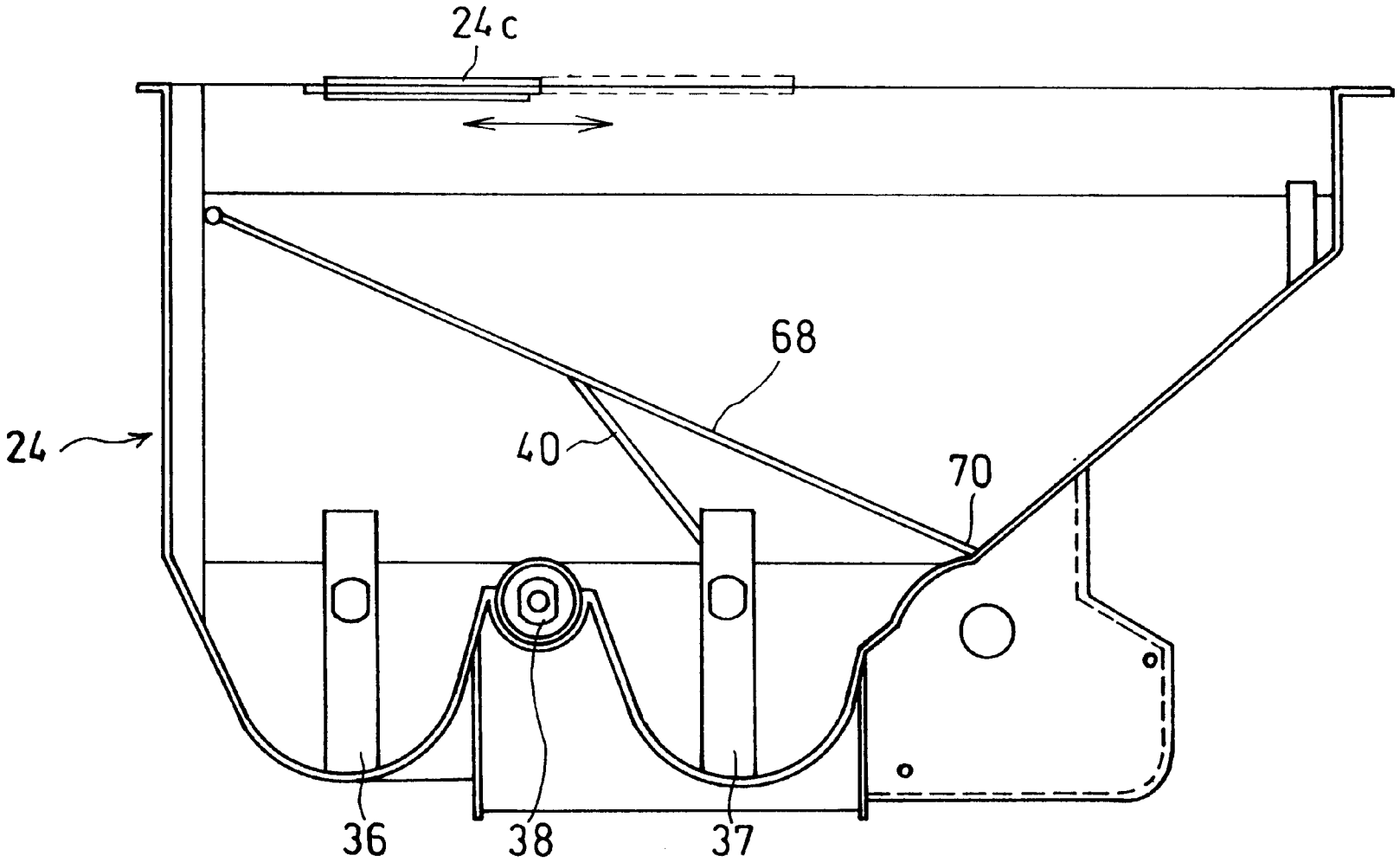
FIG. 42 is a cross section depicting an arrangement of a toner box and a flowing toner preventing section in an image forming apparatus in accordance with still another example of the present invention.

More specifically, as shown in FIG. 42, a plate of a flowing toner preventing section (flowing toner preventing means) 68 is provided in the toner box 24 at a position to allow the same to touch the lifting sections 40 of the toner stirring sections 36 and 37 while allowing the toner stirring sections 36 and 37 to rotate. According to this arrangement, adequate vibrations can be given to the flowing toner preventing section 68 as the toner stirring sections 36 and 37 rotate. Consequently, it has become possible to prevent the toner from adhering to the flowing toner preventing section 68.

The flowing toner preventing section 68 is provided to partition inside the toner box 24 completely. In this case, it is preferable to make 3–4 holes each having a diameter of 1–2 mm per 1 $cm^2$ through the flowing toner preventing section 68, because this can compensate a decrease in a quantity of the replenished toner as a result of reducing a withholding capacity of the toner box 24. In addition, it has become possible to control the liquid toner from flowing into the developing bath 10 (developing unit 29) regardless of a quantity thereof. Thus, the toner can be moved to a lower layer in the toner hopper 30 in an adequate manner.

EXAMPLE 20

In the present example, the flowing toner preventing section 68 of Example 19 above is arranged in such a manner that an end of the same is rotatable around the other end, and that the opening/closing shutter 24*c* moves in association with the flowing toner preventing section 68.

Figure 43:
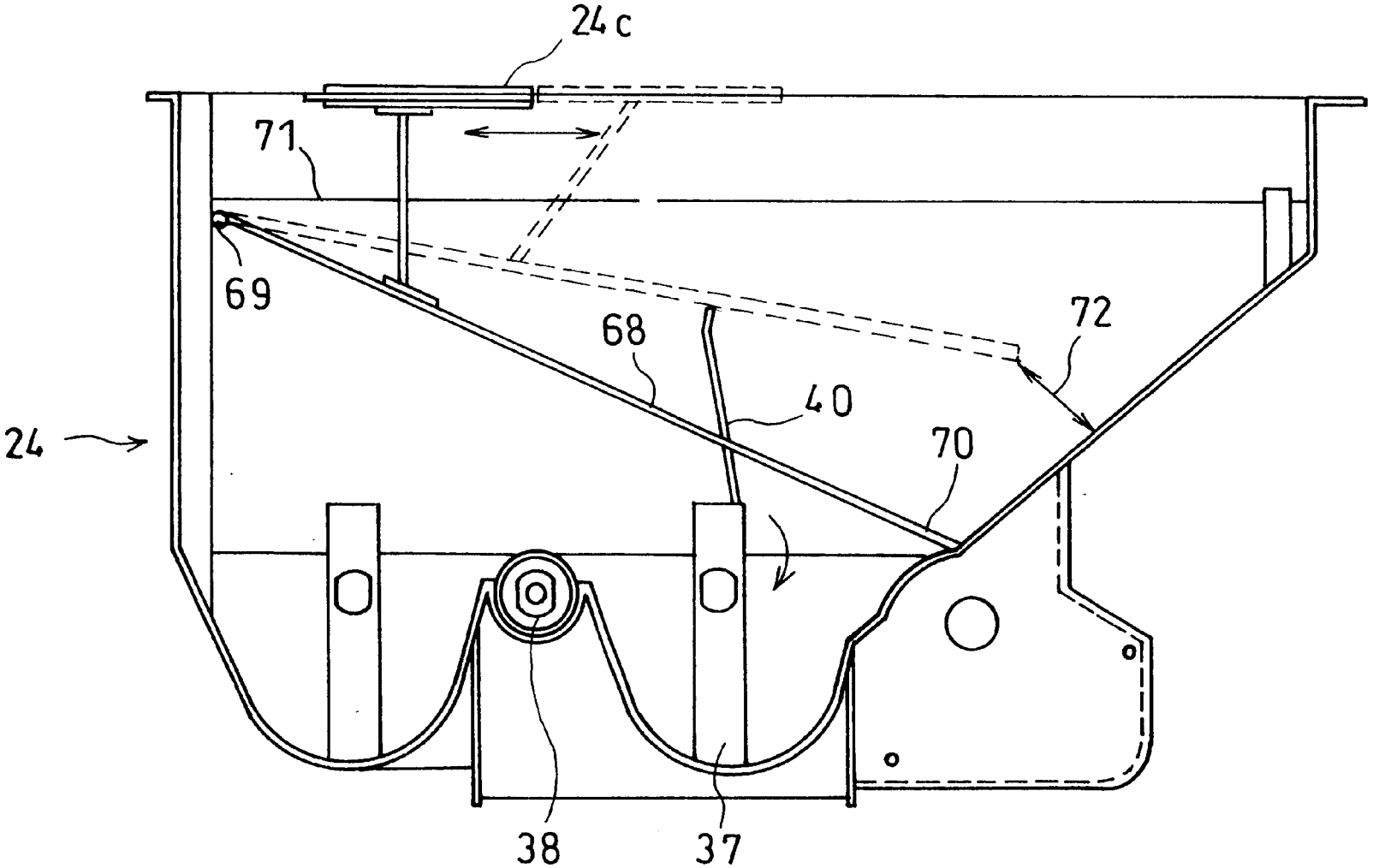
FIG. 43 is a cross section of a toner box depicting another arrangement of the flowing toner preventing section of FIG. 42.

More specifically, as shown in FIG. 43, the flowing toner preventing section 68 is tilted with one end portion 69 being higher than the other end portion 70, and the lower end portion 70 is made movable around the other upper end portion 69. Also, the opening/closing shutter 24*c* provided at the top portion of the toner box 24 is moved in association with the flowing toner preventing section 68 by means of an elastic element (elastic member) 71 made of PET or the like.

According to the above arrangement, when the opening/closing shutter 24*c* is open, the lower end portion 70 of the flowing toner preventing section 68 can be kept touched to the inner wall of the toner box 24. On the other hand, when the opening/closing shutter 24*c* is closed, the lower end portion 70 is moved so as to leave a space 72 with the inner wall of the toner box 24.

Consequently, the position setting of the flowing toner preventing section 68 can be changed, and a quantity of the flowing toner can be reduced as occasion demands. Also, when the opening/closing shutter 24*c* is closed, although the toner stirring section 37 operates, the lifting section 40 provided to the toner stirring section 37 does not touch the flowing toner preventing section 68 more than necessary (see FIG. 43), thereby allowing the toner stirring section 37 to rotate smoothly. It is preferable that the space 72 is 5 mm or across or larger.

Figure 50:
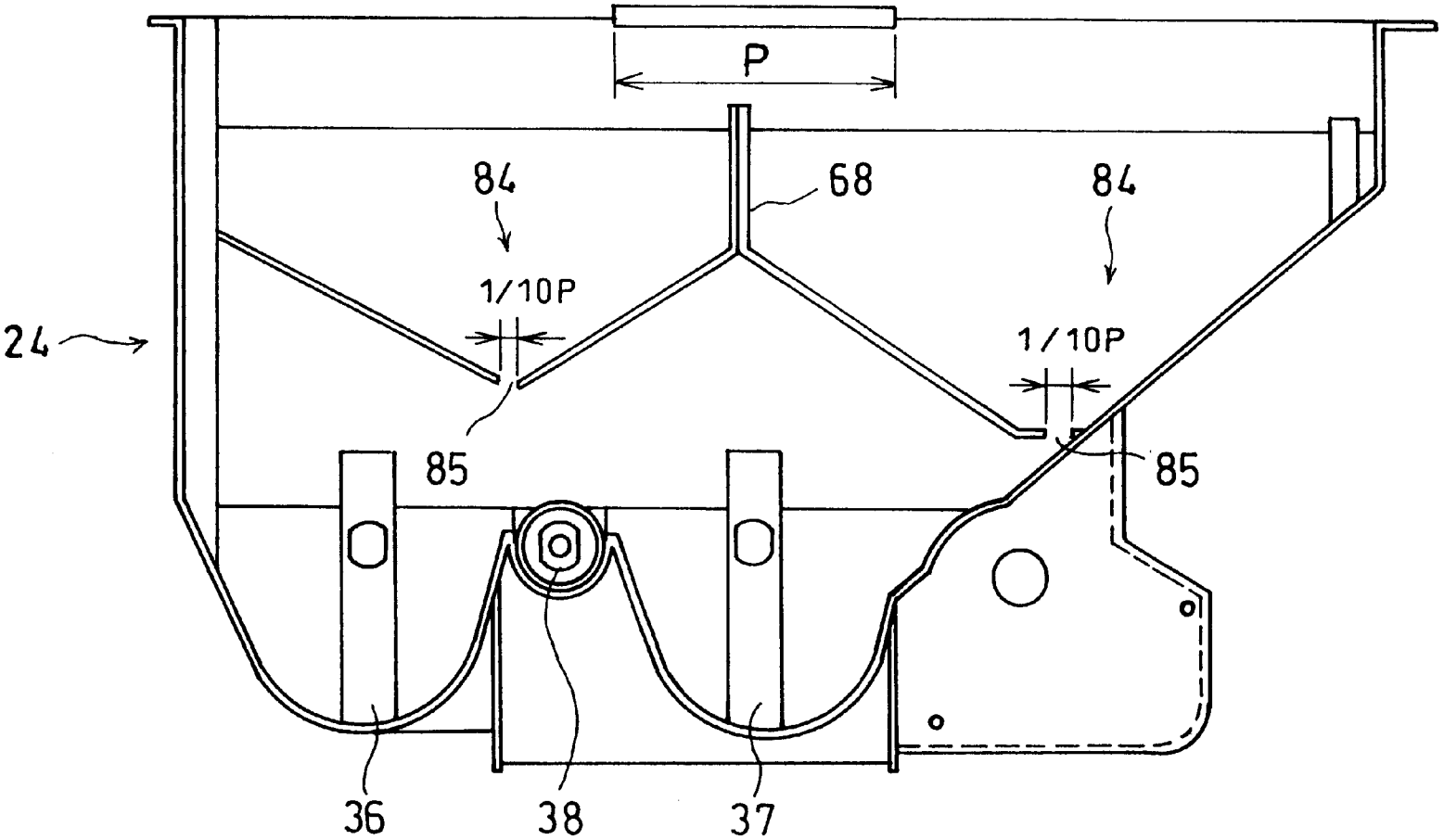
FIG. 50 is a cross section depicting an arrangement of a toner box and a flowing toner preventing section in an image forming apparatus in accordance with still another example of the present invention.

As shown in FIG. 50, the flowing toner preventing section 68 may have at least one valley portion 84 at a portion other than portion directly above the transportation screw 38. The valley portion 84 is furnished with a discharge opening 85, so that the toner replenished to the toner box 24 does not drop directly on the transportation screw 38.

In FIG. 50, two valley portions 84 are provided. To be more specific, a first valley portion 84*a* is provided near the toner stirring portion 36, and a second valley portion 84*b* is provided near the side surface of the toner box 24 which opposes the first valley portion 84*a* with having the transportation screw 38 inbetween (in other words, the side surface of the toner box 24 close to the toner stirring portion 37). The number of the valley portion(s) 84 is not especially limited, but providing at least two valley portions 84 is preferable to disperse the toner inside the toner box 24 in a satisfactory manner.

Given p as the size of the replenish opening, then it is preferable that the size of the discharge opening 85 is about $\frac{1}{10}$p. This arrangement makes it possible to control a quantity of the liquid toner flowing into the toner hopper 30, thereby reducing the flowing of the liquid toner into the developing unit 29 by simple means.

EXAMPLE 21

In the present example, the toner transportation opening inside the toner hopper 30 is opened/closed using the opening/closing action of the main body exterior portion carried out before the toner is replenished.

Figure 44:
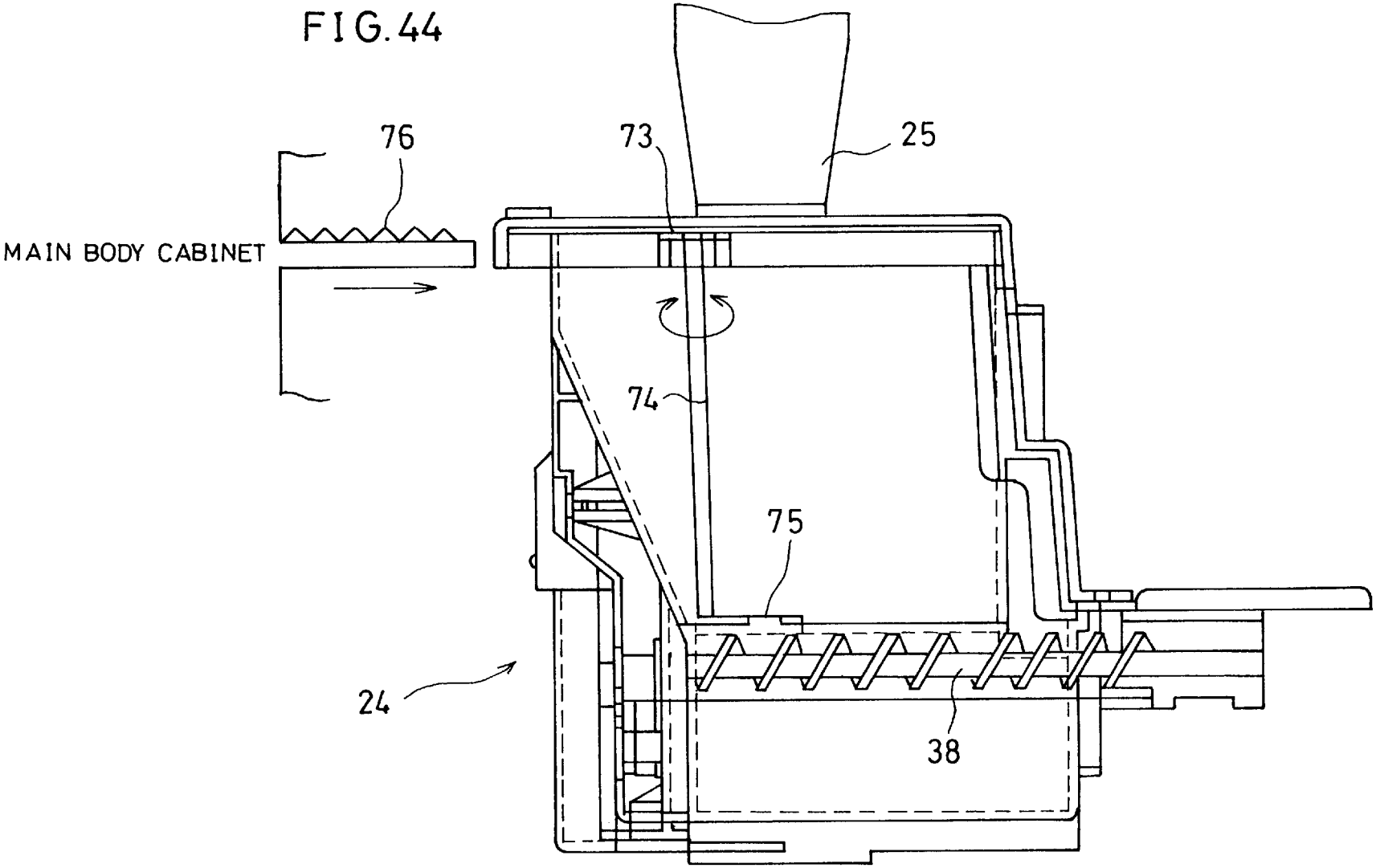
FIG. 44 is a cross section depicting an arrangement of a toner box and a transportation opening opening/closing section in an image forming apparatus in accordance with still another example of the present invention.

More specifically, as shown in FIG. 44, a toothed gear 73 is provided at the top portion of the toner box 24, a supporting shaft 74 which is allowed to rotate by the toothed gear 73, and a transportation opening opening/closing section (opening/closing member) 75 which opens/closes the toner transportation opening by means of the supporting shaft 74 are provided inside the toner box 24. Further, a driving rib 76, made into a shape having projections, for moving the toothed gear 73 is provided to the main body exterior portion.

According to this arrangement, each time the main body exterior portion is opened/closed, the driving rib 76 moves the toothed gear 73 to rotate the supporting shaft 74 for 180° in a direction indicated by an arrow in the drawing, so that the toner transportation opening is closed by moving the transportation opening opening/closing section 75. Consequently, the toner transportation opening can be opened/closed in advance when the front part of the main body exterior portion is opened/closed. In addition, even if vibrations are conveyed by a small impact caused when the developing unit 29 is pulled out from the main body, the toner does not flow into the developing unit 29.

Although it is not shown in the drawing, the mechanism of opening/closing the transportation opening opening/closing section 75 is not limited to the opening/closing action of the main body exterior portion, and can be the pull-out/push-in action of the developing unit 29 from/to the main body. Also, the main body exterior portion is not limited to the front part of the image forming apparatus (digital copying machine), and other portions are applicable as well. For example, the above mechanism is applicable to a large-sized copying machine, to which the toner is replenished by opening an upper portion of the main body.

Figure 49:
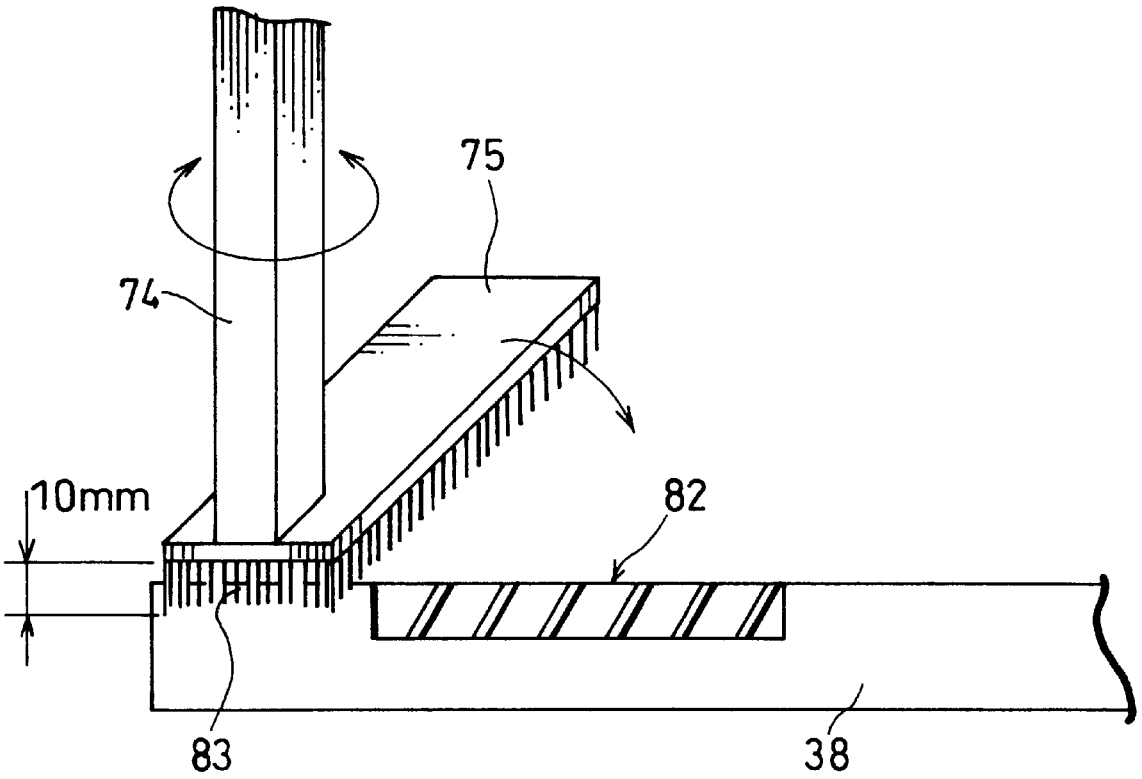
FIG. 49 is a view explaining another arrangement of the transportation opening opening/closing section of FIG. 44.

Further, as shown in FIG. 49, a brush (brush member) 83 having bristles of about 20 mm long may be provided to the transportation opening opening/closing section 75. This arrangement makes it possible to close a toner transportation opening 82 readily and more accurately, thereby suppressing the flowing of the liquid toner more effectively.

EXAMPLE 22

In the present example, the flowing of the liquid toner is suppressed by allowing the transportation screw 38 to move freely in an axial direction (longitudinal direction).

Figure 45:
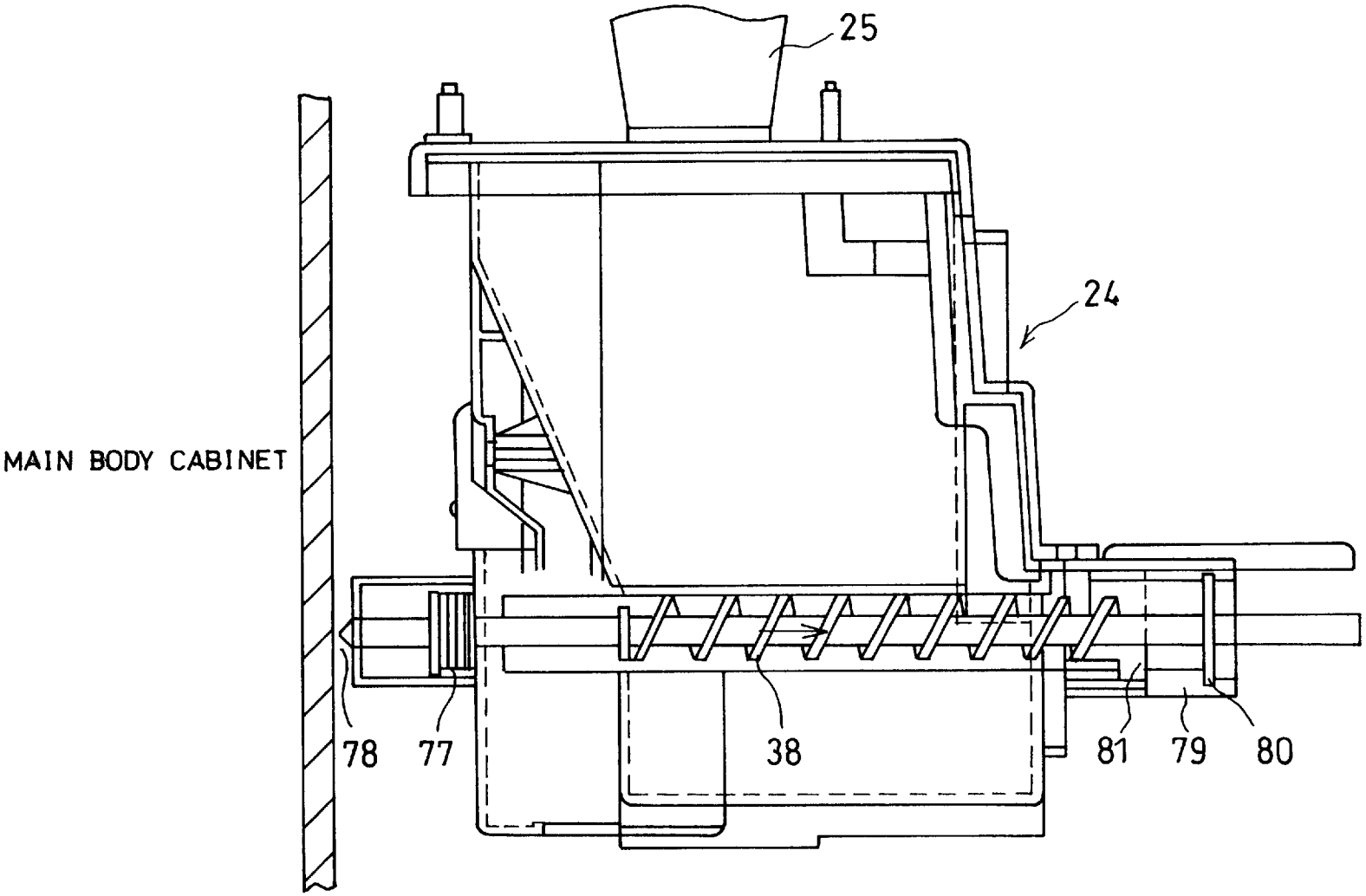
FIG. 45 is a cross section showing a relation of a main body exterior portion with respect to a toner box and a developing unit in an image forming apparatus in accordance with still another example of the present invention.
Figure 46:
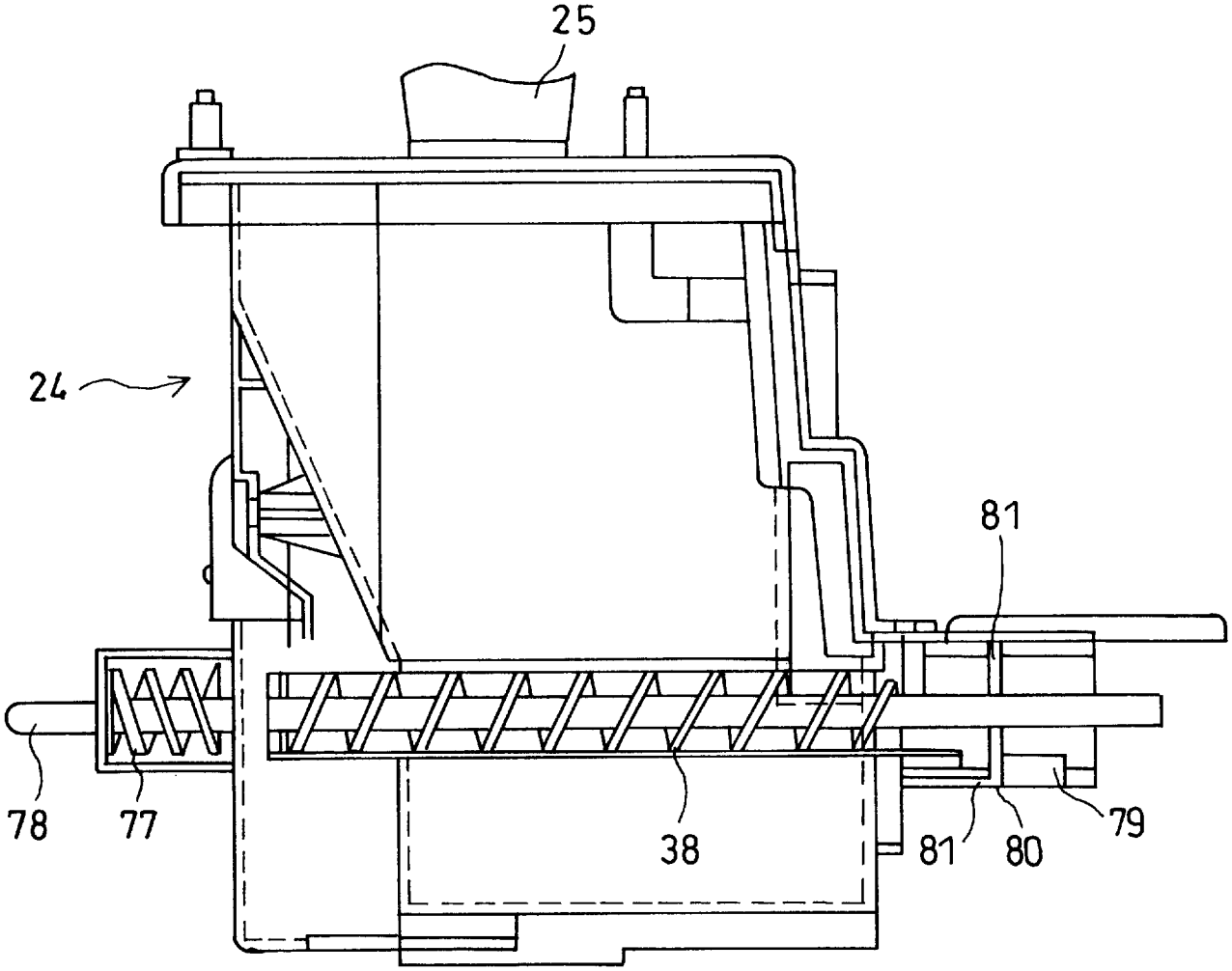
FIG. 46 is a cross section depicting an arrangement of the toner box and developing unit of FIG. 45.

More specifically, as shown in FIGS. 45 and 46, a spring (spring member) 77 is additionally provided to the transportation screw 38 installed inside the toner box 24. The spring 77 allows the transportation screw 38 to move in the axial direction freely. An end portion 78 of the supporting shaft of the transportation screw 38 at the main body exterior portion is arranged to move the transportation screw 38 in a direction opposite to the exterior portion when pushed by the same. In contrast, an end portion 80 opposing the end portion 78 is arranged to touch a wall surface portion 81 of a toner discharge opening 79 to close the same.

As has been mentioned, when the end portion 78 is pushed by the exterior portion, the transportation screw 38 moves in a direction indicated by an arrow, whereby the toner discharge opening 79 is opened. On the other hand, when the end portion 78 is released from the pushing, the transportation screw 38 moves toward the exterior portion by a force of the spring 77, and the end portion 80 touches the wall surface portion 81 of the toner discharge opening 79 to close the same. In other words, the transportation screw 38 per se serves as the flowing toner preventing means in the present example. This arrangement makes it possible to control the flowing of the liquid toner effectively.

Here, a moving stroke of the transportation screw 38 is determined by a thickness of a portion of the main body exterior portion that presses the end portion 78. Thus, the moving stroke can be determined arbitrary by changing the thickness of the pressing portion to satisfy the conditions which allow the transportation screw 38 to move in an adequate manner.

As has been explained, an image forming apparatus of the present invention, comprising:

a developing unit;

toner withholding means for withholding the toner; and toner transportation means for transporting the toner withheld in the toner withholding means to the developing unit, is characterized in that the toner transportation means includes:

a transportation screw having a supporting shaft and a spiral blade section formed thereon; and a pipe-wise member for controlling a toner transportation route by covering the transportation screw in an axial direction.

Accordingly, the flowing of liquid toner to the developing unit (developing device) can be controlled in a secure manner with a simple arrangement.

The image forming apparatus of the present invention may be arranged in such a manner that a space between a minor diameter of the pipe-wise member and a major diameter of the transportation screw becomes smaller toward a toner replenish opening of the toner withholding means.

Accordingly, a quantity of dropped toner can be stabilized as soon as the toner is replenished to a toner hopper from a toner cartridge. Consequently, it has become possible to control the flowing of the liquid toner to the developing unit effectively with a simple arrangement.

The image forming apparatus of the present invention may be arranged in such a manner that a toroidal sheet member made of an elastic member is provided to a cross section portion of the pipe-wise member, the toroidal sheet member having radial cuts, each extending from a minor diameter end toward a major diameter end.

Accordingly, not only the flowing of the liquid toner can be controlled with easy and inexpensive means, but also rotation torque of the transportation screw can be reduced by providing the radial cuts around the minor diameter of the toroidal sheet member.

The image forming apparatus of the present invention may be arranged in such a manner that a part of the pipe-wise member in a longitudinal direction is made of a cylindrical elastic member, and that the above part is placed to touch an exterior pitch of the transportation screw at least once while the transportation screw rotates.

Accordingly, a space between the blade section of the transportation screw and the pipe-wise member can be readily eliminated by providing the toroidal sheet member at a connected portion of the pipe-wise member. Further, according to the above arrangement, a load stress, caused when the transportation screw rotates while touching the pipe-wise member, can be curbed. Hence, the durability is improved satisfactorily and the flowing of the liquid toner can be prevented. In addition, the assembling efficiency can be improved.

The image forming apparatus of the present invention may be arranged in such a manner that an elastic member or a brush member is attached along an arc of the blade section of the transportation screw, so that either member touches the inner surface of the pipe-wise member while the transportation screw rotates.

Accordingly, a quantity of the flowing liquid toner can be reduced in an easy and inexpensive manner.

The image forming apparatus of the present invention may be arranged in such a manner that a groove is formed at a top end of the blade section of the transportation screw, so that the brush member is placed in the groove.

Accordingly, a space between the transportation screw and the inner surface of the pipe-wise member can be eliminated, thereby making it possible to control the flowing of the liquid toner. Consequently, a quantity of the transported toner can be stabilized, and irregular attachment of the brush member can be prevented.

The image forming apparatus of the present invention may be arranged in such a manner that a spring member is wrapped around along the blade section on the shaft of the transportation screw, and that a wrapping quality is at least one turn of the transportation screw.

Accordingly, the durability against the rotary operation can be improved, and the toner can be transported in a more stable manner.

The image forming apparatus of the present invention may be arranged in such a manner that, as fixing means of the spring member, a liner member wrapped around along the blade section on the shaft of the transportation screw is used, and that the linear member is fixedly wrapped around the transportation screw after the spring member is fitted through the same, while the fixing points of the spring member are provided on either side of the blade section of the transportation screw, so that the linear member is placed along that surface alone.

Accordingly, the assembling efficiency can be improved using inexpensive fixing means without adversely affecting a quantity of the transported toner.

An image forming apparatus of the present invention, comprising:

a developing unit;

toner withholding means for withholding the toner;

toner transportation means for transporting the toner withheld in the toner withholding means to the developing unit through a toner replenish opening, is characterized in that toner stirring means (toner stirring member) provided inside the toner withholding means closes a toner transportation opening when either an initial setting action or a toner replenishing action is carried out.

Accordingly, the momentum of the flowing toner can be reduced whenever the toner is poured. Consequently, excessive flowing of the liquid toner to the developing unit can be controlled with a simple arrangement.

The image forming apparatus of the present invention may be arranged in such a manner that a top end of the toner stirring means has an arc shape.

Accordingly, the toner transportation opening can be closed completely, thereby making it possible to further prevent the flowing of the liquid toner with a simple arrangement.

The image forming apparatus of the present invention may be arranged in such a manner that the toner stirring means is of a multi-layer structure having a first layer for closing a top surface of the toner transportation opening, and a second layer for touching a wall surface of a toner container at the downstream in the toner replenishing end.

Consequently, the flowing of the liquid toner can be prevented in a more secure manner compared with the toner stirring means of a single-layer structure.

The image forming apparatus of the present invention may be arranged in such a manner that a sheet of a reinforcing member is placed to a surface and/or a back surface of the toner stirring means.

Accordingly, the stiffness of the toner stirring means is improved, and the bending of lifting members caused by a weight of the replenished toner can be prevented. Consequently, a space between lifting members that overlap each other can be eliminated, thereby making it possible to prevent the flowing of the liquid toner furthermore effectively.

The image forming apparatus of the present invention may be arranged in such a manner that a portion curved at an obtuse angle with respect to a rotational direction is formed at a top end portion of the lifting members provided to stirring members installed inside the toner withholding means.

Accordingly, the bending of the lifting members can be prevented, and therefore, it has become possible to prevent the liquid toner from flowing through a space of the overlapped portion of the lifting members. Consequently, the effect of lifting the toner to the toner transportation opening and the sealing property against the replenished toner can be improved.

The image forming apparatus of the present invention may be arranged in such a manner that an elastic member is provided at a side surface of each lifting member provided to the stirring members installed inside the toner withholding means.

Accordingly, the leakage of the liquid toner from the side surface of the lifting members can be prevented and the flowing of the liquid toner can be prevented effectively.

An image forming apparatus of the present invention, comprising:

a developing unit:

toner withholding means for withholding toner; and toner transportation means for transporting the toner withheld in the toner withholding means to the developing unit through a toner replenish opening, is characterized by further comprising:

flowing toner preventing means (flowing toner preventing member) for closing a toner transportation opening in association with a toner replenishing action through the toner replenish opening.

Accordingly, the inside of a toner hopper can be partitioned whenever the toner is replenished. Consequently, it has become possible to prevent in advance the toner from flowing to the developing unit when the toner is replenished.

The image forming apparatus of the present invention may be arranged in such a manner that vibrations are given to the flowing toner preventing means in association with a stirring action of toner stirring means.

Accordingly, the liquid toner adhering to the flowing toner preventing members can be removed by the vibrations. Consequently, it has become possible to prevent the flowing of the liquid toner more effectively.

An image forming apparatus of the present invention, comprising:

a developing unit:

toner withholding means for withholding toner; and toner transportation means for transporting the toner withheld in the toner withholding means to the developing unit through a toner replenish opening, is characterized in that:

the toner withholding means includes flowing toner preventing means for closing a toner transportation opening in association with a toner replenishing action, the flowing toner replenishing means forming a discharge opening smaller than the toner replenish opening.

Accordingly, the flowing of the liquid toner can be prevented in a secure manner with a simple and inexpensive arrangement.

An image forming apparatus of the present invention, comprising:

a developing unit:

toner withholding means for withholding toner; and toner transportation means for transporting the toner withheld in the toner withholding means to the developing unit through a toner replenish opening, is characterized in that:

the toner withholding means includes flowing toner preventing means for closing a toner transportation opening in association with an opening/closing action of a main body external portion of the image forming apparatus.

Accordingly, the flowing of the toner to the developing unit can be prevented by utilizing the opening/closing action of the main body exterior portion taken before the toner is replenished from a toner cartridge to the toner withholding means. Consequently, it has become possible to prevent the flowing of the toner beforehand with an inexpensive arrangement.

The image forming apparatus of the present invention may be arranged in such a manner that an end portion of a transportation screw provided inside the toner withholding means closes a toner transportation opening.

Accordingly, the flowing of the liquid toner can be prevented in a secure manner with simple and inexpensive mechanism.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a developing device for developing an image of an original document on a recording medium by using toner;

toner withholding means for withholding the toner; and toner transportation means for transporting the toner withheld in said toner withholding means to said developing device, wherein said toner transportation means includes:

a transportation screw having a supporting shaft and a blade section formed thereon;

a pipe-wise member for covering said transportation screw in a direction along said supporting shaft; and toner flow suppressing means for suppressing flow of the toner from a space between said transportation screw and said pipe-wise member said toner flow suppressing means being provided to touch at least a part of an inner wall surface of said pipe-wise member in such a manner that contact with said blade section is allowed.

2. The image forming apparatus of claim 1, wherein:

said toner flow suppressing means is a toroidal sheet member made of an elastic material and provided to an interior of said pipe-wise member; and said toroidal sheet member has radial cuts, each extending from a minor diameter end to a major diameter end.

3. The image forming apparatus of claim 1, wherein:

said toner flow suppressing means is a cylindrical elastic material which forms a part of said pipe-wise member; and said elastic material has an inside diameter that allows contact with an exterior portion of the spiral blade section of said transportation screw and a length that allows contact with a pitch of the spiral blade section at least once.

4. An image forming apparatus comprising:

a developing device for developing an image of an original document on a recording medium by using toner;

toner withholding means for withholding the toner; and toner transportation means for transporting the toner withheld in said toner withholding means to said developing device, wherein said toner transportation means includes:

a transportation screw having a supporting shaft and a blade section formed thereon; and a pipe-wise member for covering said transportation screw in a direction along said supporting shaft, a space between an inside diameter of said pipe-wise member and an exterior of said transportation screw becomes smaller toward a toner replenish opening of said developing device.

5. An image forming apparatus comprising:

a developing device for developing an image of an original document on a recording medium by using toner;

toner withholding means for withholding the toner; and toner transportation means for transporting the toner withheld in said toner withholding means to said developing device, wherein said toner withholding means includes toner stirring means inside, said toner stirring means closing a toner transportation opening formed at said toner withholding means when at least one of an initial setting action and a toner replenishing action is carried out.

6. The image forming apparatus of claim 5, wherein a portion of said toner stirring means that closes said toner transportation opening is a lifting member formed at an end portion of said toner stirring means to lift the toner withheld in said toner withholding means to said toner transportation opening.

7. The image forming apparatus of claim 6, wherein a top end of said lifting member has an arc shape that conforms to a shape of said toner transportation opening.

8. The image forming apparatus of claim 6, wherein said lifting member is of a multi-layer structure having at least a first layer and a second layer, said first layer closing a top surface portion of said toner transportation opening, said second layer touching a wall surface of said toner withholding means at a downstream end in a direction in which replenished toner flows in.

9. The image forming apparatus of claim 8, wherein a sheet of a reinforcing member is placed to a surface and/or a back surface of said lifting member.

10. The image forming apparatus of claim 6, wherein a portion curved to an end opposing a rotational direction of said toner stirring means is formed at a top end portion of said lifting member.

11. The image forming apparatus of claim 6, wherein an elastic member is provided at a side surface of said lifting member.

12. An image forming apparatus comprising:

a developing device for developing an image of an original document on a recording medium by using toner;

toner withholding means having a toner replenish opening for withholding the toner replenished therefrom; and toner transportation means for transporting the toner withheld in said toner withholding means to said developing device, wherein said toner withholding means includes flowing toner preventing means inside, said flowing toner preventing means being movable to a position to cover said toner transportation means with respect to said toner replenish opening.

13. The image forming apparatus of claim 12, wherein said toner withholding means includes toner stirring means inside, said toner stirring means being placed at a position to give vibrations to said flowing toner preventing means in association with a stirring action.

14. The image forming apparatus of claim 12, wherein:

said flowing toner preventing means has at least one valley portion inside said toner withholding means at a portion other than a portion directly above said toner transportation means; and said valley portion has a discharge opening which is smaller than said toner replenish opening.

15. An image forming apparatus comprising:

a developing device for developing an image of an original document on a recording medium by using toner;

toner withholding means for withholding the toner; and toner transportation means for transporting the toner withheld in said toner withholding means to said developing device; and a replenish opening through which the toner is replenished to said toner withholding means, said replenish opening being opened/closed by a lid, wherein said toner withholding means includes flowing toner preventing means inside, said flowing toner preventing means being movable to close a toner transportation opening formed at said toner transportation means when said lid is open, and to open said toner transportation opening when said lid is closed.

16. The image forming apparatus of claim 15, wherein said flowing toner preventing means is a vibration plate provided inside said toner withholding means.

17. An image forming apparatus comprising:

a developing device for developing an image of an original document on a recording medium by using toner;

toner withholding means for withholding the toner; and toner transportation means for transporting the toner withheld in said toner withholding means to said developing device, wherein said toner withholding means includes flowing toner preventing means, said flowing toner preventing means closing a toner transportation opening provided at said toner transportation means in association with an opening/closing action of a main body exterior portion of said image forming apparatus.

18. The image forming apparatus of claim 17, wherein said flowing toner preventing means includes:

a driving rib formed at the main body exterior portion;

a toothed gear driven by said driving rib;

a supporting shaft having said toothed gear at one end and rotating in association with a movement of said toothed gear; and a transportation opening opening/closing member, provided at the other end of said supporting shaft, for opening/closing said toner transportation opening in association with a rotation of said supporting shaft.

19. The image forming apparatus of claim 17, wherein said flowing toner preventing means is provided in such a manner to move with respect to said toner transportation means so as to close said toner transportation opening at an end portion thereof, said flowing toner preventing means being a transportation screw provided to said transportation means.

20. An image forming apparatus comprising:

a developing device for developing an image of an original document on a recording medium by using toner;

toner withholding means for withholding the toner; and toner transportation means for transporting the toner withheld in said toner withholding means to said developing device, wherein said toner transportation means includes:

a transportation screw having a supporting shaft and a blade section formed thereon;

a pipe-wise member for covering said transportation screw in a direction along said supporting shaft; and toner flow suppressing means for suppressing flow of the toner from a space between said transportation screw and said pipe-wise member, said toner flow suppressing means being provided to said transportation screw along said blade section in such a manner that contact with an inner wall of said pipe-wise member is allowed.

21. The image forming apparatus of claim 20, wherein:

said toner flow suppressing means is an elastic member attached along an arc of the spiral blade section of said transportation screw; and said elastic member is allowed to contact an inner surface of said pipe-wise member when said transportation screw rotates.

22. The image forming apparatus of claim 20, wherein:

said toner flow suppressing means is a brush member attached along an arc of the spiral blade section of said transportation screw; and said brush member is allowed to touch an inner surface of said pipe-wise member when said transportation screw rotates.

23. The image forming apparatus of claim 22, further comprising a groove portion at a top end of the spiral blade section of said transportation screw, said brush member being attached to said transportation screw by being fitted into said groove portion.

24. The image forming apparatus of claim 20, wherein:

said toner flow suppressing means is a spring member wrapped around the supporting shaft of said transportation screw along the spiral blade section thereof; and said spring member is wrapped around the supporting shaft in a length at least as long as a pitch of the spiral blade section.

25. The image forming apparatus of claim 24, wherein:

as fixing means for fixedly wrapping said spring member around the supporting shaft of said transportation screw, a linear member which can be fixedly wrapped around the supporting shaft along the spiral blade section of said transportation screw is used; and said linear member fixes said spring member by being fitted through said spring member first and thence wrapped around the supporting shaft.

26. The image forming apparatus of claim 25, wherein said spring member is fixed by said linear member on and along only one of surfaces of the spiral blade section of said transportation screw.

* * * * *